US005374046A

United States Patent [19]

Toki et al.

[11] Patent Number: 5,374,046

[45] Date of Patent: Dec. 20, 1994

[54] FEEDING APPARATUS

[75] Inventors: Hirotaka Toki, Kashihara; Osamu Wakuda, Yamatotakada; Hiranaga Yamamoto; Hiroyuki Nagao, both of Nara, all of Japan

[73] Assignee: Sharp Kabushiki Kaisha, Osaka, Japan

[21] Appl. No.: 872,964

[22] Filed: Apr. 23, 1992

[30] Foreign Application Priority Data

Apr. 23, 1991 [JP] Japan ..... 3-92111

[51] Int. Cl.[5] ..... B65H 3/44

[52] U.S. Cl. ..... 271/9; 271/164; 271/159

[58] Field of Search ..... 271/145, 162, 164, 157, 271/158, 159, 9

[56] References Cited

U.S. PATENT DOCUMENTS

| | | | |
|---|---|---|---|
| 4,451,191 | 5/1984 | Torre | 271/157 X |
| 4,998,137 | 3/1991 | Ida et al. . | |
| 5,002,267 | 3/1991 | Brecy | 271/9 |
| 5,003,493 | 3/1991 | Okada et al. . | |
| 5,028,042 | 7/1991 | Yamada et al. . | |
| 5,046,715 | 7/1991 | Taniguchi et al. | 271/164 |
| 5,052,671 | 10/1991 | Matsuo | 271/9 |
| 5,065,995 | 11/1991 | Iwamoto et al. | 271/9 |
| 5,071,111 | 12/1991 | Iwamoto et al. . | |
| 5,076,561 | 12/1991 | Matsuo . | |
| 5,076,562 | 12/1991 | Sai et al. | 271/241 X |
| 5,076,563 | 12/1991 | Namba et al. . | |
| 5,083,767 | 1/1992 | Iwamoto et al. | 271/162 X |
| 5,100,122 | 3/1992 | Noda et al. . | |
| 5,150,890 | 9/1992 | Kunikawa et al. | 271/162 X |

FOREIGN PATENT DOCUMENTS

| | | | |
|---|---|---|---|
| 370836 | 5/1990 | European Pat. Off. . | |
| 398659 | 11/1990 | European Pat. Off. . | |
| 3150190 | 6/1983 | Germany . | |
| 56-59245 | 5/1981 | Japan . | |
| 56-59251 | 5/1981 | Japan . | |
| 56-121059 | 9/1981 | Japan . | |
| 59-123859 | 7/1984 | Japan . | |
| 59-124634 | 7/1984 | Japan . | |
| 60-248532 | 12/1985 | Japan . | |
| 60-262735 | 12/1985 | Japan . | |
| 0262735 | 12/1985 | Japan | 271/241 |
| 0132021 | 5/1990 | Japan | 271/162 |
| 2127328 | 5/1990 | Japan . | |
| 2205861 | 8/1990 | Japan . | |
| 2209327 | 8/1990 | Japan . | |
| 0295827 | 12/1990 | Japan | 271/162 |

*Primary Examiner*—H. Grant Skaggs
*Assistant Examiner*—Carol Lynn Druzbick

[57] ABSTRACT

A feeding apparatus has a large turntable mounted rotatably on a tray and two paper cassettes installed on the turntable. The paper cassette are movable in a radial direction of rotation of the turntable. Carriage driving mechanisms for moving the paper cassettes are controlled to move the respective paper cassettes to positions closest to the axis of rotation of the turntable when rotating the turntable so that the space occupied by the paper cassettes is minimized. A 180-degree rotation mechanism for rotating the turntable is controlled to rotate the turntable after the respective paper cassettes are moved to the positions closest to the axis of rotation of the turntable, for interchanging the paper cassette on a feeding side and the paper cassette on a non-feeding side. This enables a reduction in the size of the apparatus, irrespective of the sizes and positions of the paper cassettes on the feeding side and non-feeding side.

14 Claims, 48 Drawing Sheets

No : PATTERN No

FIG. 24

| CONSTITUENT OPERATIONS OF PATTERNS | | | | SWITCHING |
|---|---|---|---|---|
| No. | BASIC PATTERN | No. | REVERSE PATTERN | |
| 1 | OPERATION 1 | 7 | REVERSE OPERATION 1 | MODE 1<br>↓ ↑<br>MODE 2 |
| 2 | REVERSE OPERATION 2<br>↓<br>OPERATION 4<br>↓<br>OPERATION 2 | 8 | OPERATION 2<br>↑<br>REVERSE OPERATION 4<br>↑<br>REVERSE OPERATION 2 | MODE 1<br>↓ ↑<br>MODE 3 |
| 3 | REVERSE OPERATION 2<br>↓<br>OPERATION 4<br>↓<br>OPERATION 3 | 9 | OPERATION 2<br>↑<br>REVERSE OPERATION 4<br>↑<br>REVERSE OPERATION 3 | MODE 1<br>↓ ↑<br>MODE 4 |
| 4 | OPERATION 1 | 10 | REVERSE OPERATION 1 | MODE 3<br>↓ ↑<br>MODE 4 |
| 5 | REVERSE OPERATION 3<br>↓<br>OPERATION 4<br>↓<br>OPERATION 3 | 11 | OPERATION 3<br>↑<br>REVERSE OPERATION 4<br>↑<br>REVERSE OPERATION 3 | MODE 2<br>↓ ↑<br>MODE 4 |
| 6 | REVERSE OPERATION 3<br>↓<br>OPERATION 4<br>↓<br>OPERATION 2 | 12 | OPERATION 3<br>↑<br>REVERSE OPERATION 4<br>↑<br>REVERSE OPERATION 2 | MODE 2<br>↓ ↑<br>MODE 3 |

FEEDING APPARATUS

FIELD OF THE INVENTION

The present invention relates to a feeding apparatus which, for example, is used in a copying machine.

BACKGROUND OF THE INVENTION

For example, a copying machine incorporates a feeding apparatus that supplies paper onto which an image on a document is to be copied. There has been a great demand for paper feeding apparatuses that are capable of supplying paper of various sizes according to the size of a document to be copied and in response to requests for making enlarged and reduced copies.

The following are some examples of conventional paper feeding apparatuses of this type. An apparatus shown in FIGS. 50 and 51 is provided with a plurality of box-shaped paper cassettes 62 which are mounted around a rotatable supporting rod 61. In this feeding apparatus, it is arranged that the feeding direction and axial direction of the supporting rod 61 are parallel and that any of the paper cassettes 62 can be selectively placed in front of the feeding opening 64 of the main body 63 by rotating the supporting rod 61.

As for next example, as illustrated in FIGS. 52 and 53, an apparatus includes a rotatable circular plate 51 on which a plurality of paper guides 52 are mounted. The circular plate 51 and paper guides 52 form a plurality of paper trays 54 for storing paper 53. In this case, by rotating the circular plate 51, the paper 53 is supplied from the respective paper trays 54 to the main body of a copying machine.

Usually, in order to achieve an effective use of space, a paper feeding apparatus is installed, for example, under a copying machine. And to supply various types of paper, such paper feeding apparatuses of reduced heights are installed over a plurality of stages. However, in the case of the paper feeding apparatus shown in FIGS. 50 and 51, the paper cassettes 62 are attached to the supporting rod 61. Therefore, this feeding apparatus when installed under a copying machine prevents an effective use of space. In other words, if such a feeding apparatus is incorporated into a copying machine, it causes an increase in the size of the copying machine overall.

As for the paper feeding apparatus shown in FIGS. 52 and 53, it can be installed under a copying machine so as to achieve an effective use of space. However, the apparatus was developed without considering a decrease in the plane space occupied by the rotatable circular plate 51 during rotation. Thus, similar to the above case, incorporation of the apparatus into a copying machine results in an increase in the size of the copying machine.

SUMMARY OF THE INVENTION

An object of the present invention is to reduce the size of an apparatus by decreasing a space necessary for interchanging paper cassettes.

In order to achieve the above object, a feeding apparatus of the present invention includes:

(1) a plurality of storing means for storing copy material;

(2) a rotatable carrying member for carrying the storing means, the storing means being freely movable in a radial direction of rotation;

(3) moving means for moving the respective storing means in a radial direction of rotation of the carrying member;

(4) movement controlling means which controls the moving means to move the respective storing means to positions closest to the axis of rotation of the carrying member for minimizing the space occupied by the respective storing means during the rotation of the carrying member; and (5) rotation controlling means which controls rotating means to interchange the storing means on a feeding side and the storing means on a non-feeding side after the respective storing means are moved to the positions closest to the axis of rotation of the carrying member. In this apparatus, copy material stored in the storing means located on the feeding side is fed in the feeding direction.

With this configuration, when interchanging the storing means on the feeding side and the storing means on the non-feeding side, firstly, the movement controlling means controls the moving means to move the respective storing means to the positions closest to the axis of rotation of the carrying member. Then, the rotation controlling means controls the rotation means to rotate the carrying member. As a result, the storing means on the feeding side and the storing means on the non-feeding side are interchanged.

In the series of operations, when the carrying member is rotated, the respective storing means are also rotated. At this time, by moving the respective storing means to the positions closest to the axis of rotation, the space occupied by the respective storing means during rotation is minimized. In consequence, irrespective of the sizes of the storing means on the feeding side and on the non-feeding side and of their positions, i.e., whether they are placed lengthways or sideways, the storing means on the feeding side and the storing means on the non-feeding side are interchanged with a minimum turning space. This enables a decrease in the size of the apparatus.

For a fuller understanding of the nature and advantages of the invention, reference should be made to the ensuing detailed description taken in conjunction with the accompanying drawings.

BRIEF DESCRIPTION OF THE DRAWINGS

FIG. 24 is an explanatory view illustrating operations constituting the mode switching patterns shown in FIG. 23, controlled by a microcomputer shown in FIG. 18.

DESCRIPTION OF THE EMBODIMENTS

Figure 1:
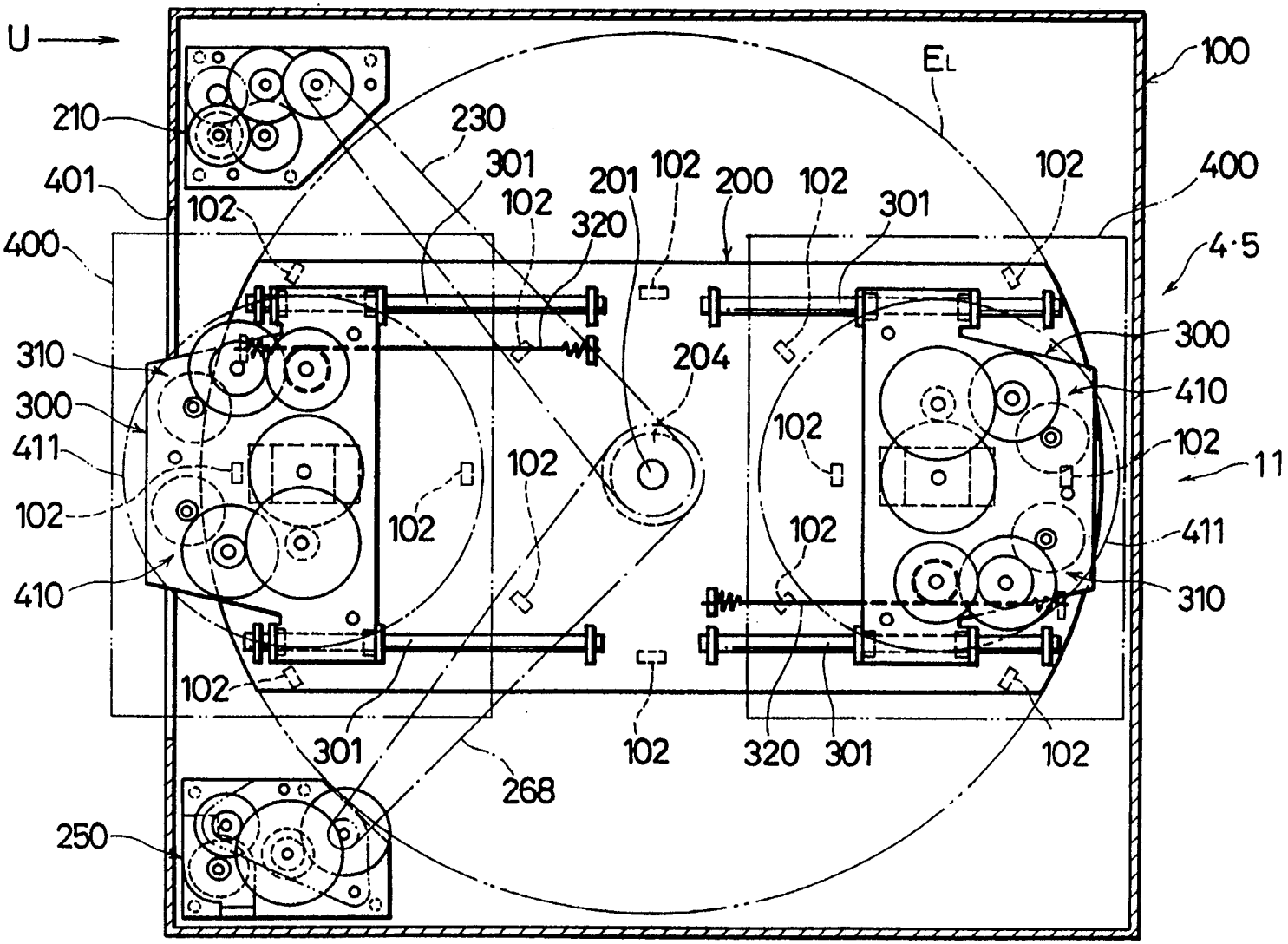
FIG. 1 is a plan view illustrating a rotatable cassette unit according to one embodiment of the present invention.
Figure 52:
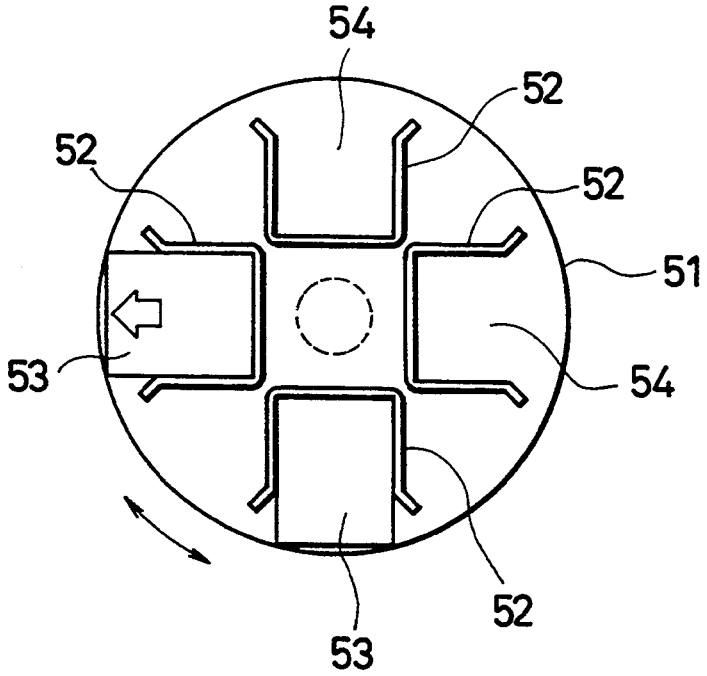
FIG. 52 PRIOR ART
FIG. 52 is a schematic plan view illustrating another conventional paper feeding apparatus.
Figure 53:
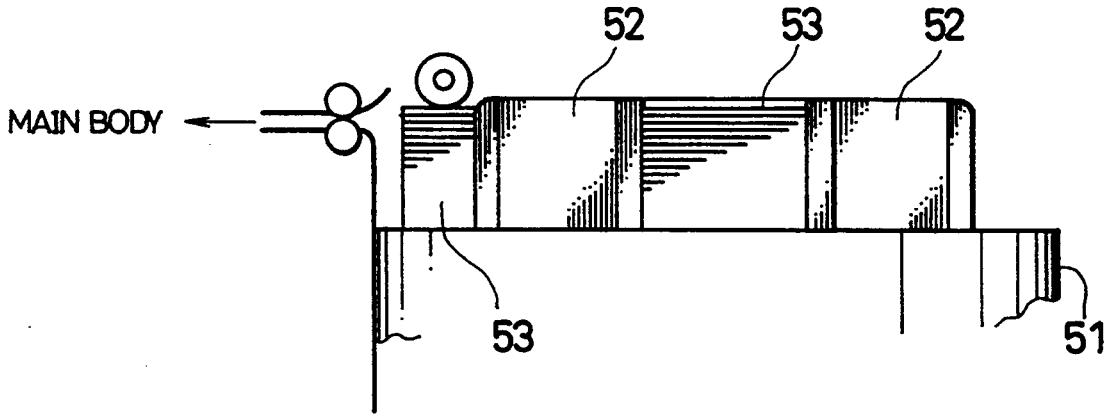
FIG. 53 PRIOR ART
FIG. 53 is a schematic front view illustrating a paper feeding state of the paper feeding apparatus shown in FIG. 52.

With reference to FIGS. 1 through 52, the following will describe one embodiment of the present invention.

Figure 3:
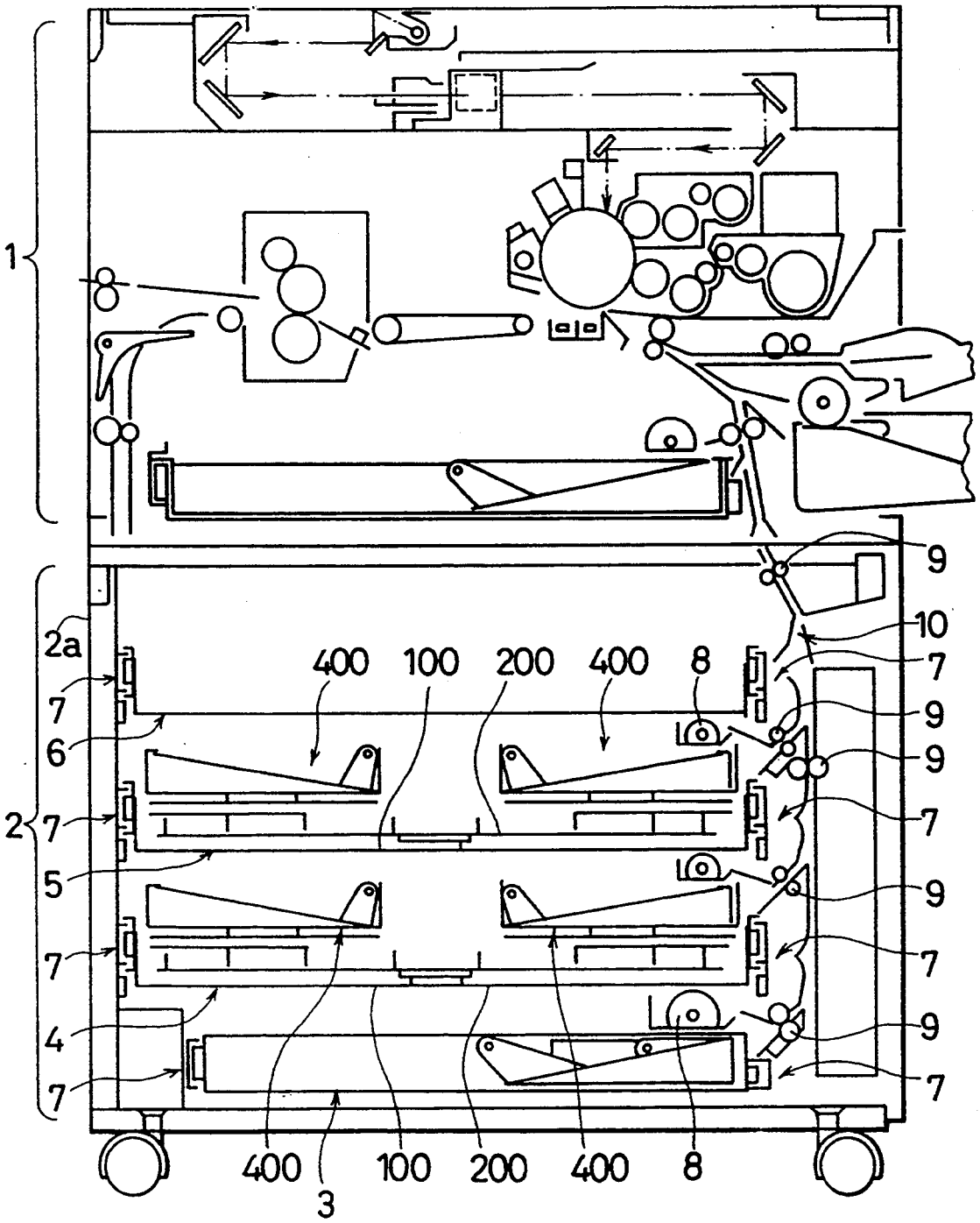
FIG. 3 is a front view illustrating the structure of a copying machine including a multi-stage feeding device having the rotatable cassette unit shown in FIG. 1.

As illustrated in FIG. 3, a copying machine is composed of a main body 1 and a multi-stage feeding device 2 located under the main body 1. The multi-stage feeding device 2 includes, from the bottom upward, a stationary cassette unit 3, rotatable cassette units 4 and 5 as rotational cassette-type feeding apparatuses, and a tray unit 6 for receiving paper discharged from the main body 1.

A sliding mechanism 7 is installed on each side of the respective units 3 to 6 and on the corresponding internal walls of the housing 2*a* of the multi-stage feeding device 2. The sliding mechanisms 7 enable the units 3 to 6 to be pulled out of the multi-stage feeding device 2 from the front of the copying machine. The stationary cassette unit 3 and rotatable cassette units 4 and 5 store paper of different sizes. The paper is supplied via a paper transport path 10 to the main body 1 by a common feeding system using feeding rollers 8 and transport rollers 9.

The above configuration and two types of rotatable cassette mechanisms, to be described later, which are rotated in a plane in the rotatable cassette units 4 and 5 enable the multi-stage feeding device 2 to feed an increased number of paper sheets and paper types, including lengthways and sideways feed, without expanding its floor area.

Figure 2:
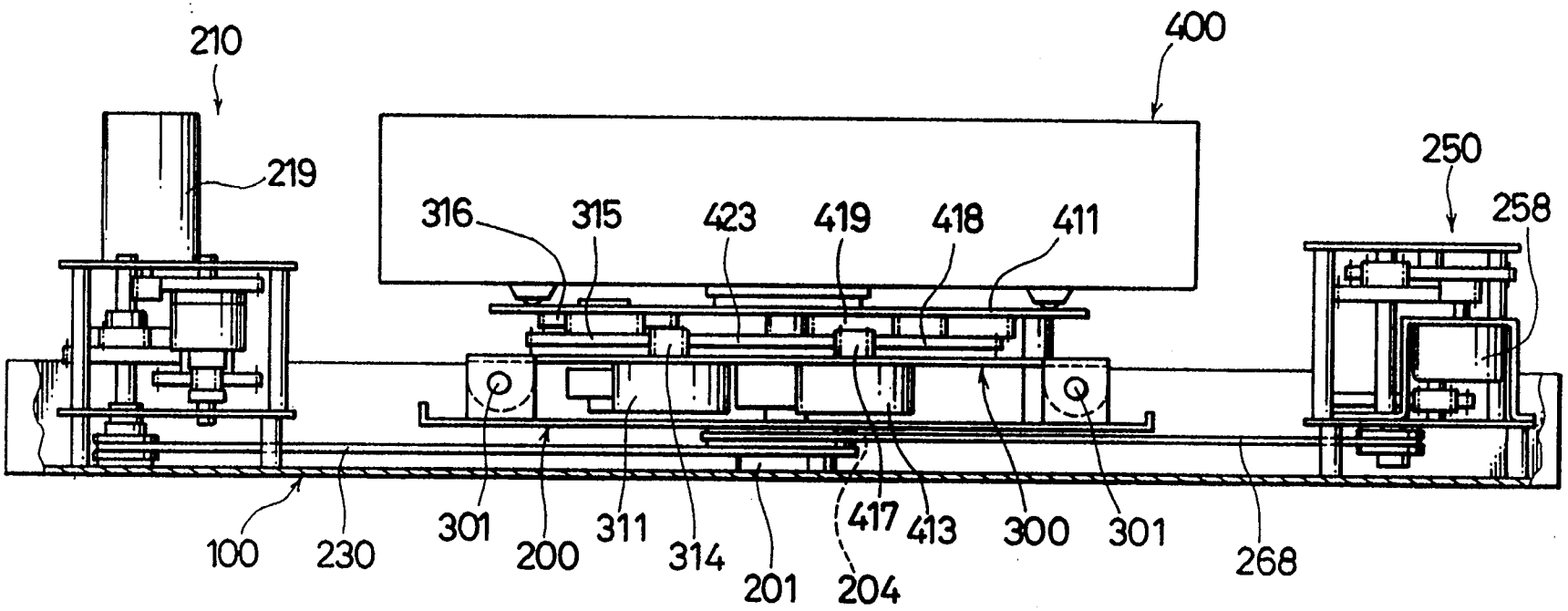
FIG. 2 is a view illustrating the rotatable cassette unit from the U side shown in FIG. 1.

As illustrated in FIGS. 1 and 2, each of the rotatable cassette units 4 and 5 has a tray 100 as a base member and a large turntable 200 as a carrying member. The turntable 200 is mounted rotatably on the center of the floor of the tray 100 in parallel with the tray 100. A carriage 300 as a movable plate is installed on each side of the turntable 200 so that it can slide straight in a longitudinal direction of the turntable 200. A paper cassette 400 as storing means is mounted rotatably on each carriage 300 parallel with the tray 100. The carriages 300 and the paper cassettes 400 are installed movably on the turntable 200, and form moving sections.

In this embodiment, a centering system is adopted in the rotatable cassette units 4 and 5. With this system, when feeding paper, the center of paper (hereinafter referred to as paper center $S_P$) stored in the paper cassette 400 is aligned with the center line of the paper transport path (hereinafter called feeding center line $SL_S$) in the feeding section of the multi-stage feeding device 2.

Figure 11:
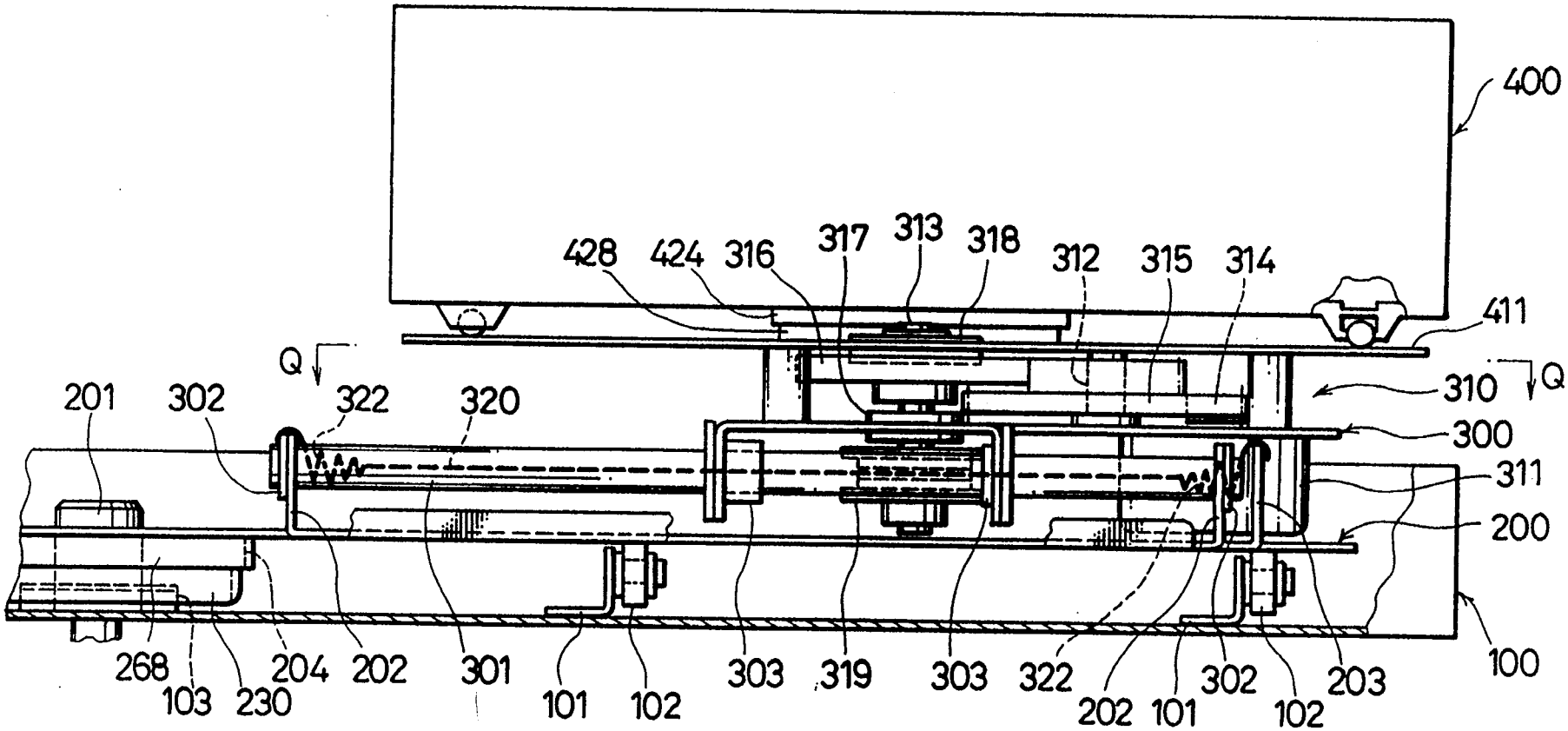
FIG. 11 is a front view of the cassette rotating mechanism shown in FIG. 1.
Figure 15:
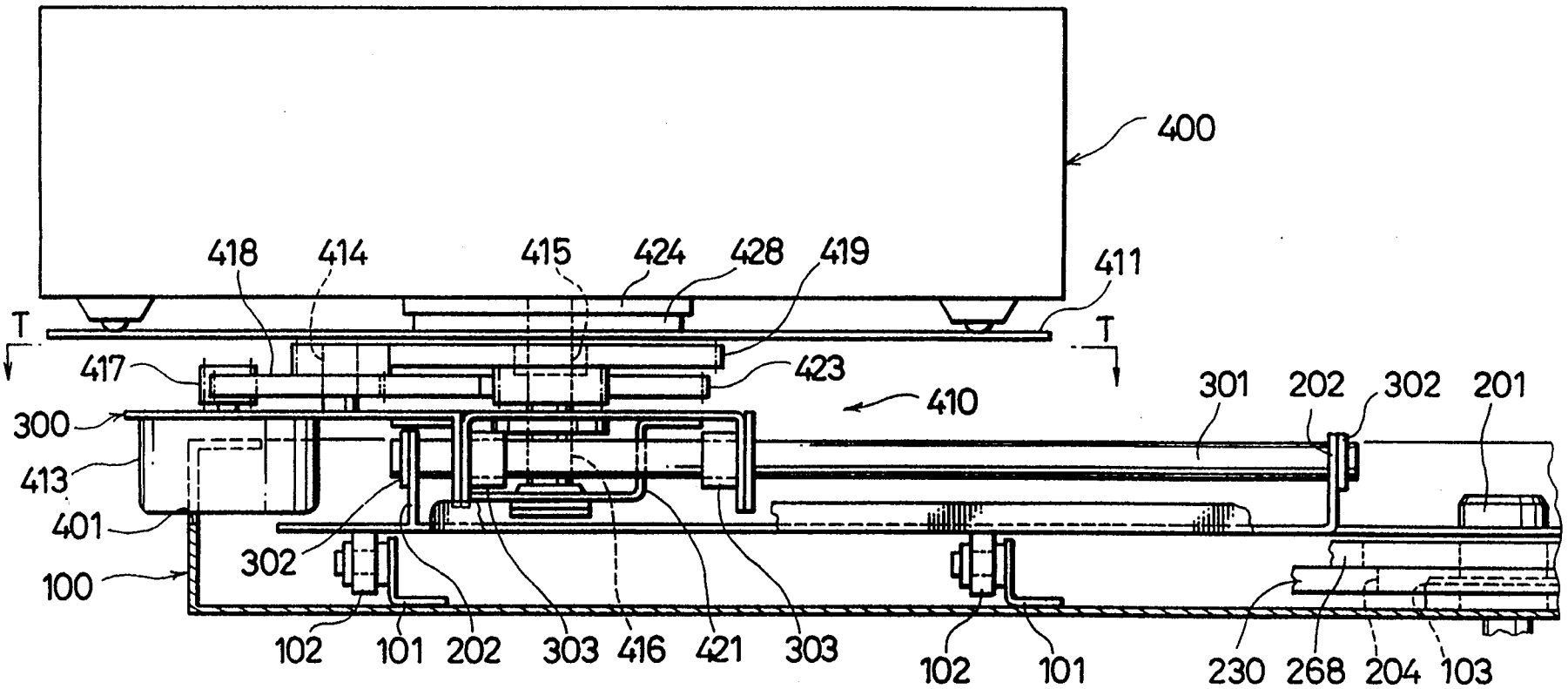
FIG. 15 is a front view of the cassette rotating mechanism shown in FIG. 1.

The turntable 200 is rotated around a rotation shaft 201, and its circumferential edges in the longitudinal direction are formed like arcs of a circle around the rotation shaft 201. As illustrated in FIGS. 11 and 15, the normal load applied to the turntable 200 by the paper cassettes 400 storing paper is borne by fourteen supporting rollers 102 and a thrust bearing 103.

The supporting rollers 102 are attached to supporting members 101 on the floor of the tray 100. As illustrated in FIG. 1, eight of the supporting rollers 102 are installed on an inner portion of the turntable 200 at intervals of 45 degrees and six are on an outer portion thereof at intervals of 30 degrees. Meanwhile, the thrust bearing 103 is inserted into a double pulley 204. The double pulley 204 is provided for timing belts 230 and 268, and attached to the rotation shaft 201.

The turntable 200 is rotated by a 180-degree rotating mechanism 210 as rotating means and by a small angle rotating mechanism 250 shown in FIG. 1. The 180-degree rotating mechanism 210 and small angle rotating mechanism 250 are respectively disposed at the corners of the tray 100 on a non-feeding side, outside of the turning space $E_L$ of the turntable 200 shown by the large circle of the alternate long and two short dashes line in FIG. 1. The non-feeding side is located opposite to a feeding side 11.

Figure 4:
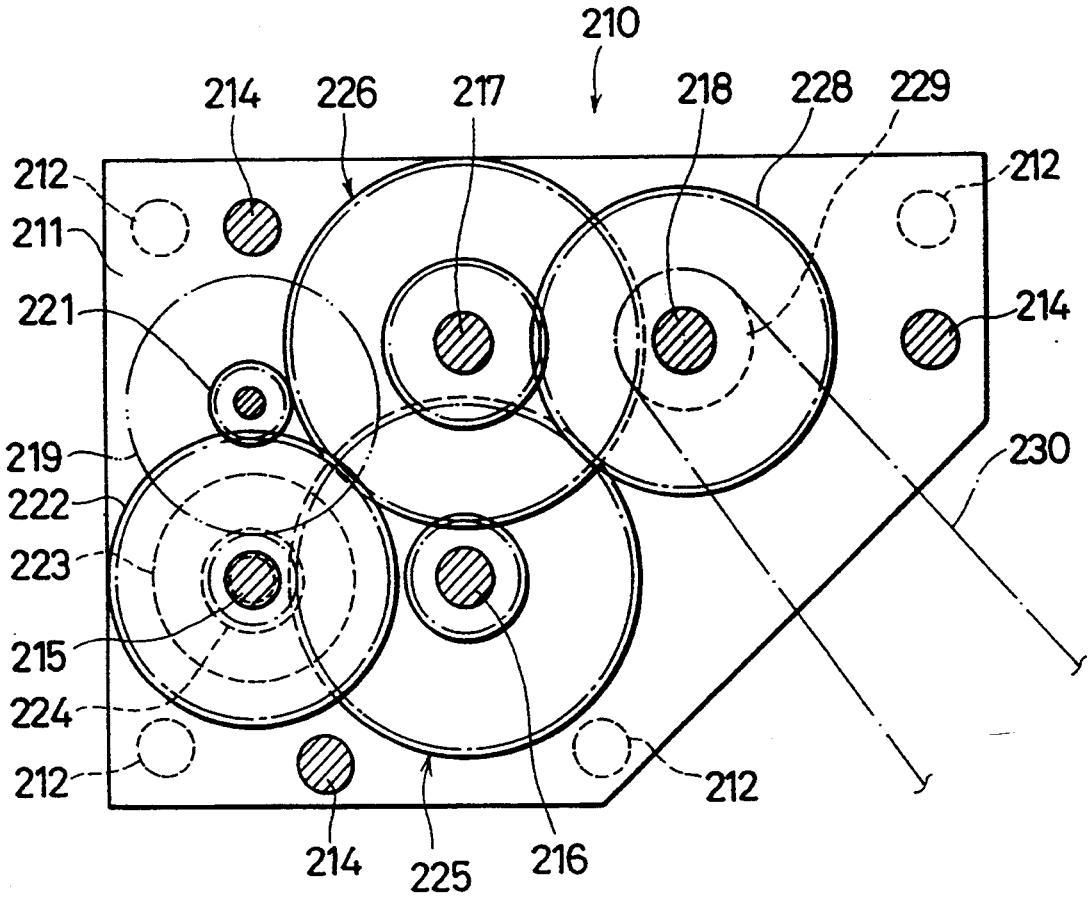
FIG. 4 is a cross section of a 180-degree rotating mechanism cut across the O—O line shown in FIG. 5.
Figure 5:
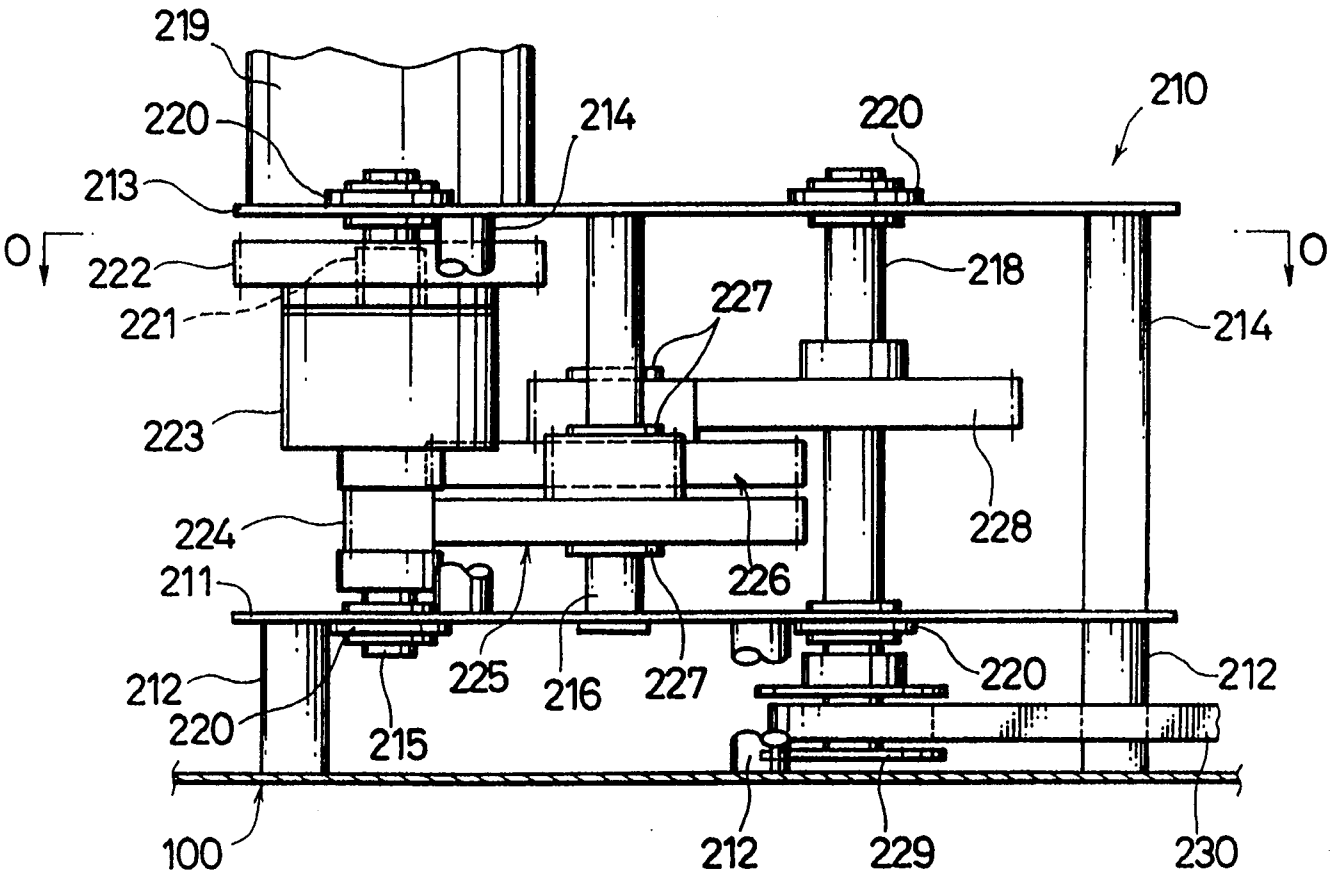
FIG. 5 is an enlarged front view of the 180-degree rotating mechanism shown in FIG. 1.
Figure 6:
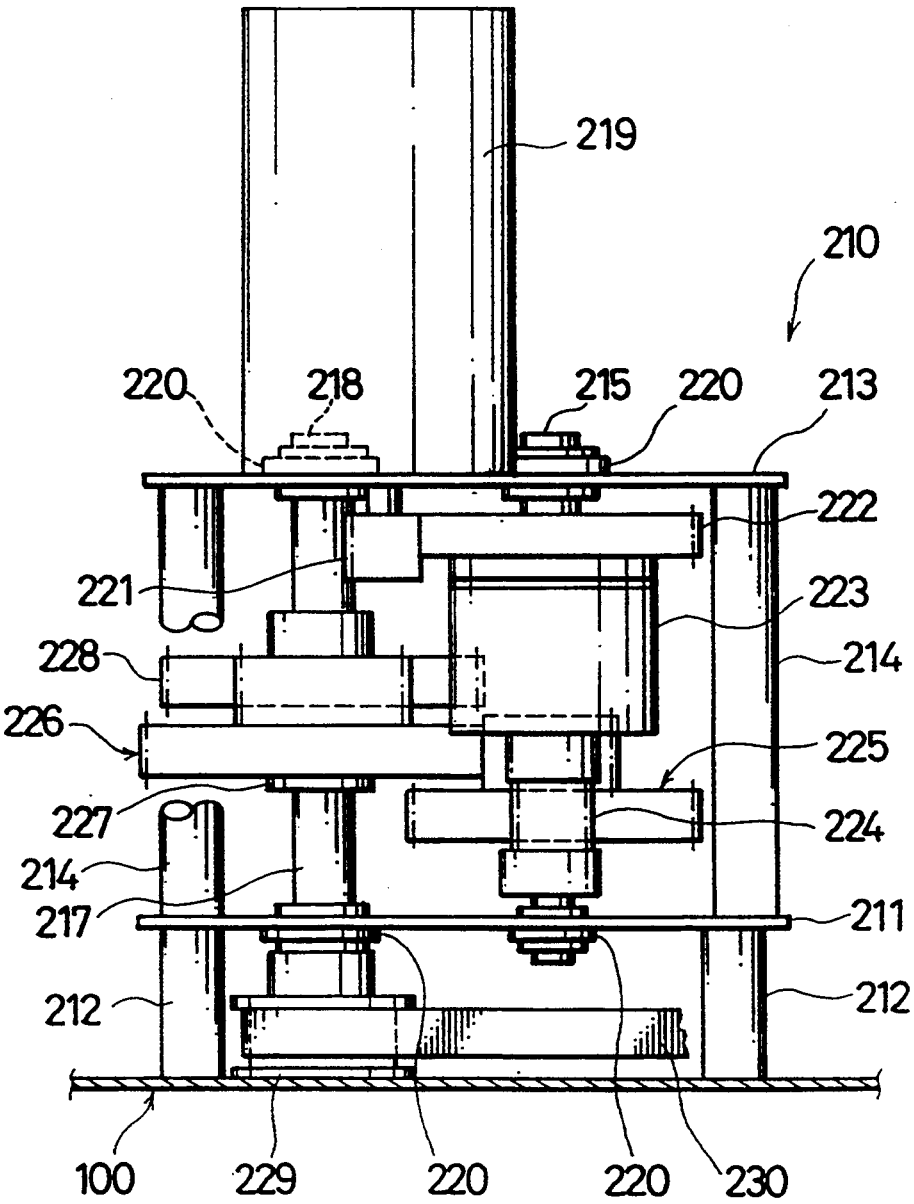
FIG. 6 is a side view of the 180-degree rotating mechanism shown in FIG. 5.

As illustrated in FIGS. 4 through 6, the lower supporting plate 211 of the 180-degree rotating mechanism 210 is supported in parallel with the tray 100 by a plurality of stays 212 mounted on the tray 100. The upper supporting plate 213 thereof is supported in parallel with the lower supporting plate 211 by a plurality of stays 214 mounted on the lower supporting plate 211. First to fourth shafts, 215 to 218, are installed between the lower supporting plate 211 and the upper supporting plate 213, and a DC motor 219 as a rotation driving source (motor) is mounted on the upper supporting plate 213. Attached to the rotation shaft of the DC motor 219 is a motor gear 221.

The top and bottom ends of the first shaft 215 and of the forth shaft 218 are rotatably held in oil impregnated metal powder sintered bearings 220. Meanwhile, the top and bottom ends of the second shaft 216 and of the third shaft 217 are fixed to the upper and lower supporting plates 213 and 211, respectively, A gear 222 is attached rotatably to an upper portion of the first shaft 215 and engages with the motor gear 221, while a gear 224 is fixed to a lower portion thereof with screws. In addition, a clutch 223 is fixed to a portion of the first shaft 215 between the gear 222 and gear 224 with screws. The clutch 223 connects or disconnects the transmission of the driving force between the gears 222 and 224.

A double gear 225 is attached rotatably to the second shaft 216 and engages with the gear 224, while a double gear 226 is attached rotatably to the third shaft 217 and engages with the double gear 225. The double gears 225 and 226 are respectively positioned by E-rings 227.

A timing pulley gear 228 is fixed to a portion of the fourth shaft 218 between the lower and upper supporting plates 211 and 213 with screws and engages with the double gear 226, while a timing pulley 229 is fixed to a portion thereof between the lower supporting plate 211 and the tray 100 with screws. Through a timing belt 230, the timing pulley 229 is connected to the lower stage of the double pulley 204 attached to the rotation shaft 201.

In the 180-degree rotating mechanism 210, to transmit the power of the DC motor 219, a series of power-transmission gears is formed by the motor gear 221, gear 222, clutch 223, gear 224, double gears 225 and 226 and timing pulley gear 228. Namely, in this arrangement, transmitting means is composed of the fourth shaft 218 as an output shaft, the series of power-transmission gears as a series of gears, the timing pulley 229 as a first body of rotation (pulley), the double pulley 204 as a second body of rotation (pulley), and the timing belt 230 as an endless member.

As a result, the power of the DC motor 219 is transmitted via the series of power-transmission gears, timing pulley 229, timing belt 230 and double pulley 204 to the rotation shaft 201 at a reduction gear ratio $i_3$ which is smaller than a reduction gear ratio $i_4$ of the small angle rotating mechanism 250. Then, the turntable 200 is rotated as the rotation shaft 201 is rotated by the timing belt 230.

The reasons why the reduction gear ratio $i_3$ is set smaller than the reduction gear ratio $i_4$ of the small angle rotating mechanism 250 is as follows.

(1) The 180-degree rotating mechanism 210 rotates the turntable 200 by a large angle, 180 degrees.

(2) Unlike the small angle rotating mechanism 250, the 180-degree rotating mechanism 210 performs its operation independently of the operations of carriage driving mechanisms 310 and cassette rotating mechanisms 410. In other words, by making the 180-degree rotating mechanism 210 rotate the turntable 200 at faster speeds than the small angle rotating mechanism 250 rotates the turntable 200, the operation time is shortened.

Figure 7:
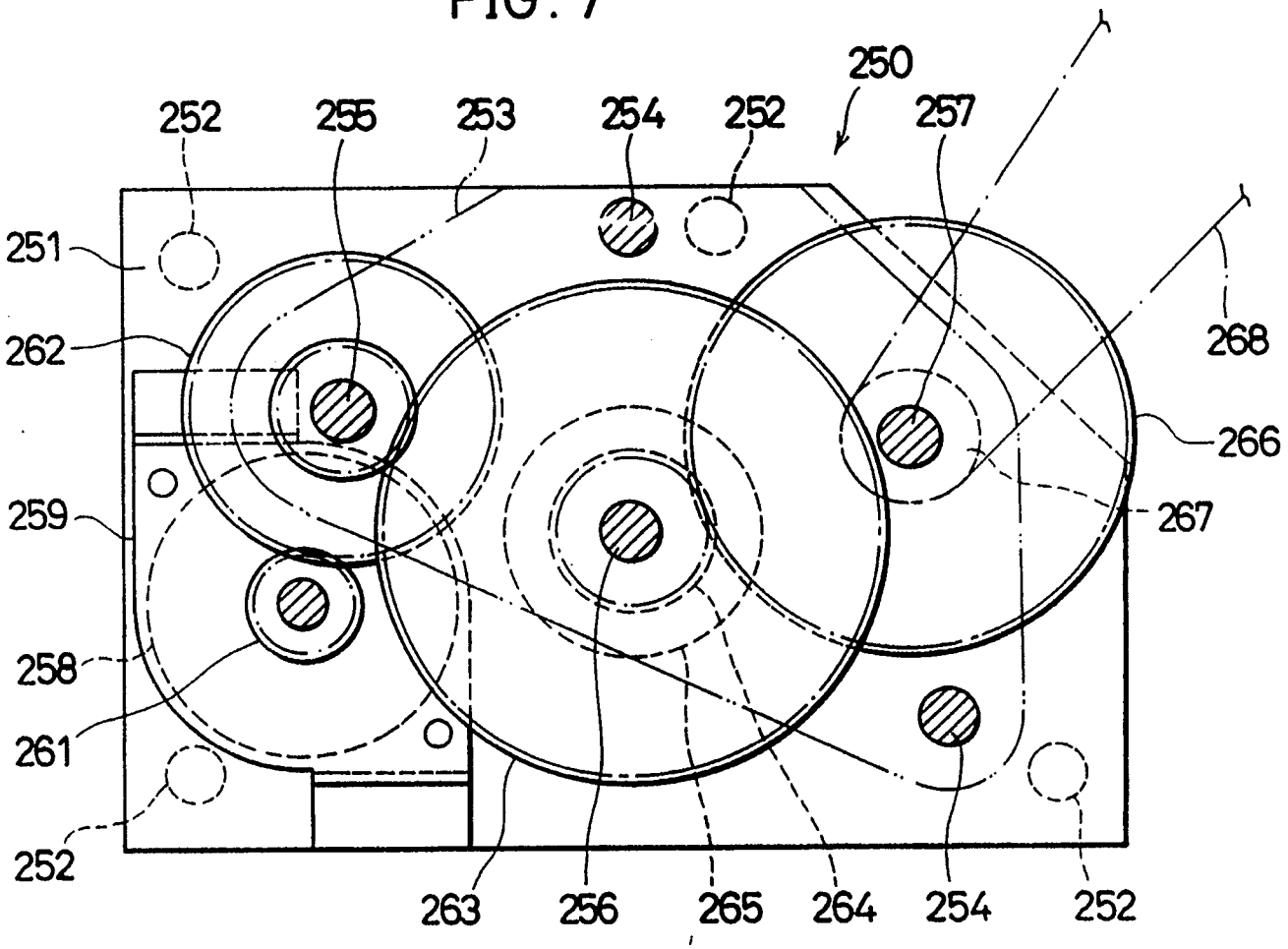
FIG. 7 is a cross section of a small angle rotating mechanism cut across the line P—P shown in FIG. 8.
Figure 8:
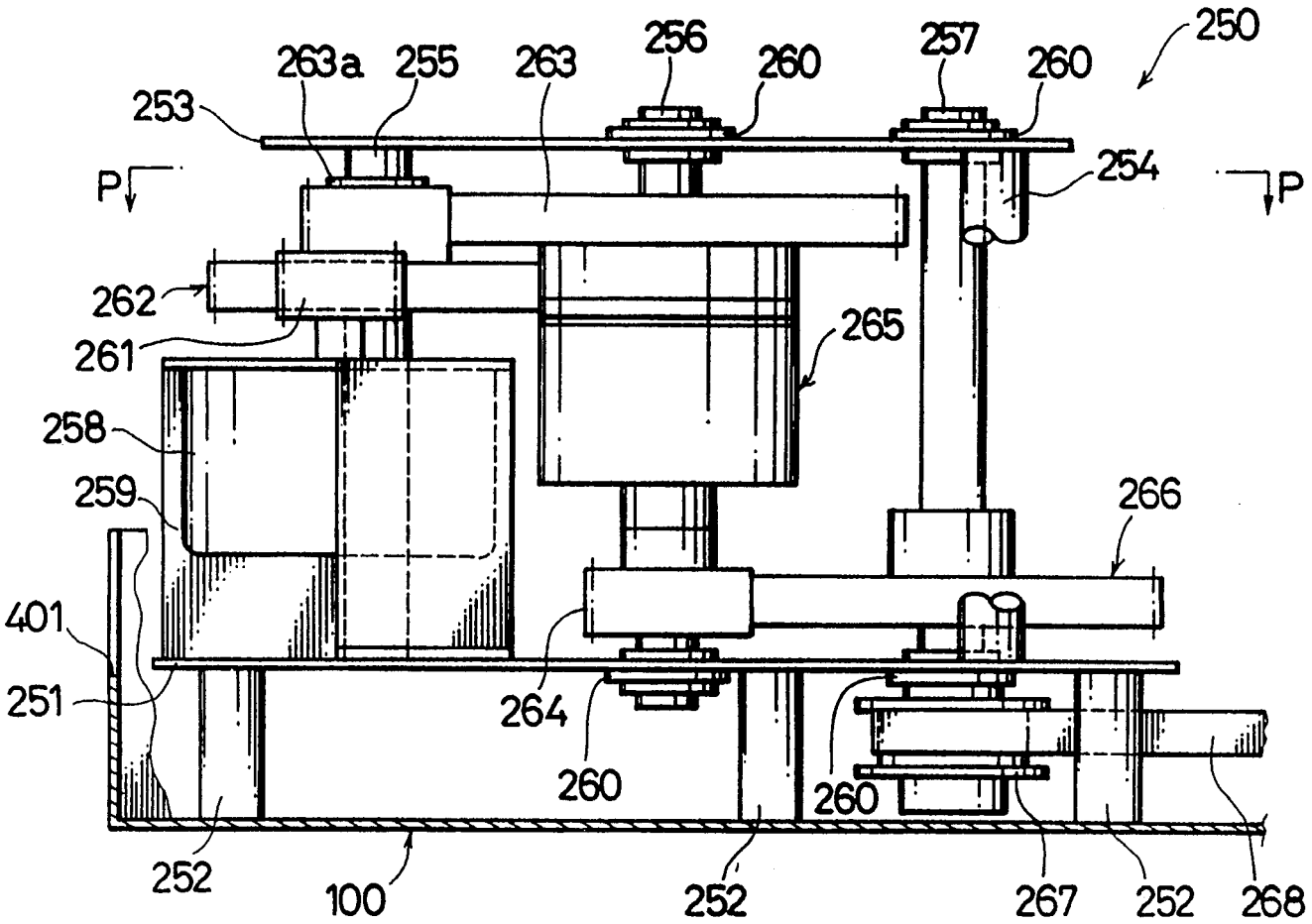
FIG. 8 is an enlarged front view of the small angle rotating mechanism shown in FIG. 1.
Figure 9:
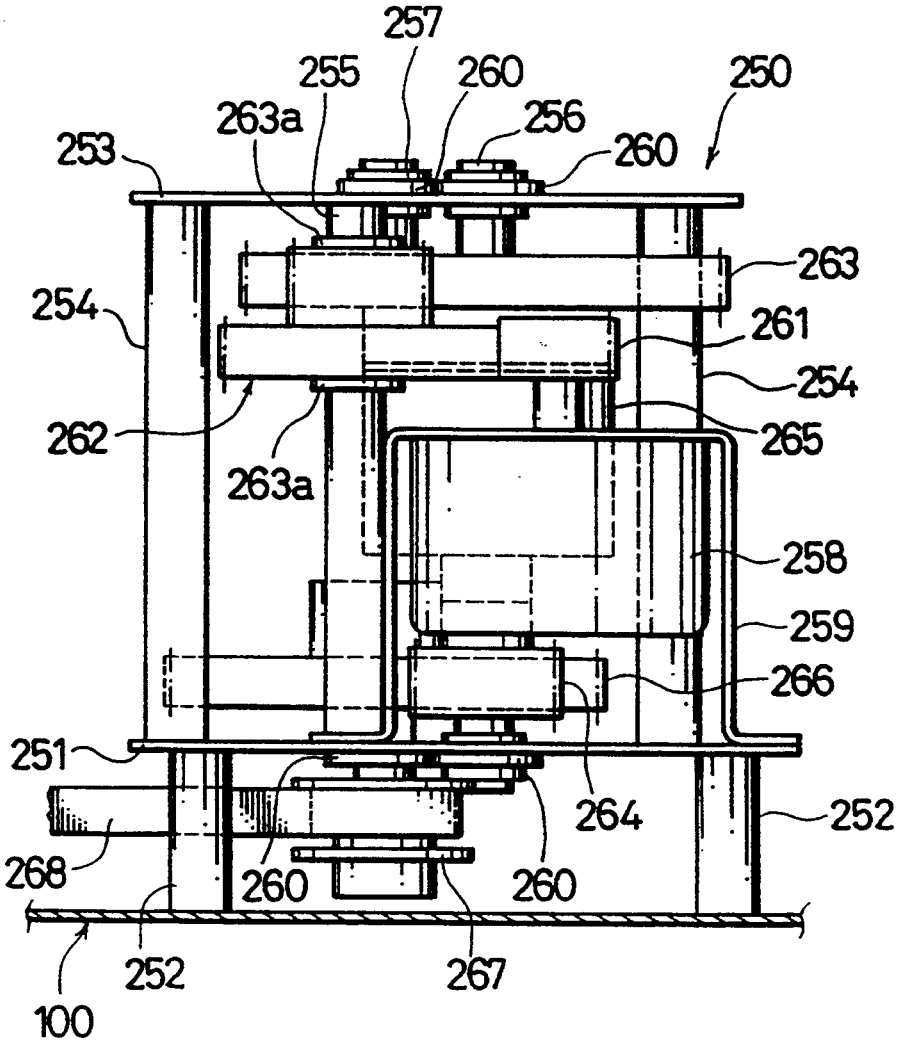
FIG. 9 is a side view of the small angle rotating mechanism shown in FIG. 8.

Next, the following will describe the small angle rotating mechanism 250. As illustrated in FIGS. 7 through 9, the lower supporting plate 251 of the small angle rotating mechanism 250 is supported parallel with the tray 100 by a plurality of stays 252 installed on the tray 100. Meanwhile, its upper supporting plate 253 is supported parallel with the lower supporting plate 251 by a plurality of stays 254 disposed on the lower supporting plate 251.

First to third shafts, 255 to 257, are installed between the lower and upper supporting plates 251 and 253, and a pulse motor 258 is mounted on the lower supporting plate 251 with a motor supporting member 259. Attached to the rotation shaft of the pulse motor 258 is a motor gear 261.

The top and bottom ends of the second shaft 256 and of the third shaft 257 are rotatably held in oil impregnated metal powder sintered bearings 260. Meanwhile, the top and bottom ends of the first shaft 255 are fixed to the upper supporting plate 253 and lower supporting plate 251, respectively.

A double gear 262 is positioned by an E-ring 263*a* and attached rotatably to the first shaft 255, and engages with the motor gear 261. A gear 263 is attached rotatably to an upper portion of the second shaft 256 and engages with the double gear 262, while a gear 264 is fixed to a lower portion thereof with screws.

In addition, a clutch 265 is fixed to a portion of the second shaft 256 between the gears 263 and 264 with screws. The clutch 265 connects and disconnects the transmission of the driving force between the gears 263 and 264.

A timing pulley gear 266 is fixed to a portion of the third shaft 257 between the lower and upper supporting plates 251 and 253 with screws and engages with the gear 264. Besides, a timing pulley 267 is fixed to a portion thereof between the lower supporting plate 251 and the tray 100 with screws. Through a timing belt 268, the timing pulley 267 is connected to the upper stage of the double pulley 204.

In the small angle rotating mechanism 250, a series of power-transmission gears is formed by the motor gear 261, double gear 262, gear 263, clutch 265, gear 264 and timing pulley gear 266 so as to transmit the power of the pulse motor 258. Accordingly, the power of the pulse motor 258 is transmitted to the rotation shaft 201 via the series of power-transmission gears, timing pulley 267, timing belt 268 and double pulley 204 at the reduction gear ratio $i_4$. Thus, the turntable 200 is rotated as the rotation shaft 201 is rotated through the timing belt 268.

Figure 10:
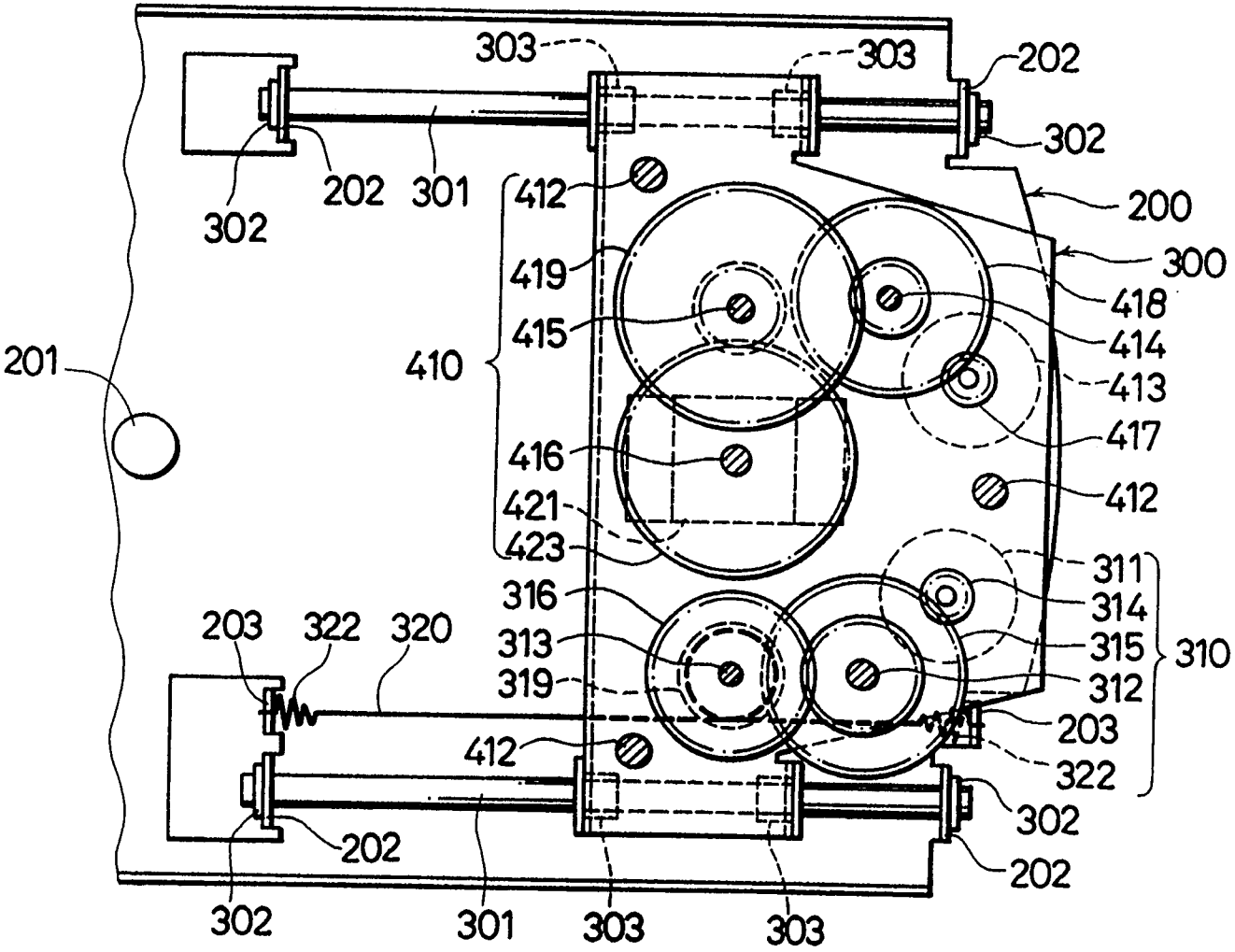
FIG. 10 is an enlarged view illustrating a carriage driving mechanism and a cassette rotating mechanism installed on one side of a large turntable shown in FIG. 1, and is also a cross sectional plan view of FIG. 11 cut across the Q—Q line.

As illustrated in FIG. 1, two slide supporting bars 301 are installed on each side of the turntable 200 in a cross direction. The slide supporting bars 301 are horizontally disposed on a level in a longitudinal direction (a radial direction of rotation) of the turntable 200 so that they are parallel with the turntable 200. As shown in FIGS. 10 and 11, each slide supporting bar 301 as a guide bar passes through a pair of bar supporting sections 202 in parallel with the turntable 200 and is fixed by E-rings 302. The bar supporting section 202 is formed by cutting and raising a part of the turntable 200.

Bearings 303 are mounted on the bottom surfaces of the carriages 300 so that the carriages 300 are installed slidably on the slide supporting bars 301. The slide supporting bars 301 and the carriages 300 function as guiding means. As shown in FIG. 1, the carriage driving mechanisms 310 as moving means and the cassette rotating mechanisms 410 are disposed on the respective carriages 300 symmetrically with respect to the rotation shaft 201. The carriage driving mechanisms 310 drive the carriages 300 so that they can slide over the slide supporting bars 301.

In the carriage driving mechanism 310, a pulse motor 311 as a driving source (motor) is mounted on the bottom surface of the carriage 300, and a fixed shaft 312 is secured to the upper surface thereof. Also, a pulley shaft 313 passes through the carriage 300 vertically.

A motor gear 314 is attached to the rotation shaft of the pulse motor 311. A double gear 315 is attached rotatably to the fixed shaft 312 and engages with the motor gear 314.

Figure 12:
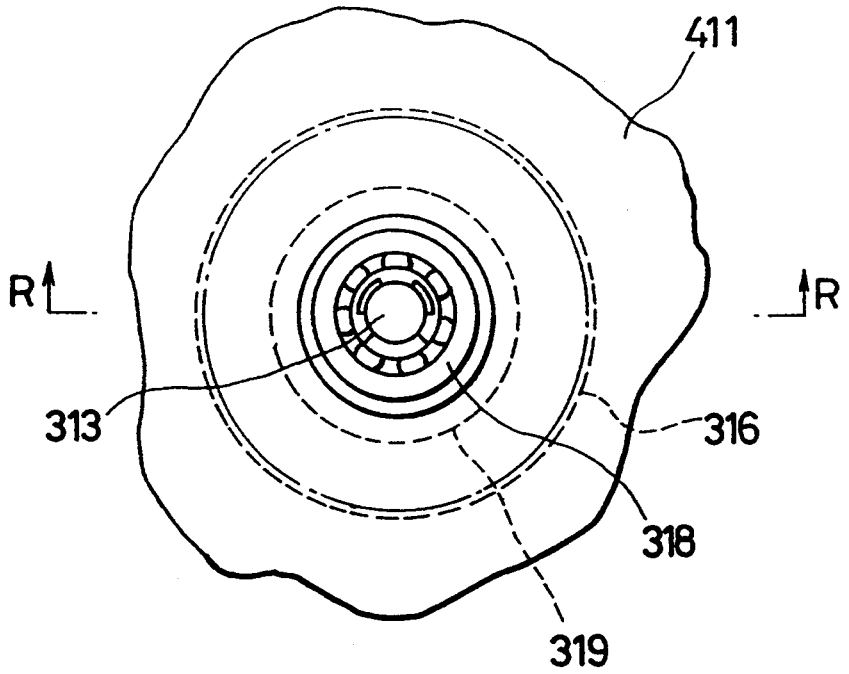
FIG. 12 is a plan view illustrating the structure of a pulley shaft shown in FIG. 10 and its periphery.
Figure 13:
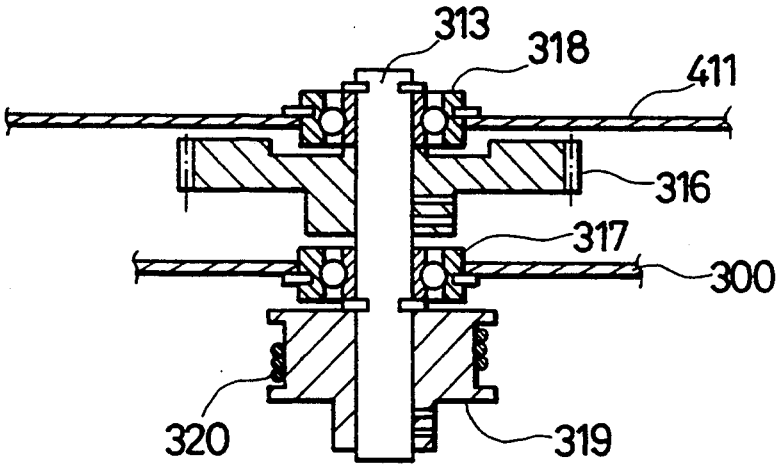
FIG. 13 is a cross sectional plan view of FIG. 12 cut across the R—R line.

As illustrated in FIGS. 12 and 13, a near central portion and an upper portion of the pulley shaft 313 are supported via radial bearings 317 and 318 by the carriage 300 and a cassette supporting circular plate 411, respectively. A pulley gear 316 is fixed to a portion of the pulley shaft 313 between the radial bearings 317 and 318 with screws and engages with the double gear 315, while a wire pulley 319 as a body of rotation is fixed to a lower portion thereof with screws.

In the carriage driving mechanism 310, a series of power-transmission gears is formed by the motor gear 314, double gear 315 and pulley gear 316 so as to transmit the power of the pulse motor 311. Moreover, transmitting means is formed by the series of gears and wire pulley 319. Accordingly, the power of the pulse motor 311 is transmitted to the wire pulley 319 at a reduction gear ratio $i_1$ via the series of power-transmission gears.

Figure 14:
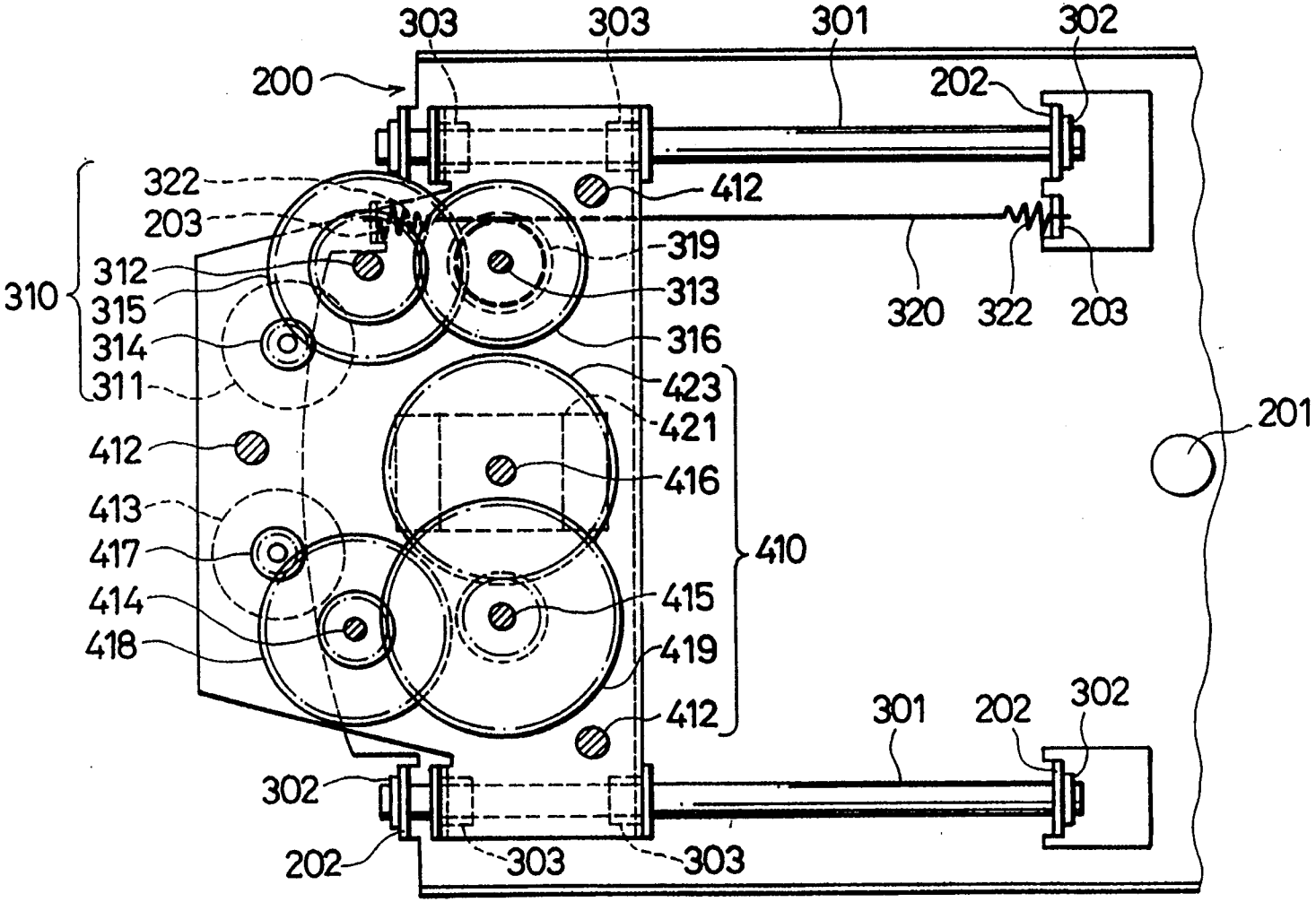
FIG. 14 is an enlarged view of a carriage driving mechanism and a cassette rotating mechanism installed on the other side of the turntable shown in FIG. 1, and is also a cross sectional plan view of FIG. 15 cut across the T—T line.

A wire 320 as convertor means is wound around and fastened to the central portion of the wire pulley 319 with screws. As illustrated in FIGS. 10 and 14, both ends of the wire 320 are connected to the wire joint sections 203 through springs 322 for preventing looseness so that the wire 320 can extend along the slide supporting bars 301. The wire joint sections 203 are formed in the vicinity of the bar supporting sections 202 by cutting and raising a part of the turntable 200.

In this arrangement, auxiliary driving means is formed by the transmitting means and the wire pulley 319. By the auxiliary driving means and pulse motor 311, the carriage 300 is moved toward the rotation shaft 201 or the opposite direction according to a rotation of the wire pulley 319, i.e., the normal rotation or the reverse rotation of the pulse motor 311. In relation to the movement of the carriage 300, as shown in FIGS. 1 and 15, the non-feeding side of the tray 100 is provided with an opening 401 which permits the carriage 300 and paper cassette 400 on the non-feeding side to protrude from the tray 100.

As illustrated in FIGS. 14 and 15, the carriage 300 is also provided with the cassette rotating mechanism 410. In the cassette rotating mechanism 410, the cassette supporting circular plate 411 for supporting the paper cassette 400 is mounted parallel with the carriage 300 through three spacers 412 shown in FIG. 14.

Additionally, a pulse motor 413 is mounted on the bottom surface of the carriage 300, and fixed shafts 414 and 415 are secured to the upper surface thereof. And, a cassette rotation shaft 416 passes through the carriage 300 vertically. A motor gear 417 is attached to the rotation shaft of the pulse motor 413.

A double gear 418 is attached rotatably to the fixed shaft 414 and engages with the motor gear 417, while a double gear 419 is attached rotatably to the fixed shaft 415 and engages with the double gear 418.

Figure 17:
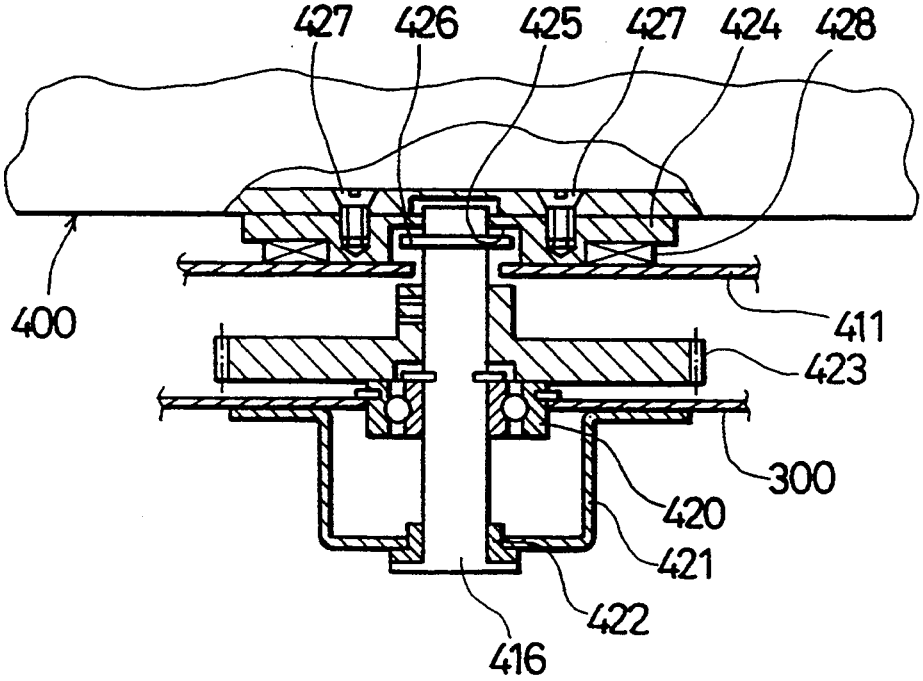
FIG. 17 is a cross sectional plan view of FIG. 16 cut across the S—S line.

As illustrated in FIG. 17, a near central portion of the cassette rotation shaft 416 is supported through a radial bearing 420 by the carriage 300, while a lower portion thereof is supported through an oil impregnated metal powder sintered bearing 422 by a U-shaped member 421 mounted on the bottom surface of the carriage 300. A cassette gear 423 is fixed to an upper portion of the cassette rotation shaft 416 with screws, and engages with the double gear 419.

Accordingly, the power of the pulse motor 413 is transmitted to the cassette rotation shaft 416 at a reduction gear ratio $i_2$ via a series of power-transmission gears, including the motor gear 417, double gears 418 and 419 and cassette gear 423.

Figure 16:
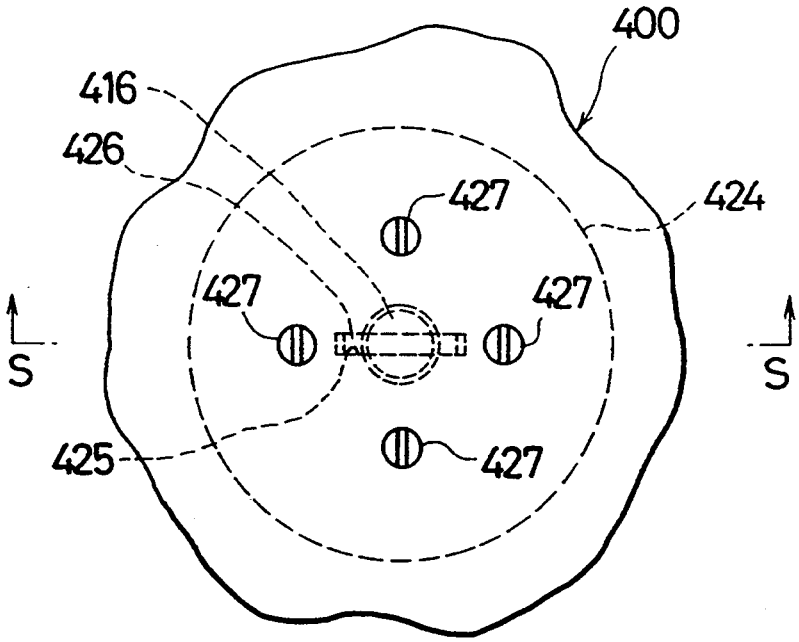
FIG. 16 is a plan view illustrating the structure of a cassette rotation shaft shown in FIG. 15 and its periphery.

As illustrated in FIG. 16, the top end of the cassette rotation shaft 416 is inserted from an opening formed on the cassette supporting circular plate 411 into a cassette connecting circular plate 424 installed on the bottom surface of the paper cassette 400 with screws 427. A joining socket 425 is formed on the cassette connecting circular plate 424, while a connecting pin 426 is secured to the top end of the cassette rotation shaft 416. By joining the connecting pin 426 to the joining socket 425, the cassette rotation shaft 416 is connected to the central portion of the paper cassette 400.

Disposed between the cassette connecting circular plate 424 and the cassette supporting circular plate 411 is a thrust bearing 428 for supporting the paper cassette 400 rotatably. This configuration enables the paper cassette 400 to be rotated depending on the normal rotation or reverse rotation of the pulse motor 413.

Figure 18:
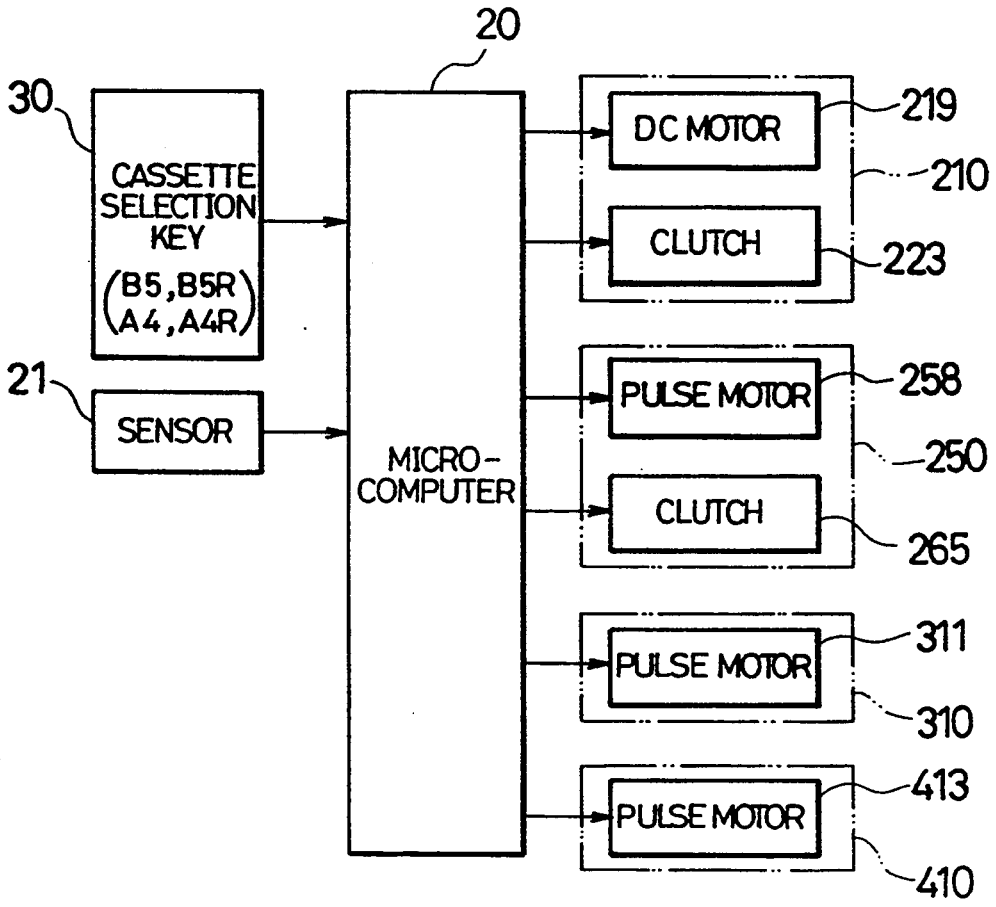
FIG. 18 is a block diagram illustrating a control system of the rotatable cassette unit shown in FIG. 1.

A microcomputer 20 shown in FIG. 18 controls:

(1) the 180-degree rotating mechanism 210 to rotate the turntable 200 around the rotation shaft 201;

(2) the small angle rotating mechanism 250 to rotate the turntable 200 (hereinafter referred to as $\theta$-axis driving);

(3) the carriage driving mechanisms 310 to move the carriages 300 and paper cassettes 400 over the slide supporting bars 301, i.e. in a radial direction of rotation of the turntable 200 (r-axis driving); and (4) the cassette rotating mechanisms 410 to rotate the paper cassettes 400 around the cassette rotation shaft 416 ($\phi$-axis driving).

More specifically, the microcomputer 20 controls the $\theta$-axis driving, r-axis driving and $\phi$-axis driving simultaneously such that the paper cassette 400 storing paper of a selected size is set in a feed position while aligning the paper center $S_P$ with the feeding center line $SL_S$. At this time, the microcomputer 20 controls the DC motor 219, clutch 223, pulse motor 258, clutch 265, pulse motor 311, and pulse motor 413 as described below.

Besides, when interchanging the paper cassette 400 on the feeding side 11 and the paper cassette 400 on the non-feeding side, the microcomputer 20 controls the carriage driving mechanisms 310 to move the paper cassettes 400 to positions closest to the axis of rotation of the turntable 200. Namely, the microcomputer 20 also functions as movement controlling means. Further, after moving the paper cassettes 400 to the positions closest to the axis of rotation of the turntable 200, the microcomputer 20 controls the 180-degree rotating mechanism to rotate the turntable 200. Here, it works as rotation controlling means. Since the microcomputer 20 controls the above-mentioned operations, it is possible to minimize the space occupied by the paper cassettes 400 during the rotation of the turntable 200.

Regarding the size of a document placed on the document platen of the main body 1 and the position thereof, i.e., whether it is placed lengthways or sideways, they are set by an input entered by an operator through a cassette selection key 30, or they are detected by a sensor (not shown). And, paper to be used is selected according to the size and position of the document, or according to a detection signal from the sensor and a specified copying mode, such as enlarged copying and reduced copying.

In this embodiment, suppose that B5-sized paper and A4-sized paper are stored in the two paper cassettes 400 of each of the rotatable cassette units 4 and 5, B5, B5R, A4 and A4R paper are available. R in B5R and A4R means a reduction mode. In the reduction mode, generally, the paper is fed lengthways.

Based on the above configuration, the following will explain the operations of the 180-degree rotating mechanism 210, small angle rotating mechanism 250, carriage driving mechanisms 310 and cassette rotating mechanisms 410, separately.

Figure 19:
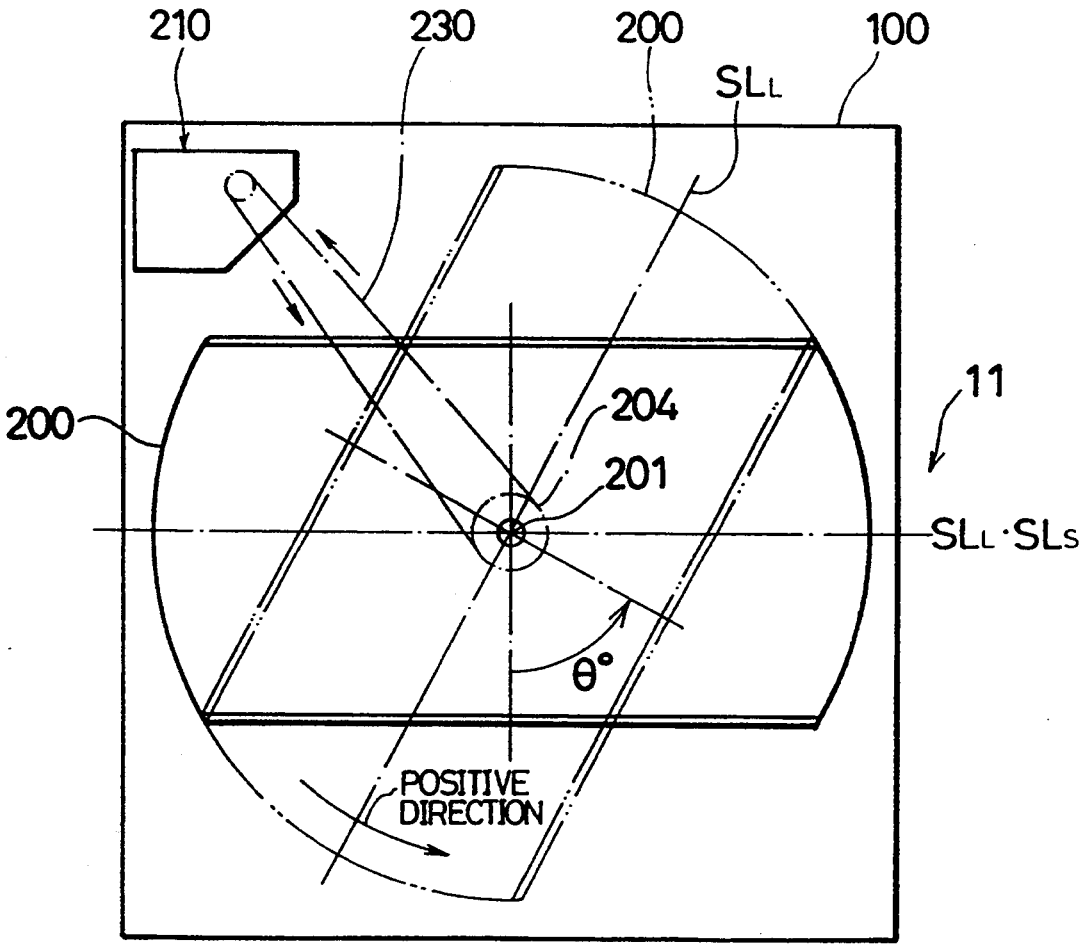
FIG. 19 is a view explaining the operation of the 180-degree rotating mechanism shown in FIGS. 4 through 6.

As illustrated in FIG. 19, the 180-degree rotating mechanism 210 simply turns the turntable 200 by 180 degrees so as to interchange the paper cassette 400 on the feeding side 11 and the paper cassette 400 on the non-feeding side. At this time, the power of the DC motor 219 is increased at the reduction gear ratio $i_3$ and transmitted to the rotation shaft 201 of the turntable 200 through the series of power-transmission gears shown in FIGS. 4 through 6, timing belt 230 and double pulley 204.

The position of the turntable 200 after the 180-degree rotation is detected by a sensor 21 as detecting means shown in FIG. 18. Then, according to a detection signal from the sensor 21, the microcomputer 20 controls the DC motor 219 so that the turntable 200 is positioned accurately. When the 180-degree rotating mechanism 210 is actuated, the microcomputer 20 controls the clutch 223 of the series of power-transmission gears to be turned ON so that the power of the DC motor 219 is transmitted. On the contrary, when the small angle rotating mechanism 250 is actuated as to be described later, it is turned OFF in order to cutoff the power transmission of the DC motor 219.

Figure 20:
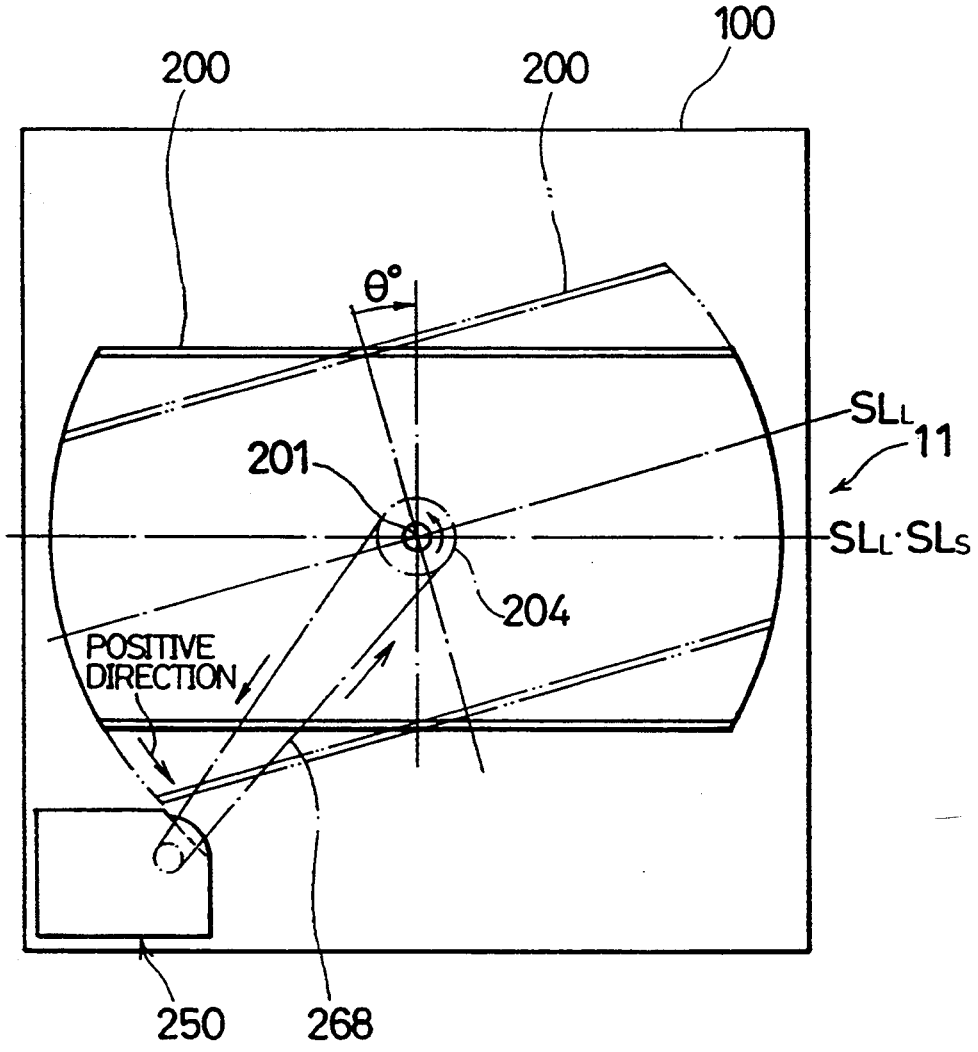
FIG. 20 is a view explaining the operation of the small angle rotating mechanism shown in FIGS. 7 through 9.

During $\theta$-axis driving by the small angle rotating mechanism 250, the power of the pulse motor 258 is increased at the reduction gear ratio $i_4$ and transmitted to the rotation shaft 201 by the series of power-transmission gears shown in FIGS. 7 through 9, timing belt 268 and double pulley 204. In consequence, the turntable 200 is rotated by a small angle as illustrated in FIG. 20.

This rotation is controlled by the microcomputer 20 such that the paper center $S_P$ of the paper stored in the paper cassette 400 on the feeding side 11 aligns with the feeding center line $SL_S$ depending on lengthways feed or sideways feed. When the small angle rotating mechanism 250 is actuated, the clutch 265 of the series of transmission gears is turned ON to transmit the power of the pulse motor 258. On the other hand, when the 180-degree rotating mechanism 210 is actuated, it is turned OFF to cutoff the power transmission of the pulse motor 258.

During r-axis driving by the carriage driving mechanism 310, the power of the pulse motor 311 is increased at the reduction gear ratio $i_1$ and transmitted to the wire pulley 319 attached to the pulley shaft 313 through the series of power-transmission gears shown in FIGS. 10 and 11. The microcomputer 20 controls the carriage driving mechanism 310 on the feeding side 11 to drive the carriage 300 such that the paper cassette 400 is moved into an interchanging position, a sideways feed position or a retracted position.

Figure 32:
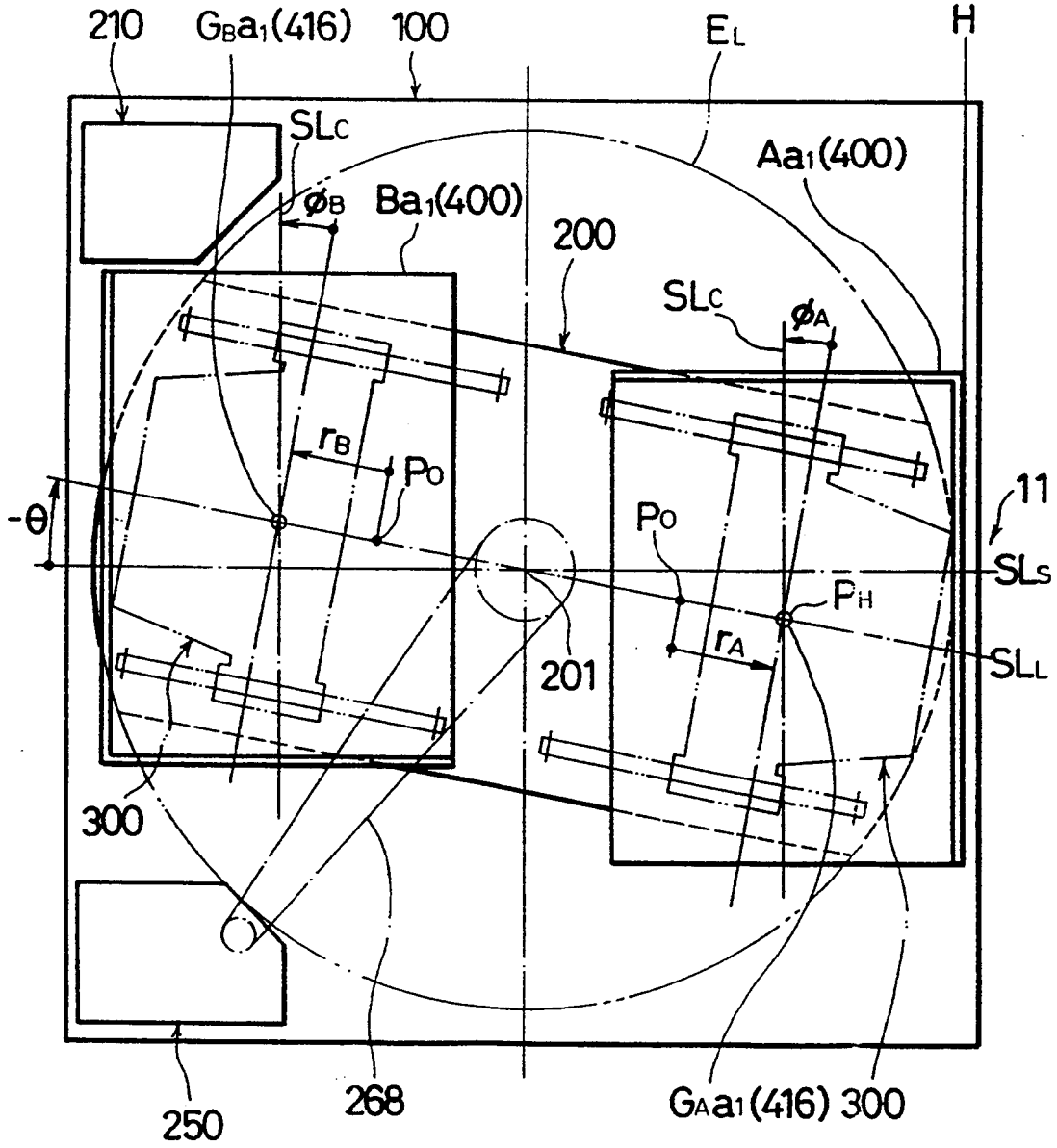
FIG. 32 is an explanatory view illustrating the states of the turntable, carriages and paper cassettes at time $a_1$ during Operation 1 shown in FIGS. 25 and 26.
Figure 33:
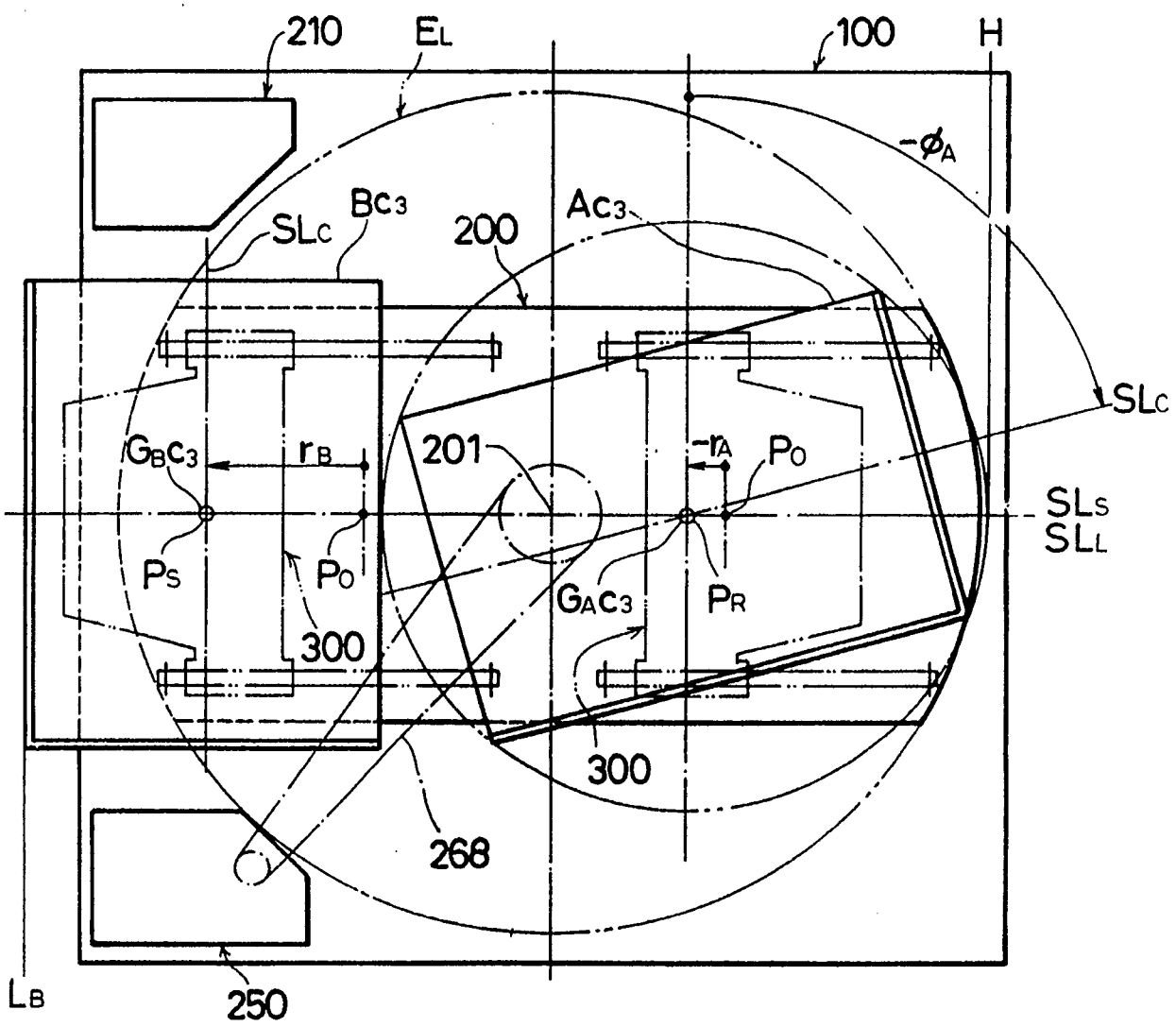
FIG. 33 is an explanatory view illustrating the states of the turntable, carriages and paper cassettes at time $c_1$ during Operation 1 shown in FIGS. 25 and 26.

The interchanging position is a position where the two paper cassettes 400 placed side by side come into the closest proximity of the rotation shaft 201. It is defined in this embodiment that at the interchanging position the sides of the paper cassettes 400 come into contact with each other on the rotation shaft 201. The sideways feed position is a position where, as shown in FIG. 32, the paper cassette 400 on the feeding side 11 is placed for sideways feed and its leading edge aligns with a predetermined cassette leading edge setting line H. The retracted position is a position where, as illustrated in FIG. 33, the paper cassette 400 on the feeding side 11 is retraced toward the non-feeding side so as to prevent it from protruding from the cassette leading edge setting line H during switching of the position of paper between lengthways and sideways feed.

Figure 21:
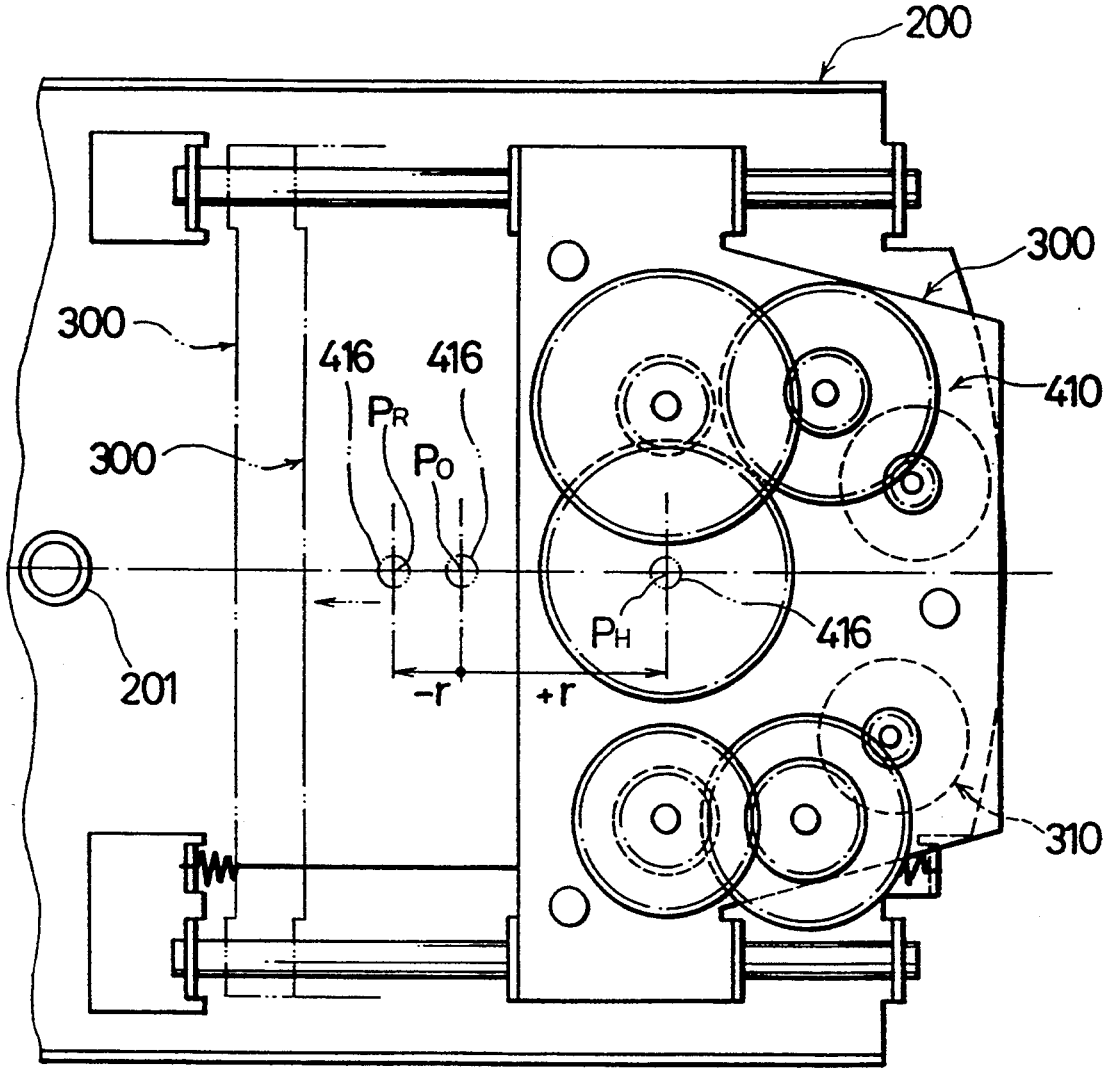
FIG. 21 is a schematic plan view illustrating the operation of the carriage driving mechanism shown in FIGS. 10 and 11.

When the paper cassette 400 is moved into the interchanging, sideways feed or retracted position, as shown in FIG. 21, the cassette rotation shaft 416 is moved to an interchanging point $P_O$, a sideways feed point $P_H$ or a retracted point $P_R$, respectively.

Figure 22:
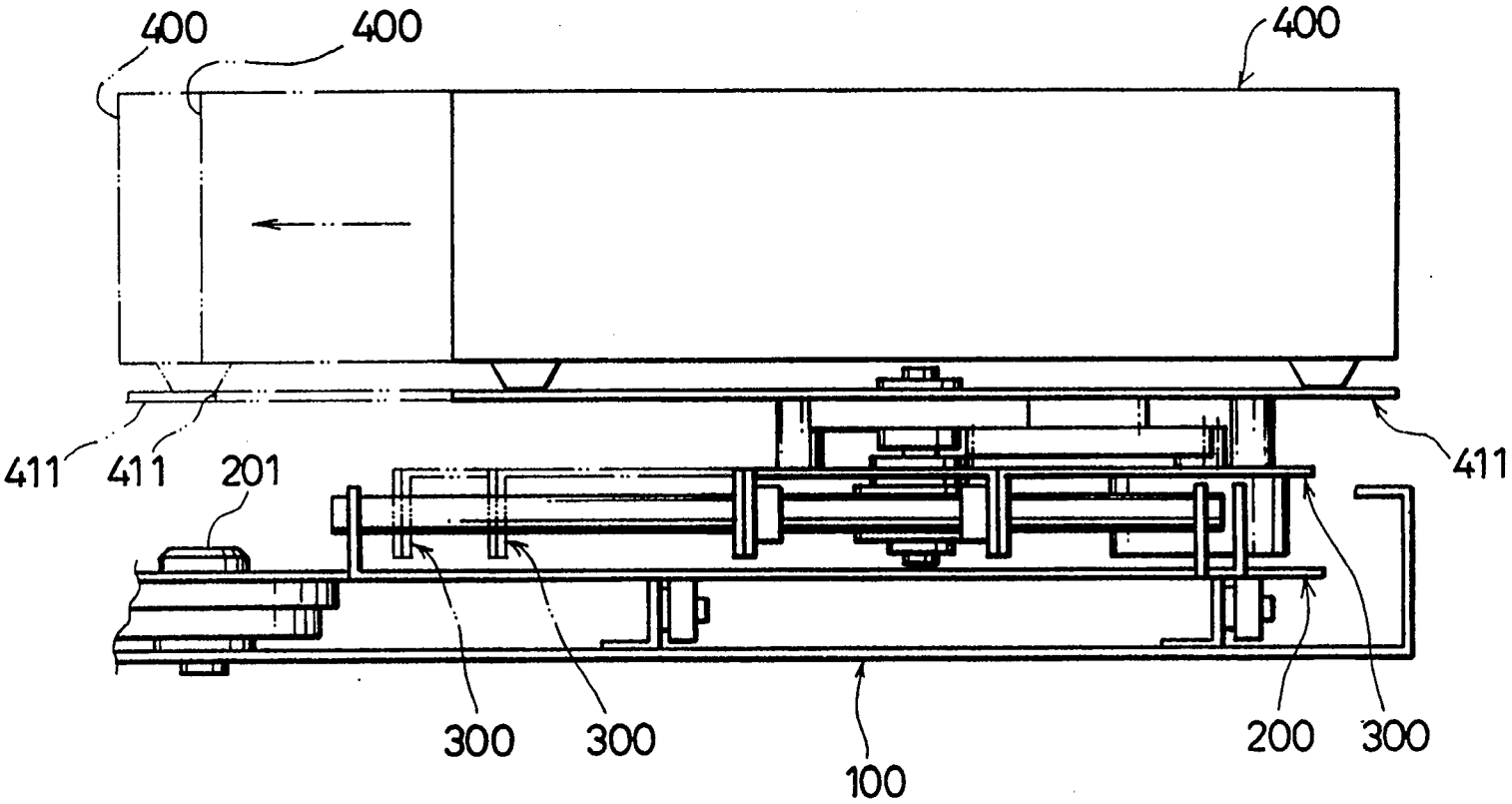
FIG. 22 is a schematic front view illustrating the movement of a paper cassette caused by the movement of the carriage shown in FIG. 21.

FIG. 22 shows the movement of the paper cassette 400. Here, the interchanging point $P_O$ is defined as a reference point with respect to the movement of the paper cassette 400 driven by the carriage driving mechanism 310. With respect to the interchanging point $P_O$, a direction toward the rotation shaft 201, i.e., toward the retracted point $P_R$ is regarded as a negative (−) direction and the opposite direction, i.e., toward the sideways feed point $P_H$ is a positive (+) direction.

Also, the carriage driving mechanism 310 on the non-feeding side drives the carriage 300 such that the paper cassette 400 on the non-feeding side is moved between the interchanging position and a clearance position. The clearance position is a position where the paper cassette 400 on the non-feeding side protrudes from the tray 100 toward a direction opposite to the rotation shaft 201 and aligns with a predetermined clearance line $L_B$ as illustrated in FIG. 33.

When the paper cassette 400 on the non-feeding side is in the clearance position, it does not interfere with the rotation of the paper cassette 400 on the feeding side 11 for switching its state between the sideways feed and lengthways feed. The cassette rotation shaft 416 is moved from the interchanging point $P_O$ shown in FIG. 38 to the clearance point $P_S$ shown in FIG. 33 as the paper cassette 400 on the non-feeding side is moved from the interchanging position to the clearance position.

During $\phi$-axis driving by the cassette rotating mechanism 410, the power of the pulse motor 413 is increased at the reduction gear ratio $i_2$ and transmitted to the cassette rotation shaft 416 by the series of power-transmission gears shown in FIGS. 14 and 15. The microcomputer 20 controls the cassette rotating mechanism 410 such that the paper cassette 400 is rotated for positioning the paper for sideways or lengthways feed and that, in accordance with the rotation of the turntable 200 driven by the $\theta$-axis driving, the paper cassette 400 is rotated for positioning the leading edge of the paper at right angles to the feeding direction. The microcomputer 20 also controls the cassette rotating mechanism 410 such that, during the rotation of the turntable 200 driven by the 180-degree rotating mechanism 210 and during the switching of the position of the paper cassette 400 on the feeding side 11 between sideways feed and lengthways feed, the longer sides of the paper cassette 400 on the non-feeding side are positioned at right angles to the feeding center line $SL_S$.

By driving of the turntable 200 by the 180-degree rotating mechanism 210, $\theta$-axis driving, r-axis driving and $\phi$-axis driving, the paper cassettes 400 on the feeding side 11 and on the non-feeding side are interchanged and the position of the paper cassette 400 on the feeding side 11 is changed between lengthways feed and sideways feed.

Denoting the two paper cassettes 400 in the rotatable cassette unit 4 as cassette No. 1 and cassette No. 2, they fall into four modes, Modes 1 to 4, on the feeding side 11 as described below.

Mode 1—cassette No. 1 is positioned for sideways feed

Mode 2—cassette No. 1 is positioned for lengthways feed

Mode 3—cassette No. 2 is positioned for sideways feed

Mode 4—cassette No. 2 is positioned for lengthways feed

Figure 23:
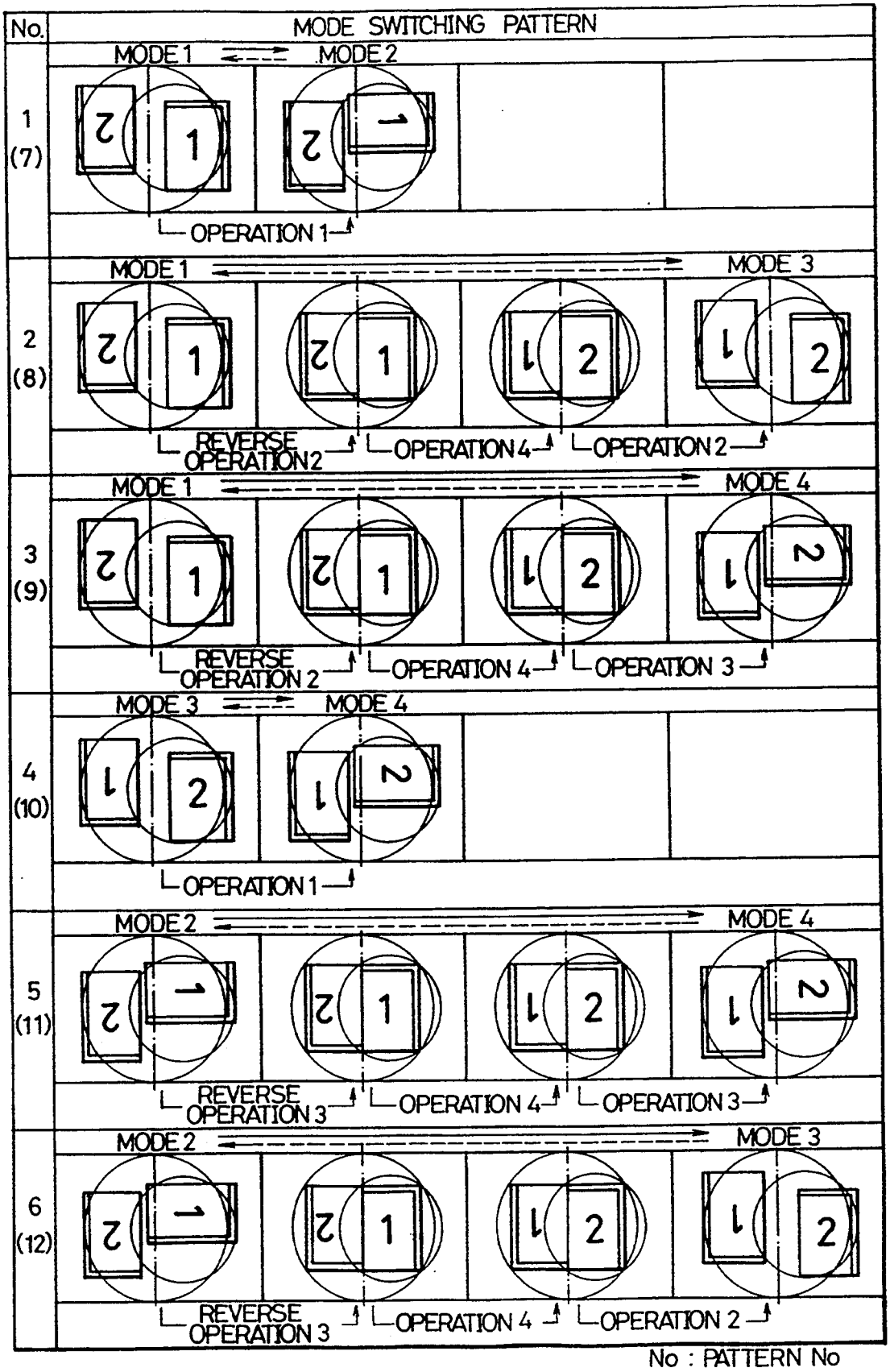
FIG. 23 is an explanatory view illustrating patterns of mode switching, executed by the 180-degree rotating mechanism, small angle rotating mechanism, cassette rotating mechanism and carriage driving mechanisms shown in FIGS. 4 through 17.

As for switching of modes from one mode to other three modes, there are twelve switching patterns in total. However, six, a half of the twelve switching patterns, are reverse operations of the other six. Therefore, there are basically six switching patterns shown in FIG. 23. In FIG. 23, switching operations from one mode to other modes are indicated with the solid lines, while their reverse operations are indicated with the broken lines. Besides, in each mode, the right is the feeding side 11 and the left is the non-feeding side.

A single switching pattern is constituted by a single operation or a combination of four operations 1 to 4 and their reverse operations 1 to 4 described below.

Operation 1—switching the position of the paper cassette 400 on the feeding side 11 between lengthways feed and sideways feed Operation 2—after interchanging the paper cassettes 400 on the feeding side 11 and on the non-feeding side, positioning the paper cassette 400 on the feeding side 11 for sideways feed Operation 3—after interchanging the paper cassettes 400 on the feeding side 11 and on the non-feeding side, positioning the paper cassette 400 on the feeding side 11 for lengthways feed Operation 4—interchanging the paper cassettes 400 on the feeding side 11 and on the non-feeding side FIG. 24 illustrates combinations of Operations 1 to 4 and Reverse Operations 1 to 4 constituting the respective mode switching patterns. Reverse Operations 1 to 4 are carried out by reversing the rotation of the corresponding motors.

Since the microcomputer 20 memorizes the mode switching patterns shown in FIG. 23 and their constituent operations shown in FIG. 24, after selecting a paper size to be fed from B5, B5R, A4 and A4R it executes operations constituting a mode switching pattern selected. This permits the selected paper to be placed in the feed position in accordance with the selected mode. Further, since the 180-degree rotating mechanism 210, small angle rotating mechanism 250, carriage driving mechanisms 310 and cassette rotating mechanisms 410 are controlled by a series of the controlling operations, i.e., the above-mentioned four operations, the process of controlling each mechanism is simplified.

The following will discuss Operations 1 to 4 controlled by the microcomputer 20.

Firstly, Operation 1 of switching modes from Mode 1 to Mode 2 will be explained. It is assumed herein that the paper cassette 400 for B5-sized paper is located on the feeding side 11 and the paper cassette 400 for A4-sized paper is located on the non-feeding side.

Figure 25:
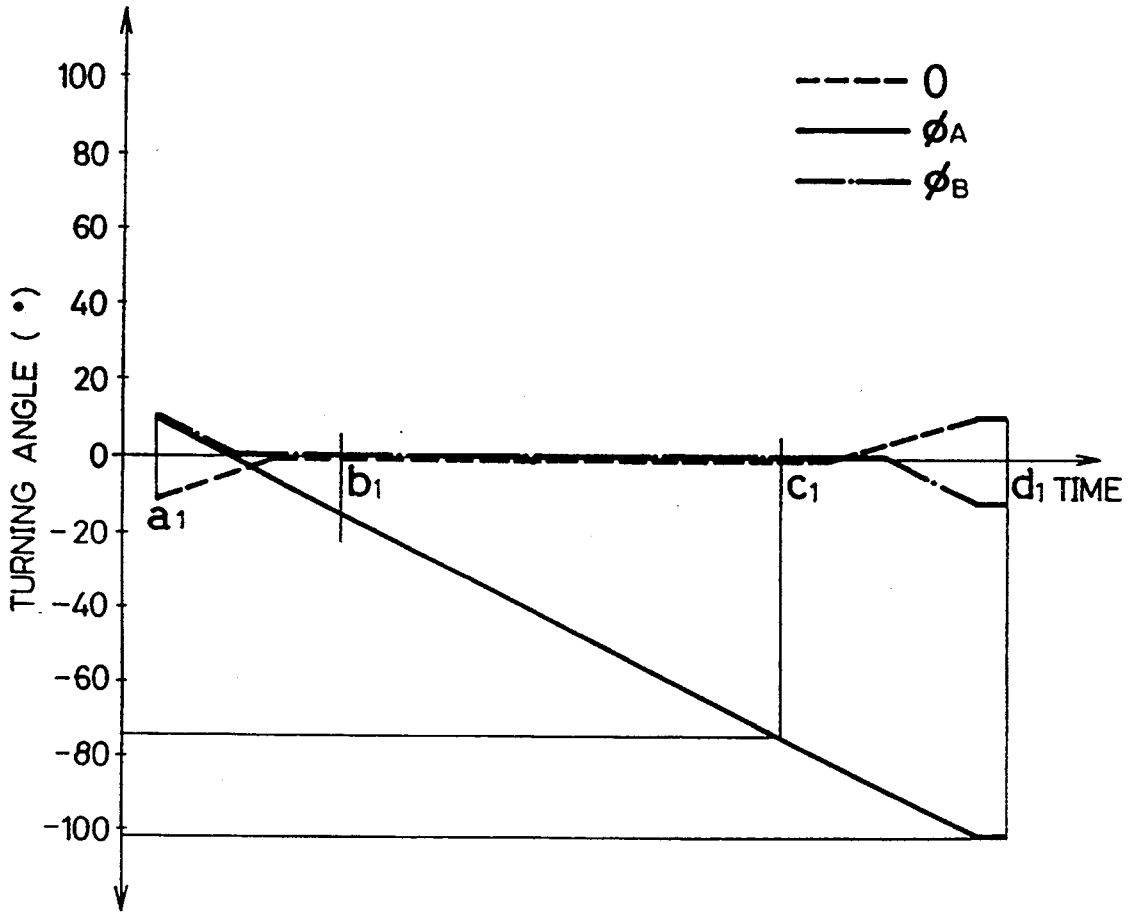
FIG. 25 is a graph illustrating the relations between the turning angle ($\theta$) of the rotation shaft of the turntable and the turning angles ($\phi_A$ and $\phi_B$) of the cassette rotation shafts of the paper cassettes on the feeding side and non-feeding side and time during Operation 1 shown in FIG. 24.
Figure 26:
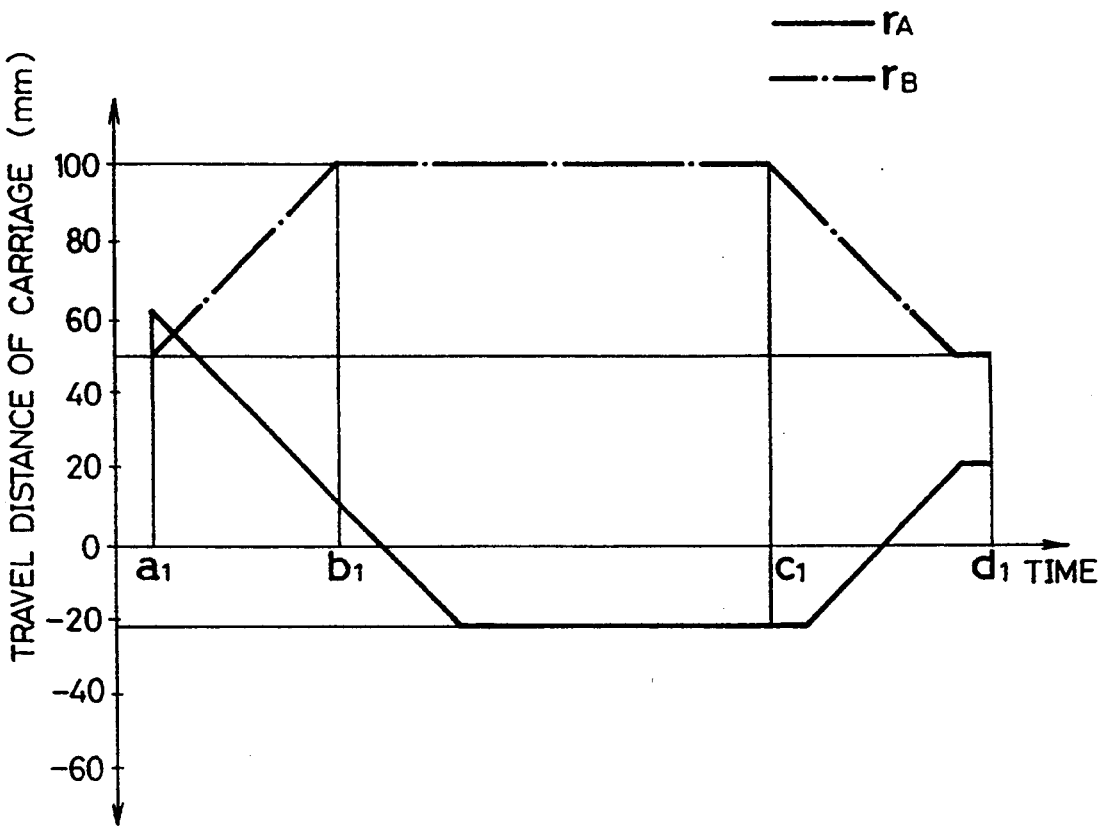
FIG. 26 is a graph illustrating the relations between the travel distances ($r_A$ and $r_B$) of the carriages on the feeding side and non-feeding side and time during Operation 1 shown in FIG. 24.

In Operation 1, to shorten the operation time, the $\theta$-axis driving and the $\phi$-axis driving shown in FIG. 25 and the r-axis driving shown in FIG. 26 are controlled simultaneously. As described above, the small angle rotating mechanism 250 rotates the turntable 200 during the $\theta$-axis driving, the cassette rotating mechanism 410 rotates the paper cassette 400 in $\phi$-axis driving, and the carriage driving mechanism 310 moves the carriage 300 in r-axis driving. Similarly, the $\theta$-axis driving, $\phi$-axis driving and r-axis driving are simultaneously controlled in Operations 2 and 3.

As illustrated in FIG. 32, $\theta$ represents the displacement of the rotation shaft 201 of the turntable 200, i.e., turning angle. This is an angle between the feeding center line $SL_S$ and the center line $SL_L$ of the rotated turntable 200 which is not parallel with the feeding center line $SL_S$. The turntable center line $SL_L$ extends in the longitudinal direction of the turntable 200 while passing through the cassette rotation shafts 416 of the two paper cassettes 400 and the rotation shaft 201 of the turntable 200. Additionally, with regard to $\theta$, the displacement in the counterclockwise direction is given by a positive (+) value and the displacement in the clockwise direction is given by a negative (−) value.

Each of $\phi_A$ and $\phi_B$ shown in FIG. 26 represents the turning angle of the paper cassette 400 with respect to the turntable center line $SL_L$. Supposing that a cassette center line $SL_C$ crosses the feeding center line $SL_S$ at right angles when the paper cassette 400 is in a state $Aa_1$ for sideways feed, the turning angle indicates the amount of movement of the cassette center line $SL_C$ when it crosses the turntable center line $SL_L$ at right angles. With regard to $\phi_A$ and $\phi_B$, similar to the above, the displacement in the counterclockwise direction is given by a positive (+) value and the displacement in the clockwise direction is given by a negative (−) value. Each of $r_A$ and $r_B$ represents the travel distance of the cassette rotation shaft 416 from the interchanging point $P_O$ shown in FIG. 21 as the result of the movement of the carriage 300. Regarding the travel distance, the movement from the interchanging point $P_O$ toward the rotation shaft 201 is given by a negative (−) value and the movement in the opposite direction is given by a positive (+) value.

The $\theta$-axis driving, r-axis driving and $\phi$-axis driving are controlled simultaneously according to the set reduction gear ratios $i_1$, $i_2$ and $i_4$, respectively. In this embodiment, the $\theta$-axis driving, r-axis driving and $\phi$-axis driving are controlled by a uniform-speed motion by maintaining the relations, $r:\phi:\theta=2$ mm:1°:0.5°. This is carried out by driving the pulse motors 258, 311 and 413 as power sources at a frequency, 100PPS, 7.5°/step in this embodiment.

Figure 27:
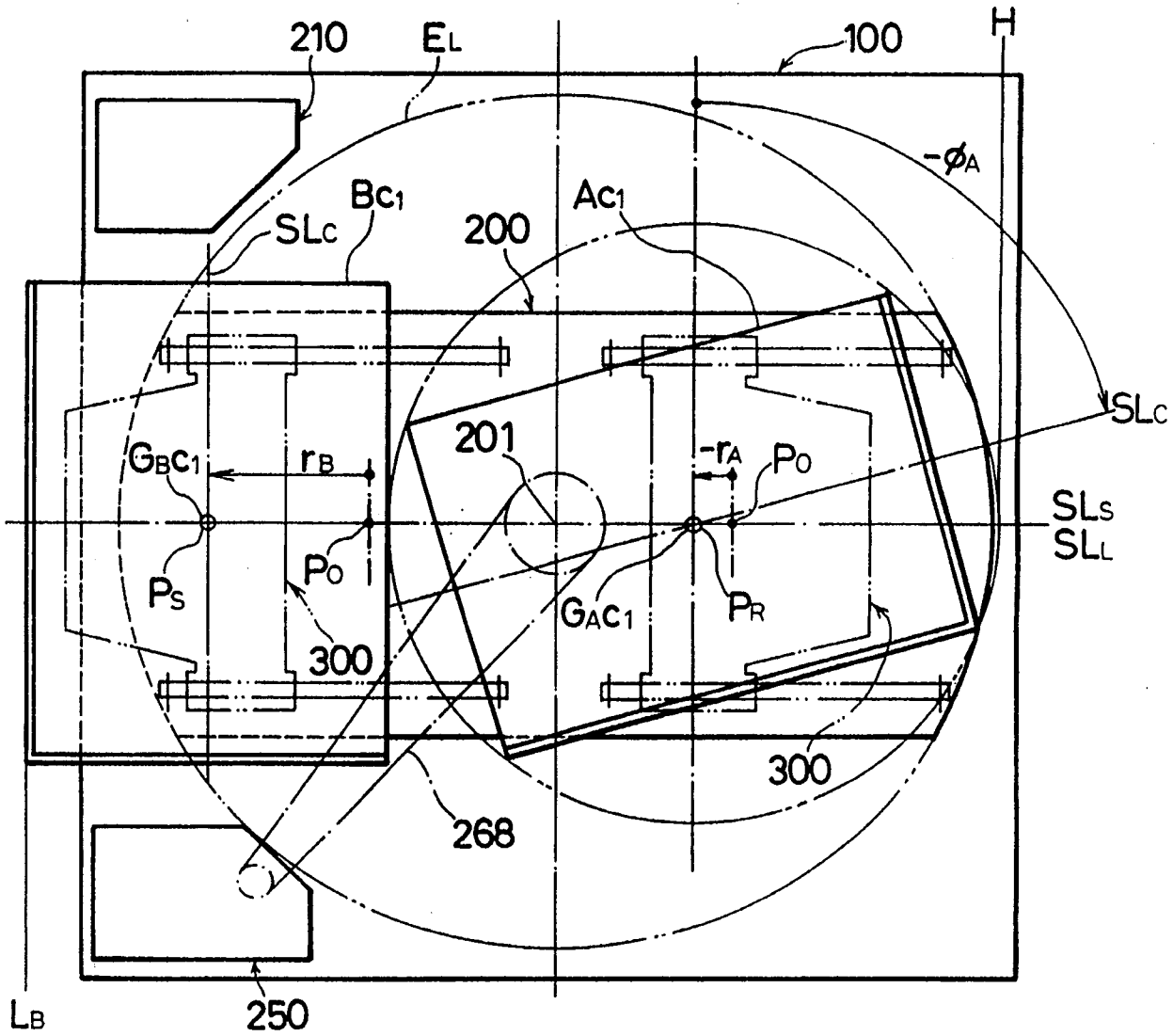
FIG. 27 is an explanatory view illustrating the locations of the cassette rotation shafts and the paper cassettes at time $a_1$ through time $d_1$ with relation to the rotation of the turntable's rotation shaft and of the cassette rotation shafts shown in FIG. 25 and the movements of the carriages shown in FIG. 26.

In the case when Operation 1 is performed in Mode 1, by controlling the operation as shown in FIGS. 25 and 26, the position of the cassette A on the feeding side 11 storing B5-sized paper is moved as shown in FIG. 27. More specifically, as time goes by from start time $a_1$ to time $b_1$, $c_1$ and $d_1$, the position of the cassette A is changed from the sideways feed state $Aa_1$ drawn with the solid line to a lengthways feed state $Ad_1$ via states $Ab_1$ and $Ac_1$ illustrated with the alternate long and two short dashes lines. During Operation 1, the leading edge of the cassette A on the feeding side 11 is moved substantially along the predetermined cassette leading edge setting line H without causing it to protrude from the cassette leading edge setting line H.

It is arranged that the cassette leading edge setting line H and the leading edge of the cassette A are in alignment when the cassette A is set in the sideways feed position or in the lengthways feed position. Moreover, denoting the cassette rotation shaft 416 of the cassette A and the cassette rotation shaft 416 of the cassette B as a cassette rotation shaft $G_A$ and a cassette rotation shaft $G_B$, respectively, the cassette rotation shaft $G_A$ is moved to $G_Aa_1$ to $G_Ad_1$ in accordance with the states $Aa_1$ to $Ad_1$ of the cassette A.

As for a cassette B on the non-feeding side, to avoid interference between the cassettes A and B, it is moved from a sideways feed state $Ba_1$ drawn with the solid line to a state $Bd_1$ via states $Bb_1$ and $Bc_1$ illustrated with the alternate long and two short dashes lines as time goes by from start time $a_1$ to time $b_1$, $c_1$ and $d_1$. As a result, the cassette rotation shaft $G_B$ is moved to $G_Ba_1$ to $G_Bd_1$ in accordance with the states $Ba_1$ to $Bd_1$ of the cassette B.

Figure 28:
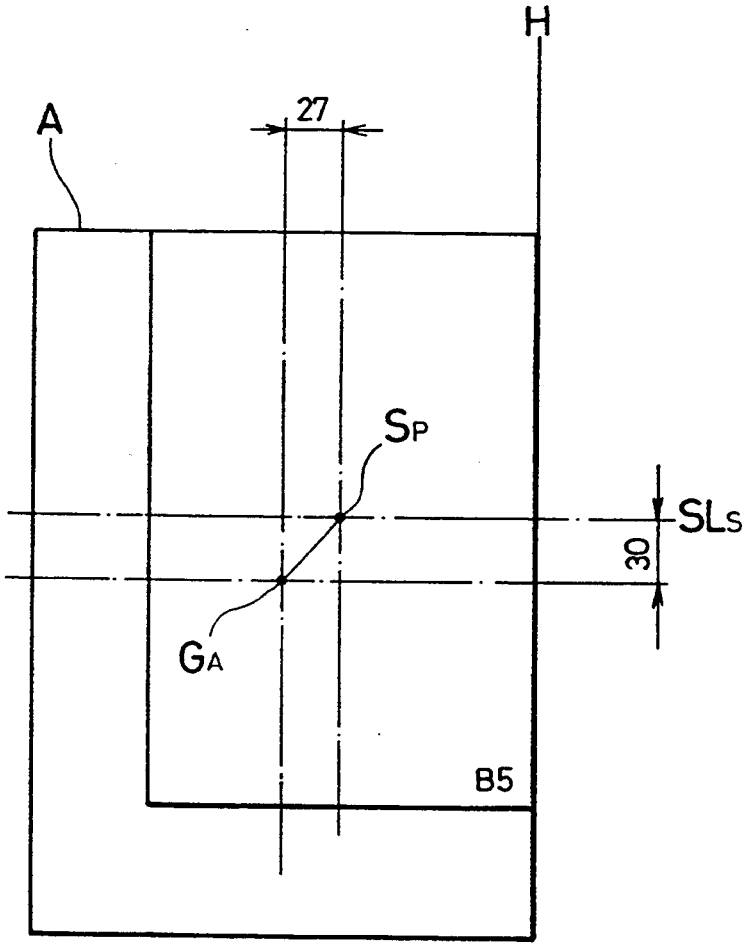
FIG. 28 is an explanatory view illustrating the relation among the feeding center line $SL_S$, the paper center $S_P$ of B5-sized paper stored in the paper cassette and the cassette rotation shaft $G_A$ when the paper cassette is placed in the sideways feed position.

As illustrated in FIG. 28, when the cassette A is in the sideways feed state $Aa_1$, the feeding center line $SL_S$ of the multi-stage feeding device 2 and the paper center $S_P$ of the paper stored in the cassette A are controlled to come into alignment. Since the B5-sized paper is stored while aligning a side of the paper against one of the sides of the cassette A, the paper center $S_P$ and the cassette rotation shaft $G_A$ come into an offset state. Accordingly, the cassette rotation shaft $G_A$ and the feeding center line $SL_S$ are out of alignment.

Figure 29:
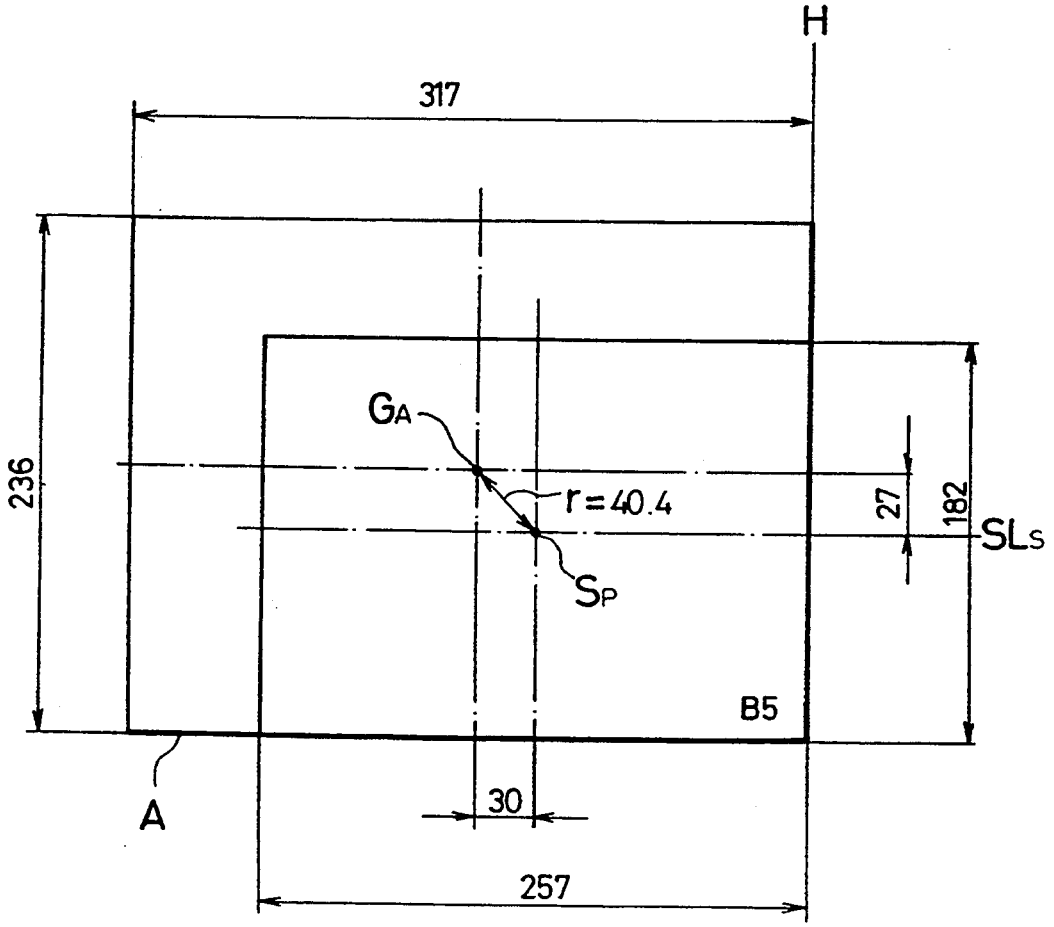
FIG. 29 is an explanatory view illustrating the relation among the feeding center line $SL_S$, the paper center $S_P$ of B5-sized paper stored in the paper cassette and the cassette rotation shaft $G_A$ when the paper cassette is placed in the lengthways feed position.
Figure 30:
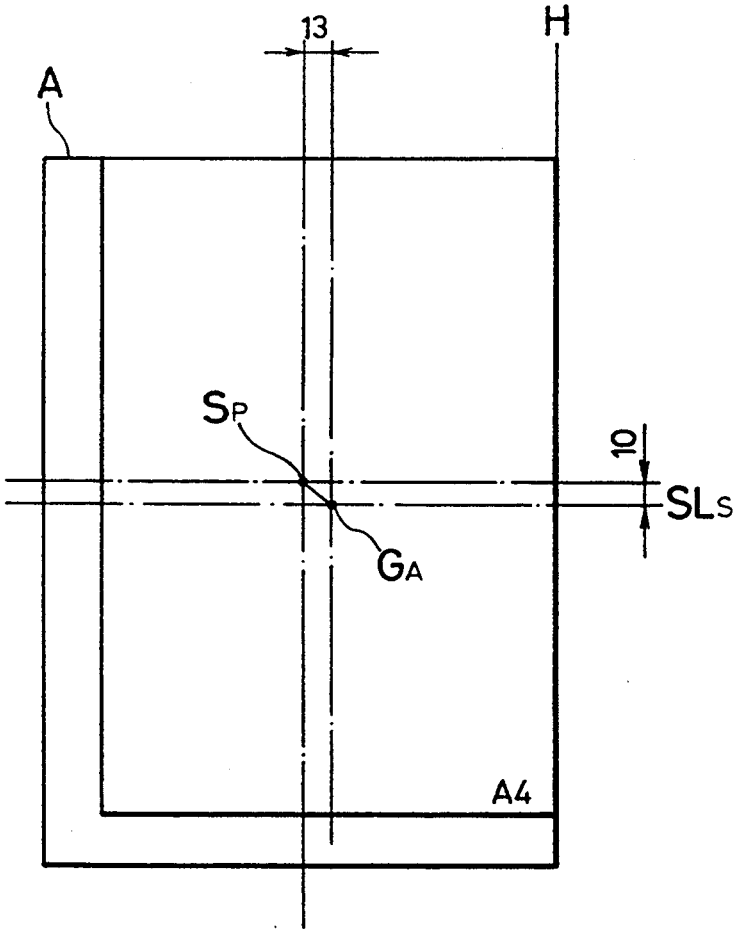
FIG. 30 is an explanatory view illustrating the relation among the feeding center line $SL_S$, the paper center $S_P$ of A4-sized paper stored in the paper cassette and the cassette rotation shaft $G_A$ when the paper cassette is placed in the sideways feed position.
Figure 31:
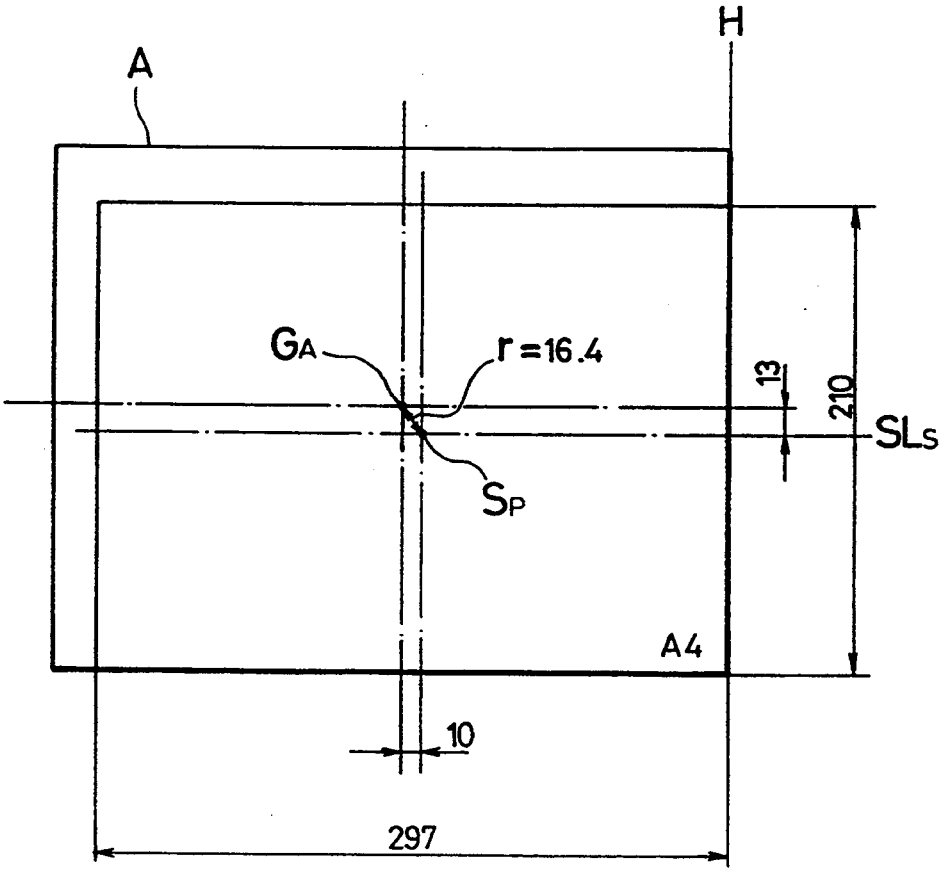
FIG. 31 is an explanatory view illustrating the relation among the feeding center line $SL_S$, the paper center $S_P$ of A4-sized paper stored in the paper cassette and the cassette rotation shaft $G_A$ when the paper cassette is placed in the lengthways feed position.

Similarly, the paper center $S_P$ and the cassette rotation shaft $G_A$ are out of alignment when B5-sized paper is stored in the cassette A positioned for lengthways feed (see FIG. 29), when A4-sized paper is stored in the cassette A positioned for sideways feed (see FIG. 30), and when A4-sized paper is stored in the cassette A positioned for lengthways feed (see FIG. 31). In each case, the cassette rotation shaft $G_A$ is in an offset state with respect to the feeding center line $SL_S$.

Therefore, when the cassette A on the feeding side 11 is in the sideways feed state $Aa_1$, i.e., at start time $a_1$, as illustrated in FIG. 32, the turntable 200 is turned by $-\theta$ degrees by the $\theta$-axis driving so as to align the paper center $S_P$ shown in FIG. 28 with the feeding center line $SL_S$. At this time, the cassette rotation shaft $G_A$ is also rotated by $+\phi_A$ degrees by the $\phi$-axis driving as shown in FIG. 32 so that the leading edge of the paper crosses the feeding center line $SL_S$ at right angles. Then, the carriage 300, i.e., the cassette rotation shaft $G_A$ is moved by a distance of $+r_A$ by the r-axis driving in order to align the leading edge of the cassette A with the cassette leading edge setting line H. Moreover, regarding the cassette B on the non-feeding side, the cassette rotation shaft $G_B$ is rotated by an angle of $+\phi_B$ that is equal to $\phi_A$ and moved by a distance of $+r_B$.

At time $b_1$ the turning angle $\theta$ of the turntable 200 is 0°, i.e., the turntable 200 is in a stationary state and the turntable center line $SL_L$ is parallel with the feeding center line $SL_S$. In this state, the rotation shaft $G_A$ is rotated with a uniform speed toward the negative direction by the $\phi$-axis driving, and the cassette A is moved in the negative direction with respect to the point $G_Aa_1$ by the r-axis driving without causing its leading edge to protrude from the cassette leading edge setting line H.

In the meantime, with regard to the cassette B, as illustrated in FIG. 33 at time $c_1$ the turning angle $\phi_B$ of the cassette rotation shaft $G_B$ is 0°, i.e., the cassette B is in a stationary state and the cassette center line $SL_C$ crosses the turntable center line $SL_L$ at right angles. In this state, the cassette rotation shaft $G_B$ is moved maximally in the positive direction from the interchanging point $P_O$ to a clearance point $P_S$, for example, by $r_B$ or 101 mm in this embodiment, and stopped. Accordingly, the cassette B is stopped at the clearance position located furthest away from the rotation shaft 201. At the clearance position, an edge of the cassette B protrudes from the tray 100 to the clearance line $L_B$ and the cassette center line $SL_C$ crosses the feeding center line $SL_S$ at right angles.

As illustrated in FIG. 33, the states of the turntable 200 and the cassette B on the non-feeding side at time $c_1$ and the states thereof at time $b_1$ are same. At this time, with regard to the cassette A on the feeding side 11, the cassette rotation shaft $G_A$ is rotated with a uniform speed toward the negative direction by the $\phi$-axis driving while being moved to the retracted point $P_R$ by the r-axis driving. In this figure, the cassette rotation shaft $G_A$ is rotated by an angle of $\phi_A$, that is, $-75$ degrees.

Figure 34:
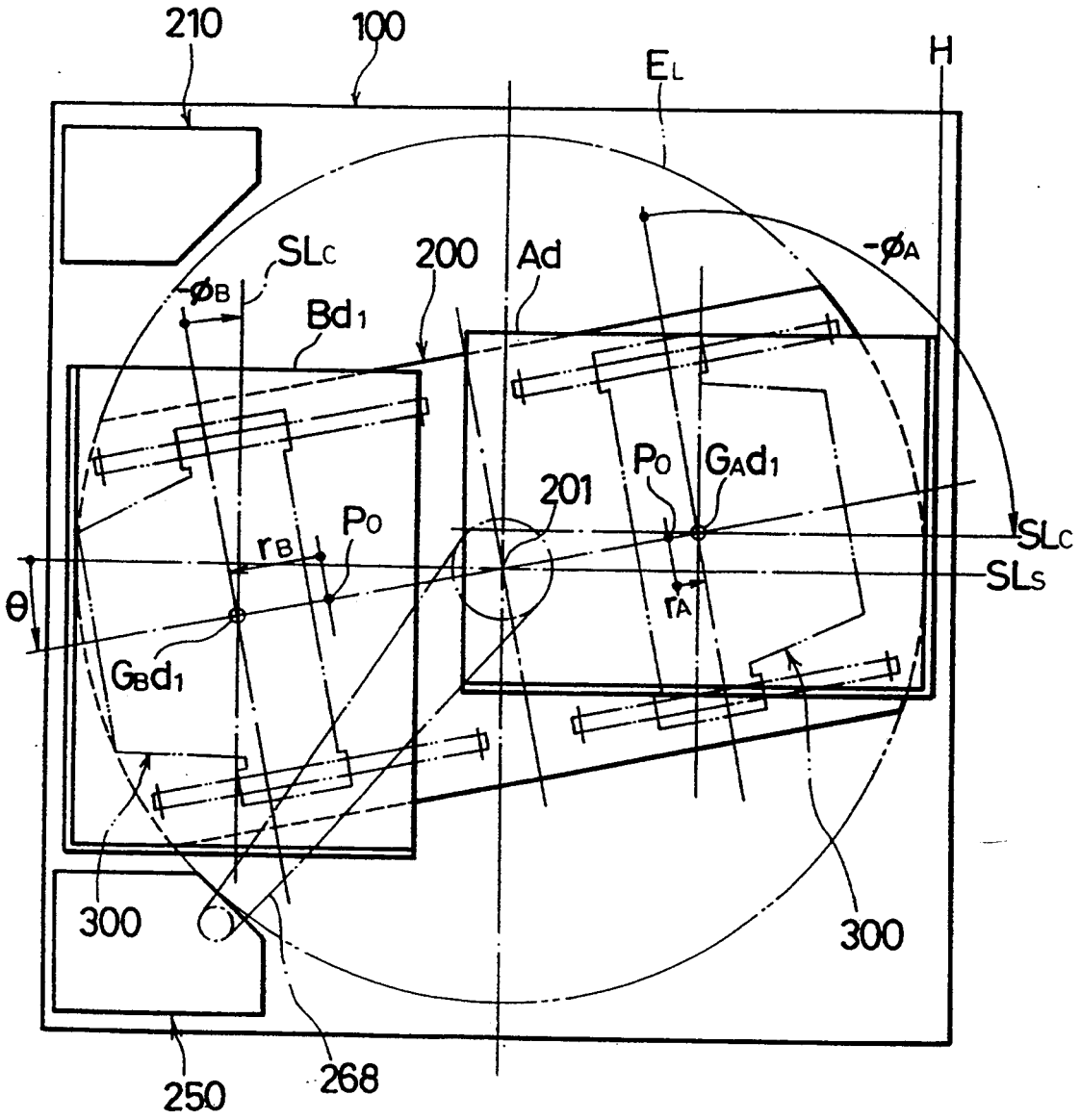
FIG. 34 is an explanatory view illustrating the states of the turntable, carriages and paper cassettes at time $d_1$ during Operation 1 shown in FIGS. 25 and 26.

At time $d_1$ Operation 1 is completed. As illustrated in FIG. 34, the turntable 200 is turned by $+\theta$ degrees by the $\theta$-axis driving in order to align the paper center $S_P$ shown in FIG. 31 with the feeding center line $SL_S$, and is then stopped. At this time, with regard to the cassette A, the cassette rotation shaft $G_A$ is rotated by $-\phi_A$ degrees by the $\phi$-axis driving so that the cassette center line $SL_C$ is parallel with the feeding center line $SL_S$ and that the leading edge of the paper crosses the feeding center line $SL_S$ at right angles. Further, the cassette rotation shaft $G_A$ is moved by a distance of $+r_A$ shown in FIG. 34 by the r-axis driving in order to align the leading edge of the cassette A with the cassette leading edge setting line H.

In the meantime, regarding the cassette B on the non-feeding side, the cassette rotation shaft $G_B$ is rotated by an angle of $-\phi_B$ and moved by a distance of $+r_B$ that is equal to the travel distance in the state $Ba_1$.

Operation 2 will be explained below.

Figure 35:
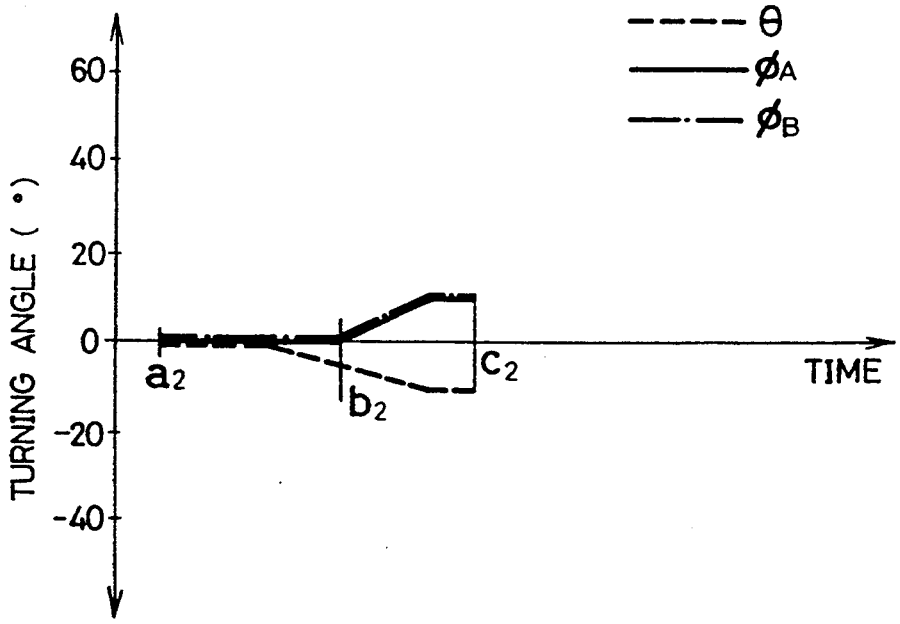
FIG. 35 is a graph illustrating the relations between the turning angle ($\theta$) of the rotation shaft of the turntable and the turning angles ($\phi_A$ and $\phi_B$) of the cassette rotation shafts of the paper cassettes on the feeding side and non-feeding side and time during Operation 2 shown in FIG. 24.
Figure 36:
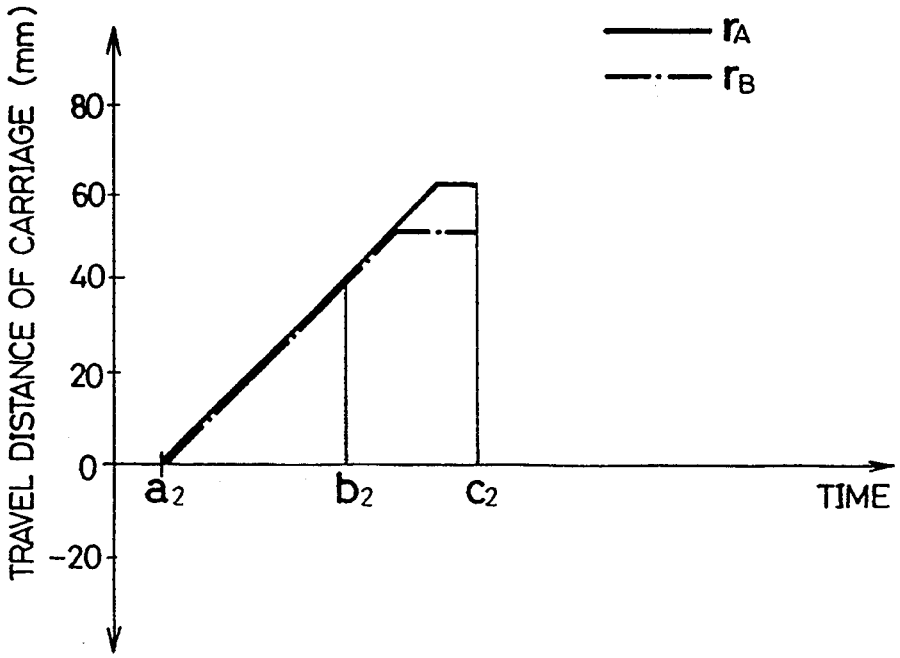
FIG. 36 is a graph illustrating the relations between the travel distances ($r_A$ and $r_B$) of the carriages on the feeding side and non-feeding side and time during Operation 2 shown in FIG. 24.
Figure 37:
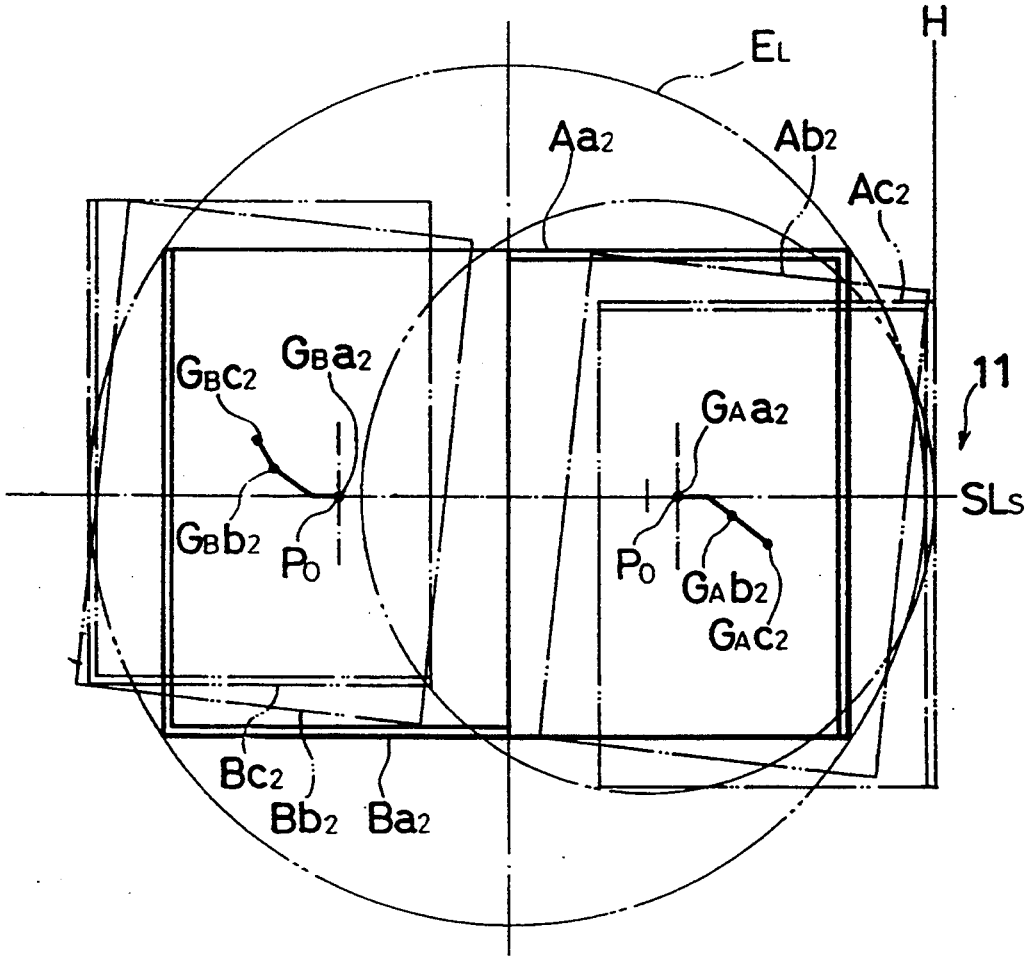
FIG. 37 is an explanatory view illustrating the locations of the cassette rotation shafts and the paper cassettes at time $a_2$ through time $c_2$ with relation to the rotation of the turntable's rotation shaft and of the cassette rotation shafts shown in FIG. 35 and the movements of the carriage shown in FIG. 36.

In Operation 2, as described above, after interchanging the paper cassettes 400 on the feeding side 11 and on the non-feeding side, the paper cassette 400 on the feeding side 11 is positioned for sideways feed. The operation is controlled as shown in FIGS. 35 and 36. At start time $a_2$, the cassettes A and B are in the states $Aa_2$ and $Ba_2$, i.e., they are in closest proximity as shown with the solid lines in FIG. 37. Then, as time goes by to time $b_2$ and time $c_2$, they are parted from each other to reach states $Ac_2$ and $Bc_2$ via states $Ab_2$ and $Bb_2$ as shown with the alternate long and two short dashes lines. As a result, the cassette A is placed in the sideways feed position. And the rotation shafts $G_A$ and $G_B$ are also moved to $G_Aa_2$ to $G_Ac_2$ and to $G_Ba_2$ to $G_Bc_2$, respectively, in accordance with the states $Aa_2$ to $Ac_2$ and $Ba_2$ to $Bc_2$ of the cassettes A and B.

Figure 38:
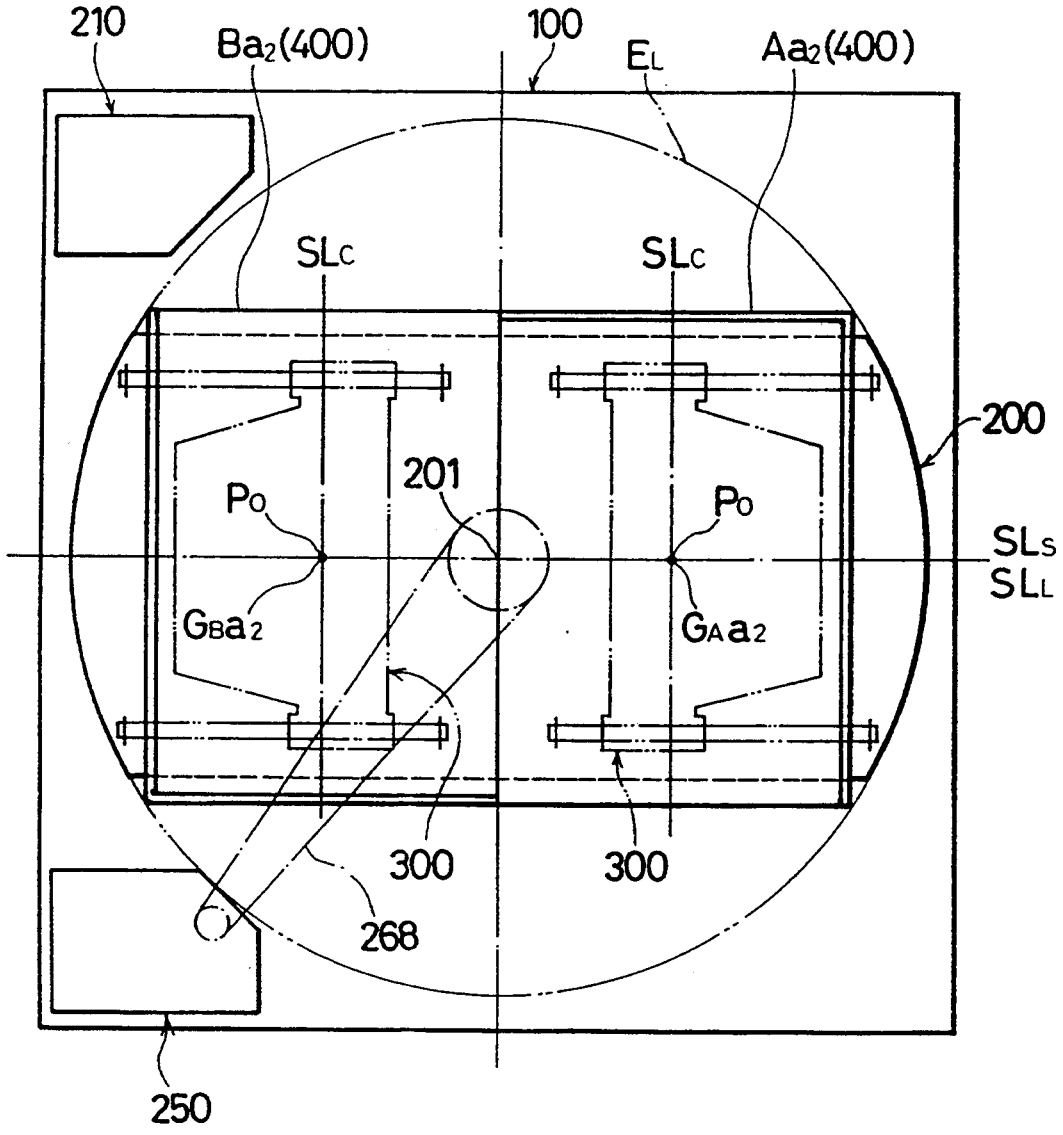
FIG. 38 is an explanatory view illustrating the states of the turntable, carriages and paper cassettes at time $a_2$ during Operation 2 shown in FIGS. 35 and 36.

When Operation 2 is started at time $a_2$, as illustrated in FIG. 38, the turntable 200 is in a stationary state, $\theta=0°$. In this state, both $\phi_A$ and $\phi_B$ are 0 degrees, and the cassette center lines $SL_C$ of the cassettes A and B cross the turntable center line $SL_L$ and the feeding center line $SL_S$ at right angles respectively. In addition, both $r_A$ and $r_B$ are 0, and the cassette rotation shafts $G_A$ and $G_B$ of the cassettes A and B are located on the respective interchanging points $P_O$.

At time $b_2$, the turntable 200 is rotated in the negative direction by the $\theta$-axis driving. At this time, the cassette center lines $SL_C$ of the cassettes A and B still cross the turntable center line $SL_L$ at right angles. In the meantime, the cassette rotation shafts $G_A$ and $G_B$ of the cassettes A and B are moved from the interchanging points $P_O$ toward the positive direction by the r-axis driving, respectively.

Figure 39:
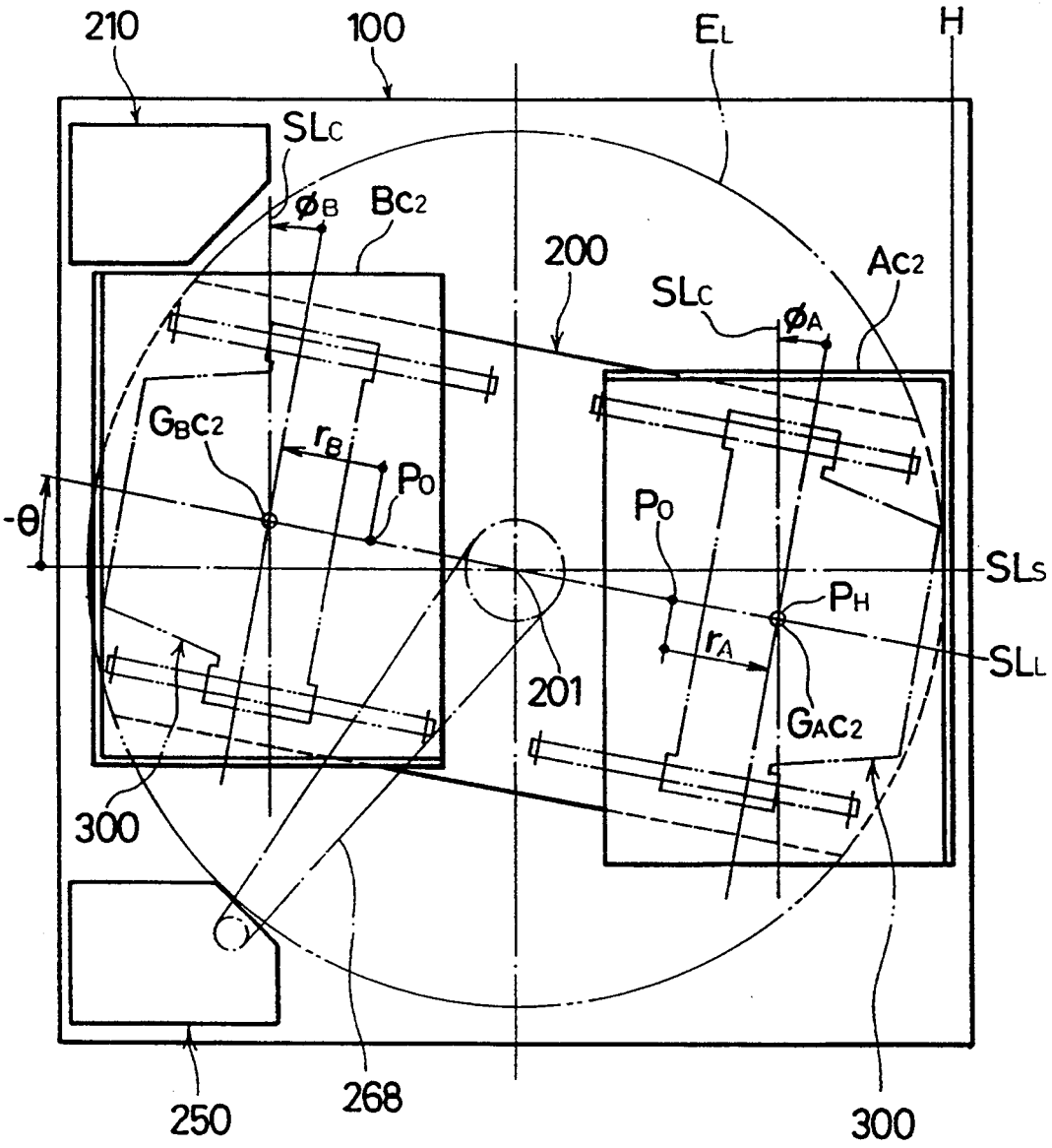
FIG. 39 is an explanatory view illustrating the states of the turntable, carriages and paper cassettes at time $c_2$ during Operation 2 shown in FIGS. 35 and 36.

At time $c_2$, Operation 2 is finished. At this time, as illustrated in FIG. 39, the turntable 200 is turned by $-\theta$ degrees by the $\theta$-axis driving in order to align the paper center $S_P$ with the feeding center line $SL_S$, and is then stopped. With regard to the cassette A, the cassette rotation shaft $G_A$ is rotated by $+\phi_A$ degrees by the $\phi$-axis driving so that the cassette center line $SL_C$ crosses the feeding center line $SL_S$ at right angles and that the leading edge of the paper crosses the feeding center line $SL_S$ at right angles. Besides, the cassette rotation shaft $G_A$ is moved by a distance of $+r_A$ by the r-axis driving in order to align the leading edge of the cassette A with the cassette leading edge setting line H.

Meanwhile, regarding the cassette B on the non-feeding side, the cassette rotation shaft $G_B$ is rotated by an angle of $+\phi_B$ that is equal to $+\phi_A$ and moved by a distance of $+r_B$ that is smaller than $r_A$.

The following will explain Operation 3.

Figure 40:
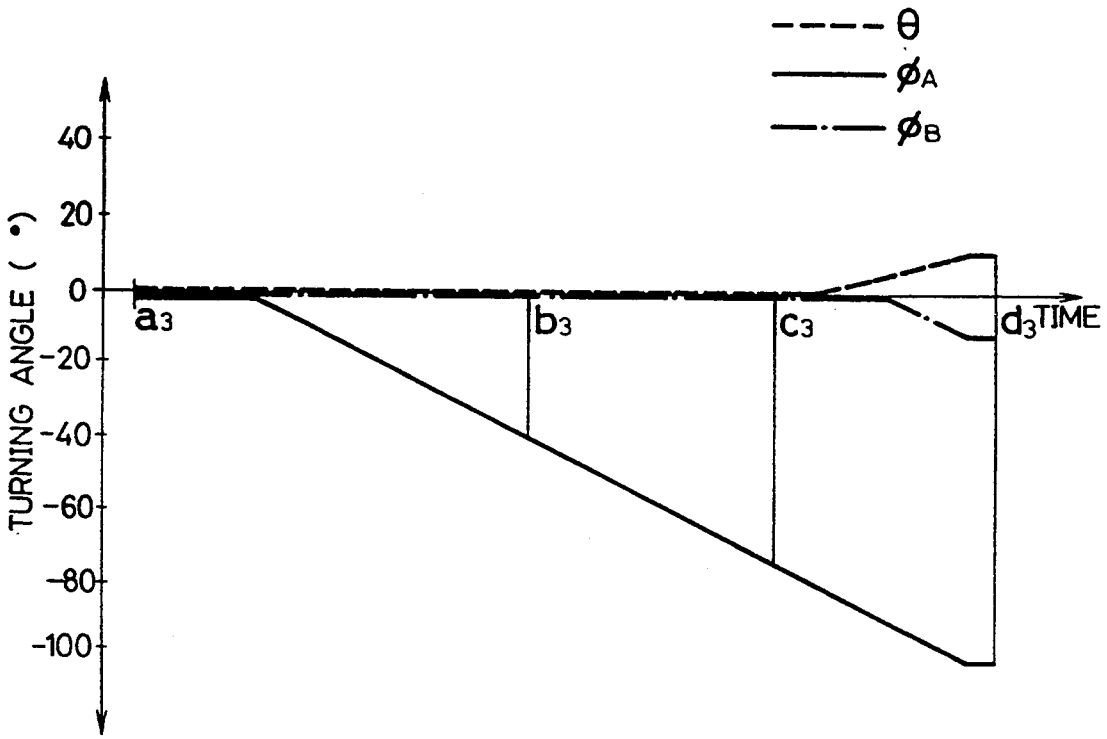
FIG. 40 is a graph illustrating the relations between the turning angle ($\theta$) of the rotation shaft of the turntable and the turning angles ($\phi_A$ and $\phi_B$) of the cassette rotation shafts of the paper cassettes on the feeding side and non-feeding side and time during Operation 3 shown in FIG. 24.
Figure 41:
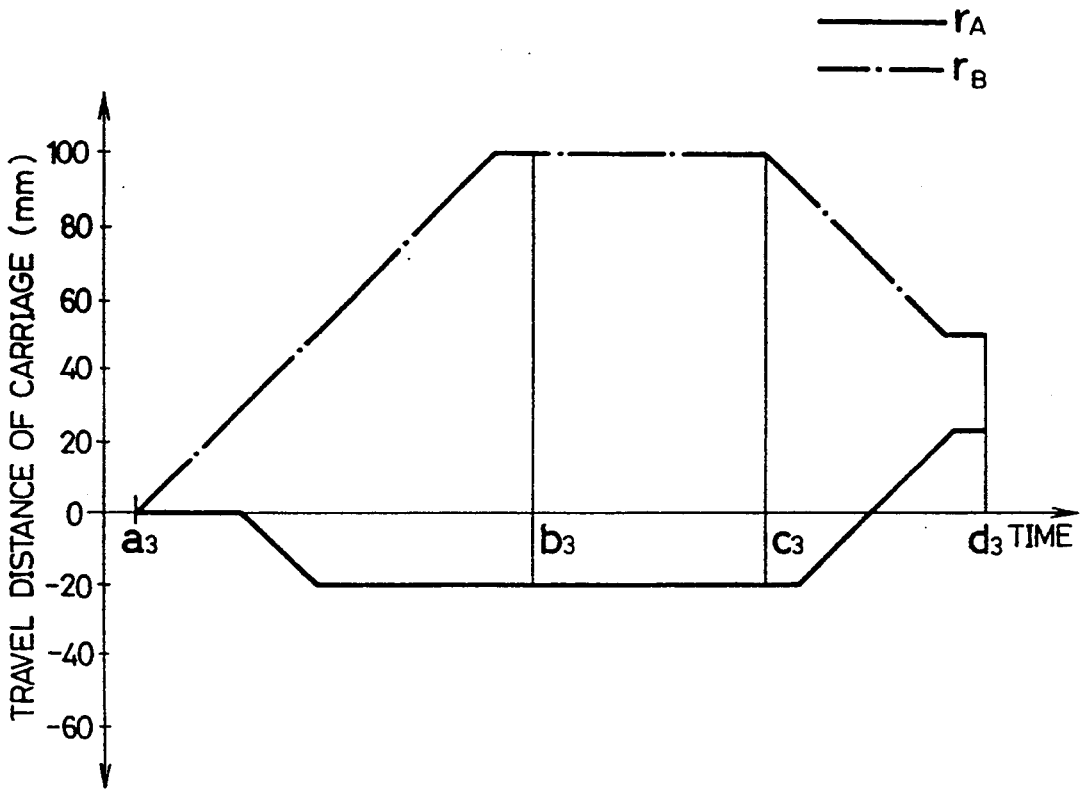
FIG. 41 is a graph illustrating the relations between the travel distances ($r_A$ and $r_B$) of the carriages on the feeding side and non-feeding side and time during Operation 3 shown in FIG. 24.
Figure 42:
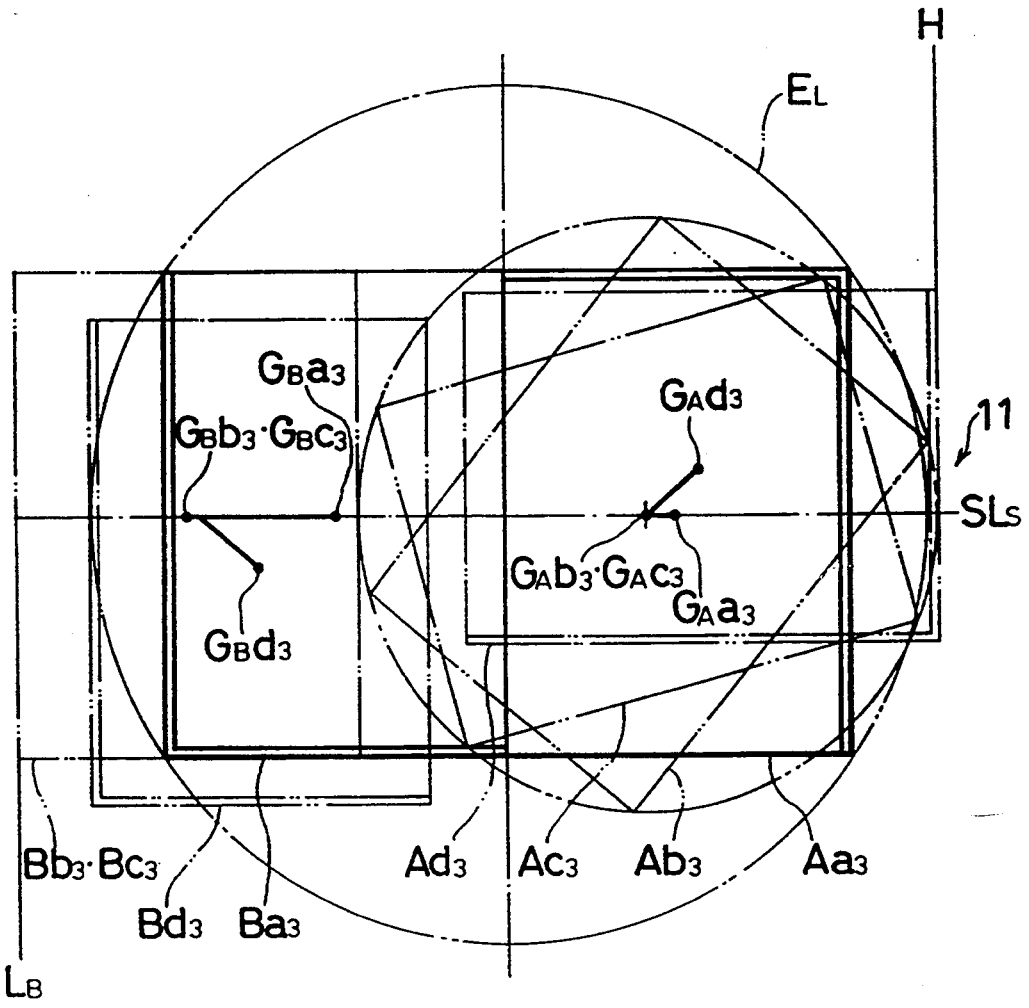
FIG. 42 is an explanatory view illustrating the locations of the cassette rotation shafts and the paper cassettes at time $a_3$ through $d_3$ with relation to the rotation of the turntable's rotation shaft and of the cassette rotation shafts shown in FIG. 40 and the movements of the carriages shown in FIG. 41.

In Operation 3, as described above, after interchanging the paper cassettes 400 on the feeding side 11 and on the non-feeding side, the paper cassette 400 on the feeding side 11 is positioned for lengthways feed. At this time, the operation is controlled as shown in FIGS. 40 and 41. Namely, as illustrated in FIG. 42, the cassettes A and B are in the states $Aa_3$ and $Ba_3$ at start time $a_3$, i.e., in closest proximity as shown with the solid lines. Then, as time goes by to time $b_3$, $c_3$ and $d_3$, they are moved so that the cassette A is positioned for lengthways feed and cassette B is in a state $Bd_3$, i.e., a longer side of the cassette B is perpendicular to the longer sides of the cassette A. At that time, the rotation shafts $G_A$ and $G_B$ of the cassettes A and B are also moved to $G_Aa_3$ to $G_Ad_3$ and to $G_Ba_3$ to $G_Bd_3$, respectively.

Figure 43:
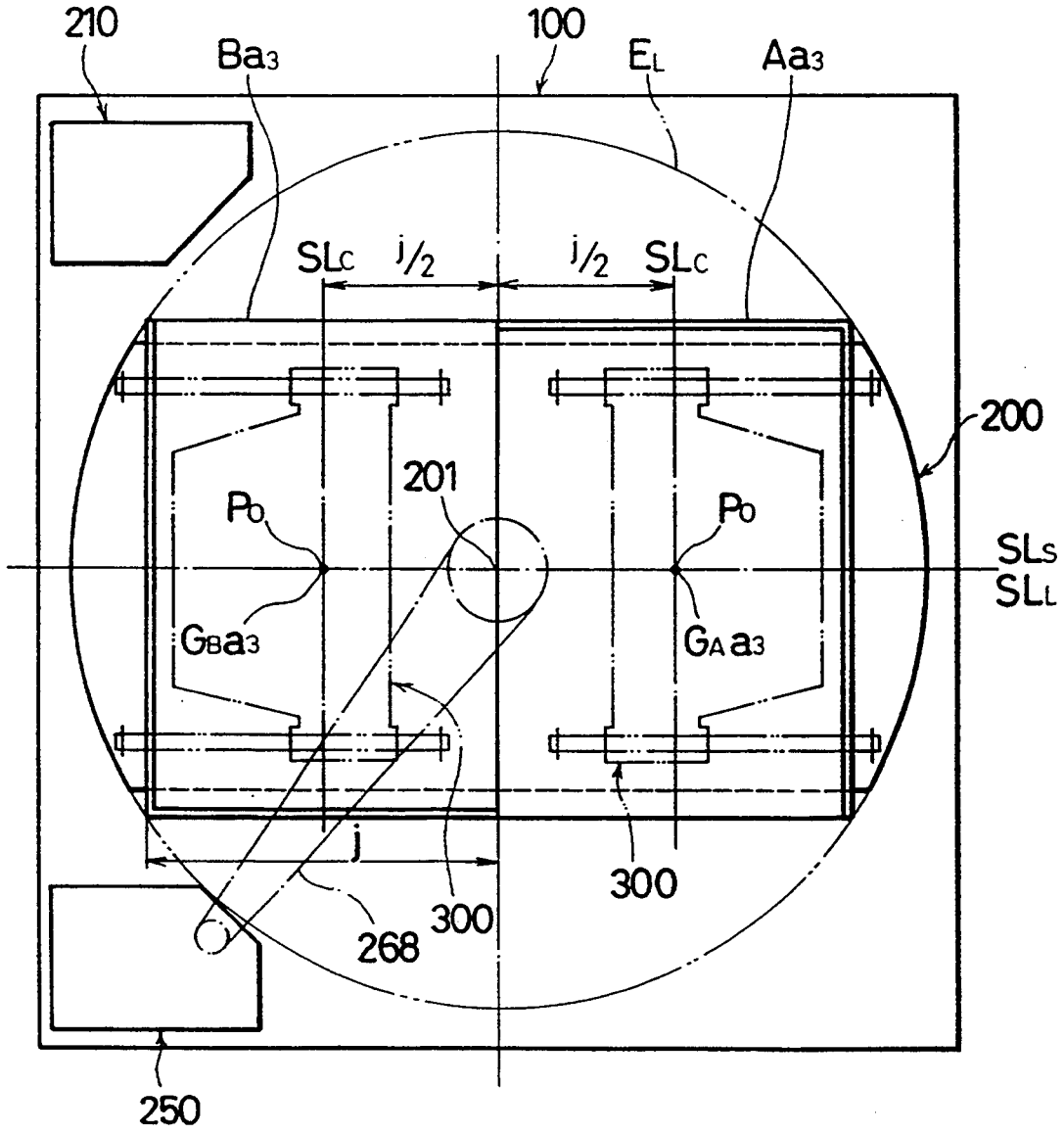
FIG. 43 is an explanatory view illustrating the states of the turntable, carriages and paper cassettes at time $a_3$ during Operation 3 shown in FIGS. 40 and 41.

As illustrated in FIG. 43, at time $a_3$ when Operation 3 is started, the states of the turntable 200 and the cassettes A and B are as same as those at time $a_2$ in Operation 2 shown in FIG. 38.

At time $b_3$, the turntable 200 is still in the stationary state like at time $a_3$. At this time, with regard to the cassette A, the cassette rotation shaft $G_A$ is rotated at a uniform speed toward the negative direction by the $\phi$-axis driving, and is moved from the interchanging point $P_O$ to the retracted point $P_R$ by a distance of $-r_A$.

Figure 44:
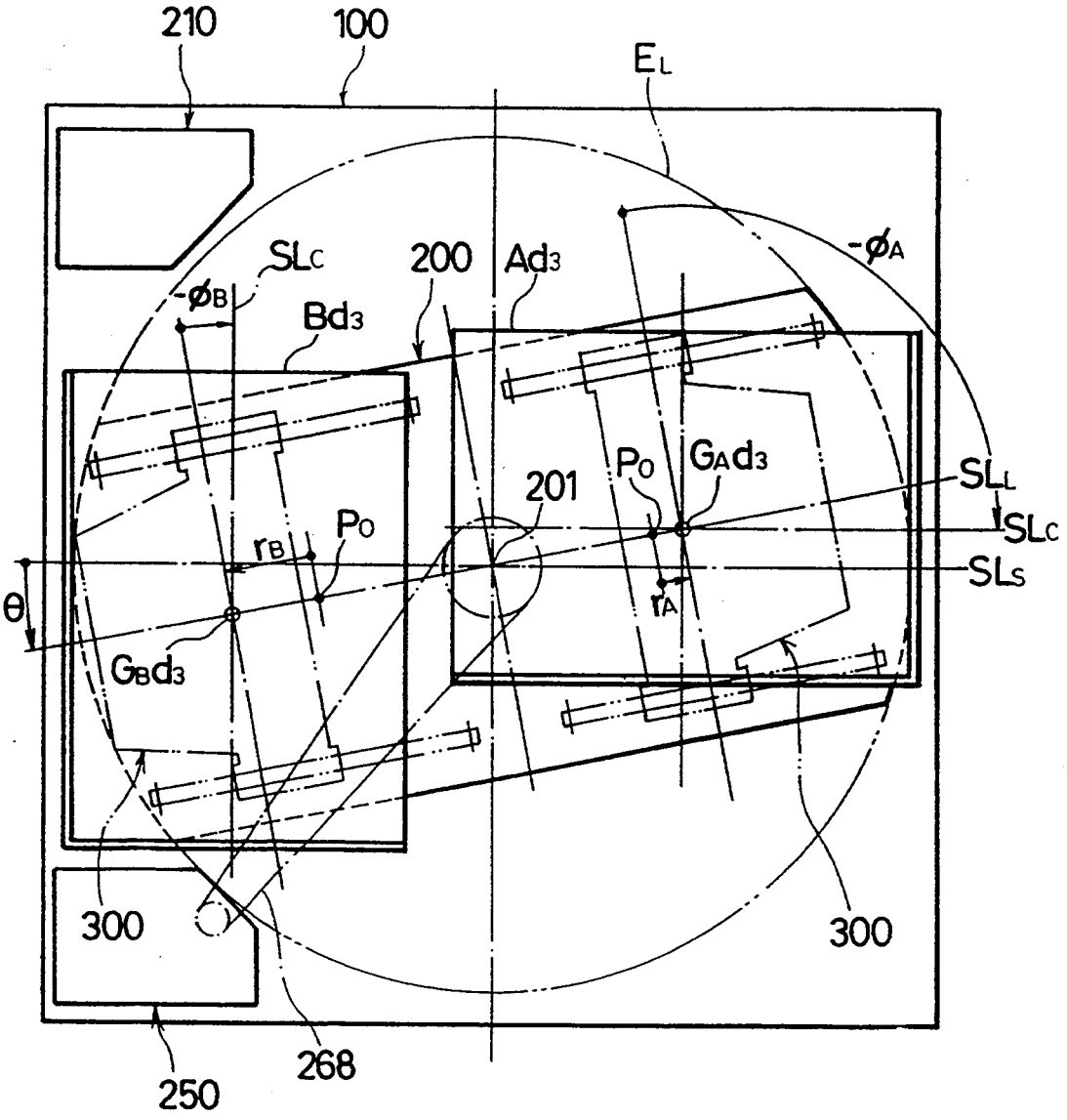
FIG. 44 is an explanatory view illustrating the states of the turntable, carriages and paper cassettes at time $c_3$ during Operation 3 shown in FIGS. 40 and 41.
Figure 45:
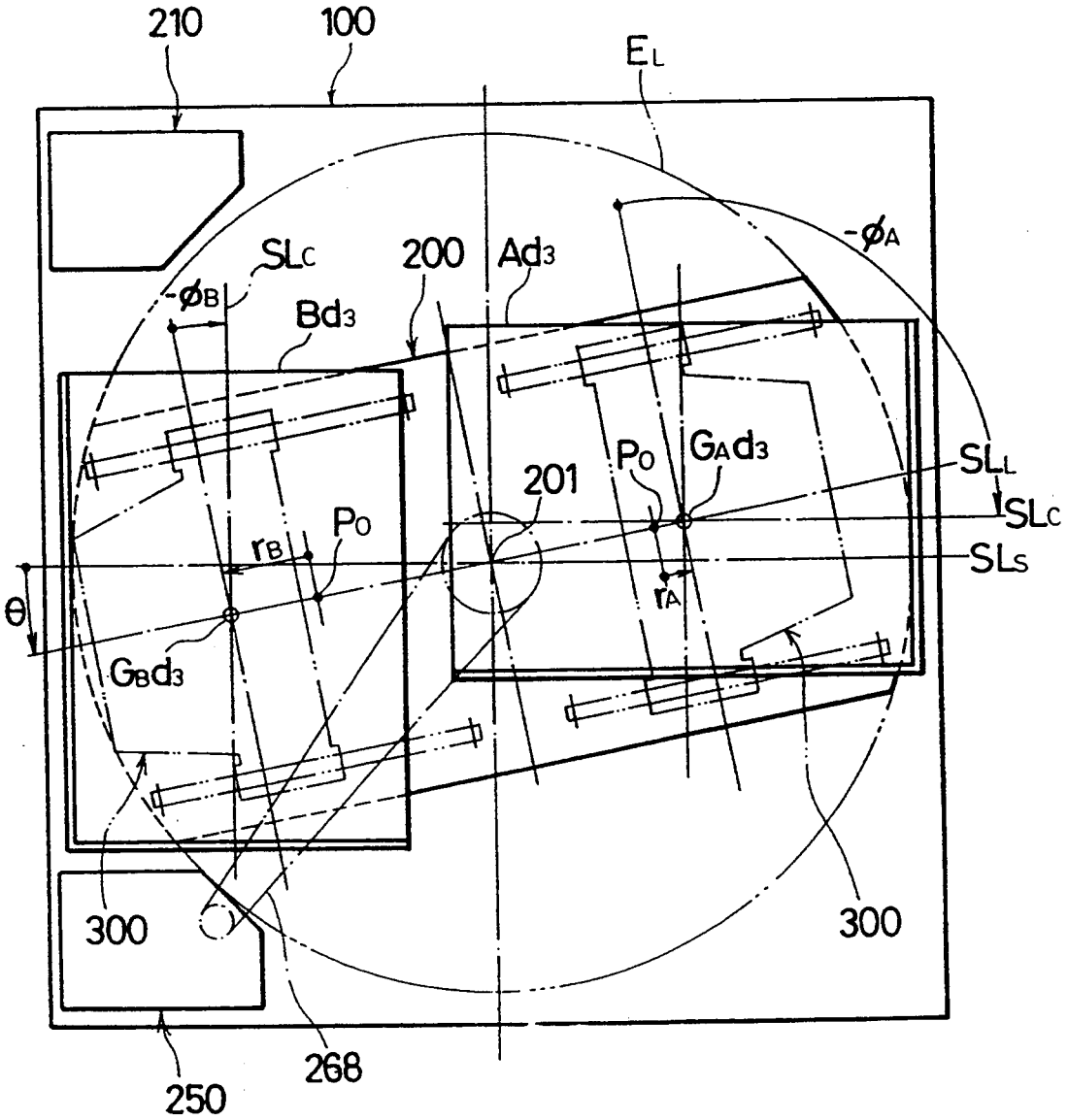
FIG. 45 is an explanatory view illustrating the states of the turntables, carriages and paper cassettes at time $d_3$ during Operation 3 shown in FIGS. 40 and 41.

Regarding the cassette B, as illustrated in FIG. 44, at time $c_3$ the turning angle $\phi_B$ of the cassette rotation shaft $G_B$ is 0°, i.e., it is in a stationary state where its cassette center line $SL_C$ crosses the turntable center line $SL_L$ at right angles and the cassette rotation shaft $G_B$ is stopped at the clearance point $P_S$. The states of the cassette B at time $c_3$ shown in FIG. 44 and time $d_3$ shown in FIG. 45 are the same as those at time $c_1$ and time $d_1$ in Operation 1 shown in FIGS. 33 and 34.

The explanations of Operations 1 to 3 described above show the controlled variable for the case where the cassette A stores B5-sized paper. So when the cassette A stores paper of a different size, the control variable will vary.

Figure 46:
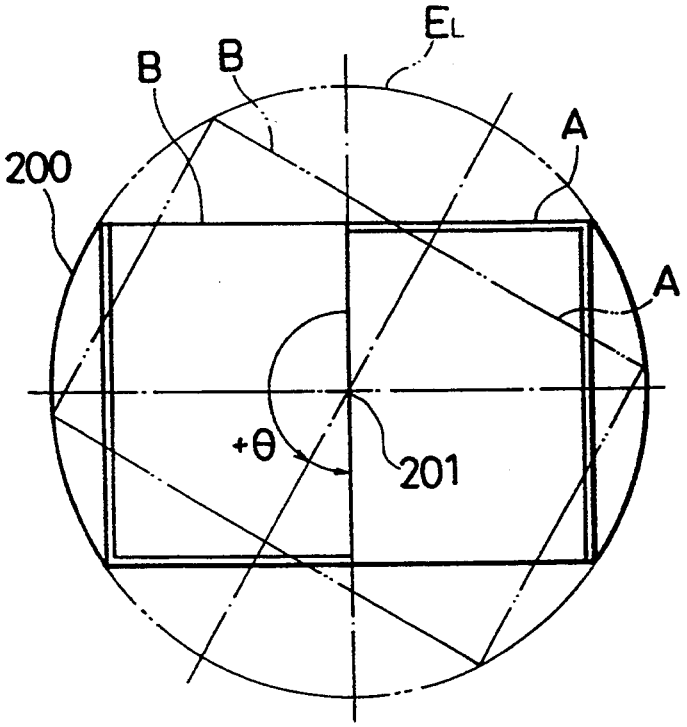
FIG. 46 is a view explaining the rotation of the turntable according to Operation 4 shown in FIG. 24.

As illustrated in FIG. 46, Operation 4 interchanges the paper cassettes 400 on the feeding side and on the non-feeding side by rotating the turntable 200 by 180 degrees. The two paper cassettes 400 are placed side by side in closest proximity to the rotation shaft 201 of the turntable 200, and then the turntable 200 is turned. At this time, the cassette rotation shafts 416 are located on the respective interchanging points $P_O$. Differently from other operations, Operation 4 is performed independently of the $\theta$-axis driving, $\phi$-axis driving and r-axis driving.

As described above, within the rotatable cassette units 4 and 5 of this embodiment, by the rotation of the turntable 200 driven by the 180-degree rotating mechanism, the two paper cassettes 400 mounted on a plane are interchanged. And the carriage driving mechanism 310 moves the paper cassette 400 on the feeding side 11 to align the leading edge of the paper cassette 400 with the cassette leading edge setting line H.

Additionally, within the rotatable cassette units 4 and 5, when interchanging the paper cassettes 400 on the feeding side 11 and on the non-feeding side, since the paper cassettes 400 are moved in the positions closest to the axis of rotation of the turntable 200, the interchange of the paper cassettes 400 is performed with a reduced plane space. This enables a decrease in the size of the apparatus.

Figure 47:
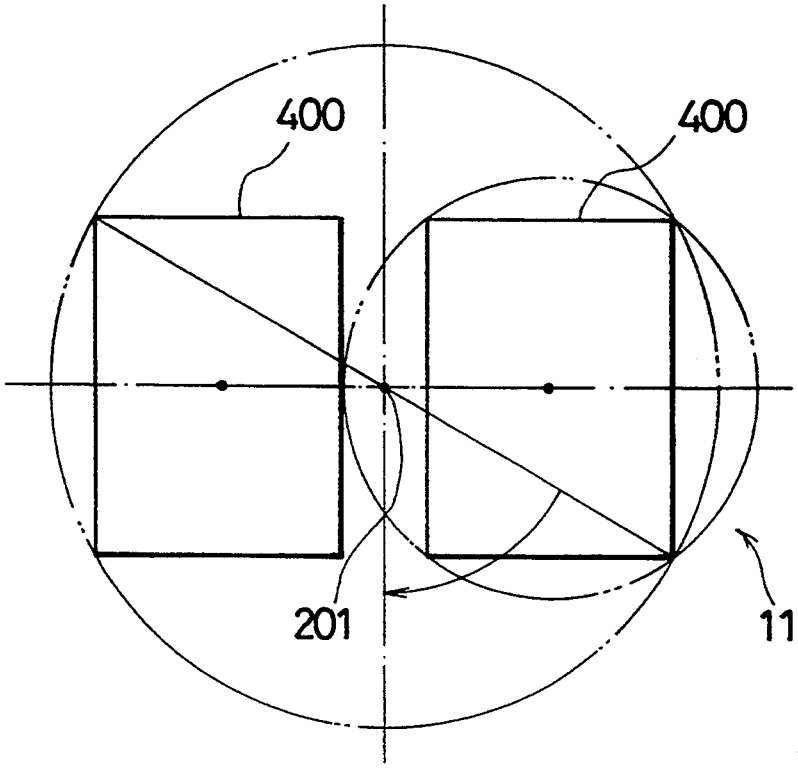
FIG. 47 is a view illustrating the rotatable cassette unit shown in FIG. 1 wherein the paper cassettes on the feeding side and non-feeding side which are arranged such that the paper cassette on the feeding side is rotatable, and explaining a turning space occupied by both the paper cassettes when their places are interchanged.
Figure 48:
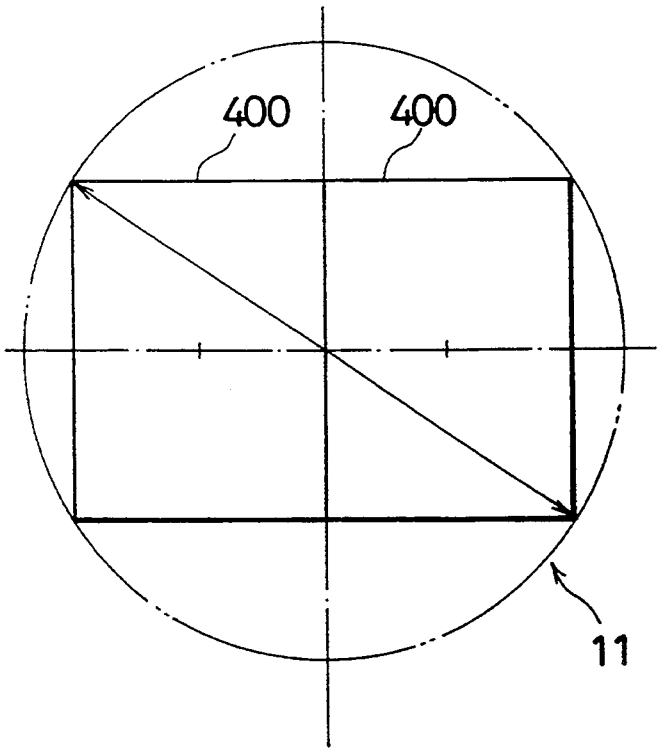
FIG. 48 is a view illustrating the paper cassettes shown in FIG. 47, and explaining a minimum turning space occupied by the paper cassettes when they are interchanged.

Namely, in FIG. 47, the paper cassettes 400 are parted and the paper cassette 400 on the feeding side 11 is in a rotatable state. In this state, when the turntable 200 is rotated so as to interchange the paper cassettes, they take a larger turning space. On the other hand, in FIG. 48, the paper cassettes 400 are positioned according to the rotating operation of this embodiment. When the turntable 200 is rotated in this state, the paper cassettes 400 occupy a reduced turning space.

Figure 49:
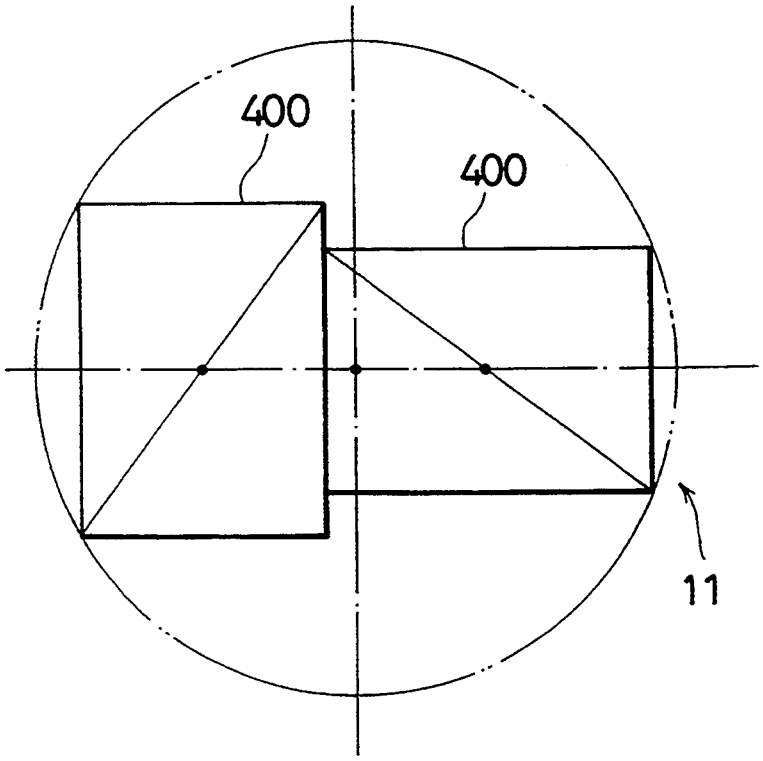
FIG. 49 is a view illustrating the paper cassettes which are disposed closely so as to have a minimum turning space, wherein one of the sides of one paper cassette faces one of the ends of the other cassette, and explaining the turning space occupied by the paper cassettes when their places are interchanged, in comparison with FIG. 48.
Figure 50:
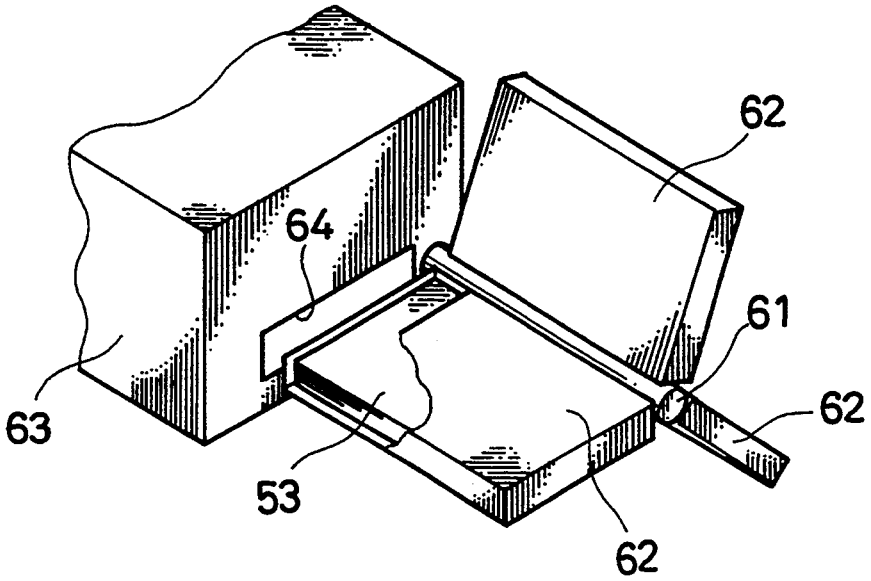
FIG. 50 PRIOR ART
FIG. 50 is a perspective view illustrating a conventional paper feeding apparatus.
Figure 51:
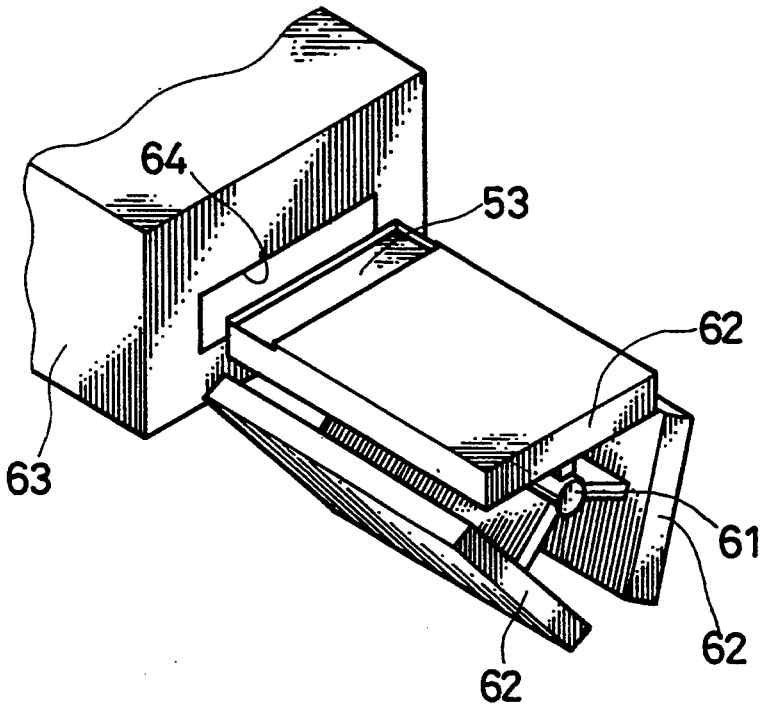
FIG. 51 PRIOR ART
FIG. 51 is a schematic perspective view illustrating another type of installation of paper cassettes on the supporting rod of the paper feeding apparatus shown in FIG. 50.

In the case where the paper cassette 400 on the feeding side 11 is placed for lengthways feed as shown in FIG. 49, the paper cassettes 400 also occupy a reduced turning space compared to that occupied by them when the turntable 200 is rotated without moving the paper cassettes 400 come closer to each other. In this case, one of the ends of the paper cassette 400 on the feeding side 11 faces the one of the sides of the paper cassette 400 on the non-feeding side. And, when the turntable 200 is rotated, they are moved to come closer to each other in order to reduce the space occupied by the paper cassettes 400 during the rotation of the turntable 200.

As described above, in the cassettes units 4 and 5, since the paper cassettes 400 are moved by the carriage driving mechanisms 310, they are always interchanged with a minimum turning space, irrespective of the positions and sizes of the paper cassettes 400. This configuration is especially effective for a feeding apparatus in which a paper cassette 400 installed on the carriage 300 is freely replaced with a paper cassette 400 of a different size.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A feeding apparatus, comprising:

a base member;

a plurality of storing means for storing copy material on which an image is to be copied;

carrying member installed rotatably on said base member for carrying said plurality of storing means, said plurality of storing means being freely movable in a radial direction of rotation substantially in a plane;

rotating means for rotating said carrying member;

moving means for moving said respective plurality of storing means in the radial direction of rotation of said carrying member, said moving means including a first transmitting means for transmitting a driving force in the radial direction of rotation generated by said moving means to said plurality of storing means, said first transmitting means and said plurality of storing means constituting movable members movable together in said radial direction;

movement controlling means which controls said moving means to move said respective movable members to positions closest to an axis of rotation of said carrying member when rotating said carrying member, for minimizing the turning space of said plurality of storing means; and rotation controlling means which controls said rotating means to rotate said carrying member after said movable members are moved to the positions, for interchanging said movable members on a feeding side and said movable members on a non-feeding side, wherein the copy material in one of said plurality of storing means located on the feeding side is fed in a feeding direction.

2. The feeding apparatus according to claim 1, wherein said rotating means includes:

a rotation driving source for producing a rotation driving force; and second transmitting means for transmitting the rotation driving force to the axis of rotation of said carrying member.

3. The feeding apparatus according to claim 1, wherein said moving means includes:

guiding means for guiding said plurality of storing means along the radial direction of rotation of said carrying member;

a driving source for producing a driving force; and auxiliary driving means which controls the driving force to move said plurality of storing means in the radial direction of rotation of said carrying member.

4. The feeding apparatus according to claim 1, further comprising detecting means for detecting a rotation of said carrying member, wherein said rotation controlling means controls said rotating means based on an output signal of said detecting means.

5. The feeding apparatus according to claim 1, wherein said first transmitting means includes said carrying member having said plurality of storing means mounted thereon, said carrying member directly receiving the driving force of said moving means.

6. The feeding apparatus according to claim 5, wherein said moving means further includes a driving source for generating the driving force, said driving source constitutes said movable member together with said first transmitting means and said plurality of storing means.

7. The feeding apparatus according to claim 6, wherein said carrying member is mounted on a lower surface of said plurality of storing means, and said driving source is mounted on a lower surface of said carrying member.

8. A feeding apparatus, comprising:

a base member;

a plurality of storing means for storing copy material on which an image is to be copied;

carrying member installed rotatably on said base member for carrying said plurality of storing means, said plurality of storing means being freely movable in a radial direction of rotation substantially in a plane;

rotating means for rotating said carrying member wherein said rotating means includes:

a rotation driving source for producing a rotation driving force, wherein said rotation driving source is a motor, transmitting means for transmitting the rotation driving force to an axis of rotation of said carrying member;

said transmitting means includes:

a series of gears;

a first body of rotation, said first body and an output shaft of said series of gears being coaxial;

a second body of rotation, said second body and the axis of rotation of said carrying member being coaxial and an endless member attached around said first body and second body;

moving means for moving said respective plurality of storing means in the radial direction of rotation of said carrying member;

movement controlling means which controls said moving means to move said respective plurality of storing means to positions closest to the axis of rotation of said carrying member when rotating said carrying member, for minimizing the turning space of said plurality of storing means; and rotation controlling means which controls said rotating means to rotate said carrying member after said plurality of storing means are moved to the positions, for interchanging one of said storing means located on a feeding side and one of said plurality of storing means located on a non-feeding side, wherein the copy material in said one of said plurality of storing means located on the feeding side is fed in a feeding direction.

9. The feeding apparatus according to claim 8, wherein said second body of rotation is mounted on a reverse side of a face of said carrying member, said plurality of storing means being installed on the face.

10. The feeding apparatus according to claim 8, wherein said first body of rotation and said second body of rotation are pulleys, and said endless member is a timing belt.

11. A feeding apparatus, comprising:

a base member;

a plurality of storing means for storing copy material on which an image is to be copied;

carrying member installed rotatably on said base member for carrying said plurality of storing means, said plurality of storing means being freely movable in a radial direction of rotation substantially in a plane;

rotating means for rotating said carrying member;

moving means for moving said respective plurality of storing means in the radial direction of rotation of said carrying member; wherein said moving means includes:

guiding means for guiding said plurality of storing means along the radial direction of rotation of said carrying member;

wherein said guiding means includes:

at least two guide bars, the guide bars being laid in the radial direction of rotation of said carrying member with an axis of rotation of said carrying member between them; and a movable plate on which said storing means is installed, said movable plate being supported by and slidable over said guide bars;

a driving source for producing a driving force; and auxiliary driving means which controls the driving force to move said plurality of storing means in the radial direction of rotation of said carrying member;

movement controlling means which controls said moving means to move said respective plurality of storing means to positions closest to the axis of rotation of said carrying member when rotating said carrying member, for minimizing the turning space of plurality of said storing means; and rotation controlling means which controls said rotating means to rotate said carrying member after said plurality of storing means are moved to the positions, for interchanging one of said plurality of storing means located on a feeding side and one of said plurality of storing means located on a non-feeding side, wherein the copy material in said one of said plurality of storing means located on the feeding side is fed in a feeding direction.

12. A feeding apparatus, comprising:

a base member;

a plurality of storing means for storing copy material on which an image is to be copied;

carrying member installed rotatably on said base member for carrying said plurality of storing means, said plurality of storing means being freely movable in a radial direction of rotation substantially in a plane;

rotating means for rotating said carrying member;

moving means for moving said respective plurality of storing means in the radial direction of rotation of said carrying member wherein said moving means includes:

guiding means for said plurality of storing means along the radial direction of rotation of said carrying member;

a driving source for producing a driving force wherein said driving source is a motor mounted on a movable section, the movable section being movable on said carrying member, and;

auxiliary driving means which controls the driving force to move said plurality of storing means in the radial direction of rotation of said carrying member; wherein said auxiliary driving means includes:

transmitting means for transmitting a driving force of said motor;

convertor means for converting the driving force transmitted by said transmitting means into the driving force for moving said plurality of storing means in the radial direction of rotation of said carrying member;

movement controlling means which controls said moving means to move said respective plurality of storing means to positions closest to the axis of rotation of said carrying member when rotating said carrying member, for minimizing the turning space of said plurality of storing means; and rotation controlling means which controls said rotating means to rotate said carrying member after said plurality of storing means are moved to the positions, for interchanging one of said plurality of storing means located on a feeding side and one of said plurality of storing means located on a non-feeding side, wherein the copy material in said one of said plurality of storing means located on the feeding side is fed in a feeding direction.

13. The feeding apparatus according to claim 12, wherein said transmitting means is installed in the movable section, and includes a series of gears and a body of rotation, said body of rotation and an output shaft of said series of gears being coaxial, and wherein said converter means is a wire, said wire being wound around said body of rotation and extending in the radial direction of rotation of said carrying member, both ends of said wire being fixed to said carrying member.

14. The feeding apparatus according to claim 13, wherein said body of rotation is a pulley, and wherein said motor, said series of gears, and said pulley are mounted on said movable plate.

* * * * *